United States Patent [19]

Turner

[11] 4,294,155

[45] Oct. 13, 1981

[54] ELECTRONIC MUSICAL INSTRUMENT

[75] Inventor: James Turner, Stamford, Conn.

[73] Assignee: CBS Inc., New York, N.Y.

[21] Appl. No.: 112,895

[22] Filed: Jan. 17, 1980

[51] Int. Cl.[3] ..... G10H 1/24; G10H 1/36; G10H 5/00

[52] U.S. Cl. ..... 84/1.01; 84/1.03; 84/1.17; 84/1.24; 84/345; 84/370; 84/DIG. 4; 84/DIG. 12; 84/DIG. 25

[58] Field of Search ..... 84/1.01, 1.03, 1.17, 84/1.24, 345, 370, DIG. 4, DIG. 12, DIG. 25

[56] References Cited

U.S. PATENT DOCUMENTS

| | | | |
|---|---|---|---|
| 3,878,750 | 4/1975 | Kapps | 84/1.01 |
| 3,889,568 | 6/1975 | Amaya | 84/1.01 |
| 3,890,871 | 6/1975 | Oberheim | 84/1.01 |
| 3,894,463 | 7/1975 | Rocheleau | 84/1.01 |
| 4,157,049 | 6/1979 | Watanabe | 84/1.01 X |
| 4,177,708 | 12/1979 | Pinz et al. | 84/1.24 X |
| 4,184,400 | 1/1980 | Niimi | 84/1.03 |
| 4,190,826 | 2/1980 | Alles | 84/1.01 X |
| 4,191,083 | 3/1980 | Wilcox et al. | 84/1.03 X |
| 4,201,105 | 5/1980 | Alles | 84/1.01 |
| 4,215,619 | 8/1980 | Budelman et al. | 84/1.24 X |

*Primary Examiner*—Stanley J. Witkowski
*Attorney, Agent, or Firm*—Spencer E. Olson

[57] ABSTRACT

An electronic musical keyboard instrument that is controlled by a digital processor. Key and stops/effects statuses are sampled, during successive time intervals, and read into random access memory associated with the digital processor. After manipulation and/or supplementation of the status information to effect implementation of various features, key-representative signals are read out to tone generation and voicing circuits.

76 Claims, 31 Drawing Figures

| | BIT 0 | BIT 1 | BIT 2 | BIT 3 | BIT 4 | BIT 5 | BIT 6 | BIT 7 | |
|---|---|---|---|---|---|---|---|---|---|
| NOTE IN SOLO | 0 | 1 | 0 | 1 | 0 | 0 | 0 | 0 | 1711 |
| PREV. NOTE IN SOLO | 0 | 1 | 0 | 0 | 0 | 0 | 0 | 0 | 1712 |
| NEW NOTE IN SOLO | 0 | 0 | 0 | 1 | 0 | 0 | 0 | 0 | 1713 |
| INV. OF NEW NOTE IN SOLO | 1 | 1 | 1 | 0 | 1 | 1 | 1 | 1 | 1714 |
| INITIAL RESTRIKE MASK | 1 | 1 | 1 | 1 | 1 | 1 | 1 | 1 | 1715 |
| INV. ANDED WITH RESTRIKE | 1 | 1 | 1 | 0 | 1 | 1 | 1 | 1 | 1716 |
| FINAL RESTRIKE MASK | 1 | 1 | 1 | 0 | 1 | 1 | 1 | 1 | 1750 |
| COMBINED STATE | 0 | 1 | 1 | 1 | 0 | 0 | 0 | 0 | 1751 |
| COMBINED STATE ANDED WITH FINAL RESTRIKE MASK | 0 | 1 | 1 | 0 * | 0 | 0 | 0 | 0 | 1752 |

FROM 2020

2031
IS 3b OR 3# ON ?
NO
YES
2032
IS DIM. AUG. OR MIN. FLAG ON ?
YES
NO
2035
ARE BOTH ON ?
YES
NO
2033
IS MINOR FOOTSW. ON ?
YES
NO
2034
SET MINOR FLAG
2090
2036
IS 3b ON ?
NO
YES
2042
IS 5b OR 3# ON ?
NO
YES
2037
IS 5♮ OR 5# ON ?
NO
YES
2044
ARE BOTH ON ?
YES
NO
2039
ARE BOTH ON ?
YES
NO
2090
2045
IS 5b ON ?
NO
YES
2040
IS 5# ON ?
NO
YES
2043
SET MINOR FLAG; RESET DIM. & AUG. FLAGS
2038
RESET AUG. MIN. & DIM. FLAGS
2046
SET DIM. FLAG; RESET MIN. & AUG. FLAGS
2041
SET AUG. FLAG; RESET MIN. & DIM. FLAGS
TO 2050
TO EXIT

ELECTRONIC MUSICAL INSTRUMENT

BACKGROUND OF THE INVENTION

This invention relates to the field of musical instruments and, more particularly, to an electronic musical keyboard instrument that is controlled by a digital processor.

The technology of electronic musical keyboard instruments, or electronic organs, has made great advances in recent years, both in the quality of sound produced and in the number and type of operational features that add to the enjoyment and/or ease of playing the instrument. Many features are available in commercially sold electronic organs that allow even a novice musician to produce impressive combinations of sounds. In addition to the many standard voices and effects obtainable from the typical instrument, options are available whereby the user can, by merely selecting a stop or other control, cause automatic generation of chords, arpeggios, percussion rhythms, "walking bass" musical rhythm accompaniments, coupling, transposition, etc.

The described advances in the state of the art have been accompanied by unfortunate increases in complexity of the instruments. Even where modern electronic and computer-related techniques have been employed in implementing certain features of electronic organs, the amount and complexity of necessary hardward keeps the manufacturing cost high and is a limiting factor on reliability.

The large number of features that are available within the state of the art is a factor that tends to work against efficient manufacturing. The electronic organ producer must decide upon the number and type of features that will go into a given model to be produced. The temptation to have many models is high, since individual consumers have a wide variety of tastes and budgetary constraints with regard to the type and number of features that are considered necessary or desirable. However, the design and production of a large number of different models is generally inefficient. Also, if a new feature is to be added to an existing model, it may require redesign of the system for compatibility with the new feature and will at least involve the cost of whatever hardware is required for implementing the new feature.

It is among the objects of the present invention to provide an electronic musical keyboard instrument that has advantages in operation and reliability and which reduces complexity, as compared to existing instruments.

It is further object of the invention to provide an electronic musical instrument which has the flexibility to be efficiently configured with a wide variety of features and to which new features can be added with a minimum of effort and expense.

It is another object of the invention to provide new and useful operational features for an electronic musical keyboard instrument that allow greater user enjoyment.

SUMMARY OF THE INVENTION

The present invention is directed to an electronic musical instrument that includes at least one keyboard having a plurality of octaves of keys. A digital processor, preferably a so-called microprocessor, is provided, along with random access memory means coupled to the digital processor. Key sampling means, controlled by the digital processor, are provided for sampling, during successive time intervals, the statuses of the keys. Music generating means, typically including tone generating circuitry, voicing generation circuitry, and output transducers or speakers, are also coupled to the digital processor. The digital processor is operative, inter alia, to store the statuses of the keys in the random access memory means and to read out key-representative signals from the random access memory means to the music generating means.

In the preferred embodiment of the invention, the digital processor is operative to generate keyboard storage addresses specifying keyboard storage locations in the random access memory means, and to store the statuses of the keys in the random access memory means at the keyboard storage addresses. In this embodiment, the key sampling means forms, during each time interval, a set of digital words, each word having a plurality of bits that respectively represent the key statuses of the different octaves of a note of the chromatic scale. The set of digital words comprises twelve words (i.e., one for each note), the number of bits per word being a function of the number of octaves on the keyboard. The digital words are stored in random access memory means at the keyboard storage addresses and are subsequently read out of said addresses to the music generating means. Prior to being read out, however, the stored key status information may be subjected to manipulation and/or supplementation of other generated information in order to implement the functions of various features of the invention, as will be described in detail below. Also, in the preferred embodiment of the invention, a plurality of stops/effects control switches are provided, along with stops/effects sampling means, controlled by the digital processor, for sampling, during successive time intervals, the statuses of the stops/effects control switches. The digital processor is operative to store the statuses of the stops/effects control switches in the random access memory means and to read out stops/effects-representative signals from the random access memory means to the music generating means.

The use of a digital processor to control virtually every operational aspect of the musical instrument is advantageous in a number of respects. The complexity of required hardware is reduced. Also, almost any desired automatic feature can be implemented or added with little or no significant additional hardware by properly programming or reprogramming the digital processor. Further, as will become clear, the format of the digital words generated by the key sampling means, and stored in the random access memory associated with the digital processor, facilitates overall operation, and especially facilitates the implementation of various features to be described.

A brief summary of some of the features to be set forth below in detail is as follows:

An automatically generated musical rhythm accompaniment, called "orchestral rhythm accompaniment" is generated and played from keyboard-related voices. The musical pattern of this orchestral rhythm accompaniment, as well as the musical pattern of a generated walking bass feature, is variable and is automatically modified to be compatible with (i.e., to avoid dissonance with) the keyboard music being played by the user.

Another feature of the invention is called "restrike". There are a number of situations that can be encountered when playing an electronic organ which result in the disturbing occurrence of a note "missing" from a musical sequence. Such situations occur when a particular note has been played and is being sustained, and during such sustenance the note is again played from another source (e.g. from the other keyboard or from an automatically generated note pattern such as an automatically generated chord or arpeggiation). When this occurs, the note being sustained will not strike again. For a situation such as two piano voices, the resultant "dead" spot is particularly noticeable and unpleasant. With the "restrike" feature of the present invention, the situation of a sustained note being again played from another source is sensed and the appropriate manipulations in memory are made to cause a restrike of the note, thereby eliminating the "dead" spot in the music.

Another feature of the invention is called "manual memory". When this feature is active, a continuous (in time) sequence of notes on one keyboard (e.g. the accompaniment keyboard) is sustained even after the player's hands have both been removed from the keyboard (e.g. for two-handed playing on a different keyboard, to change a stop, etc.) and this condition continues until a new note is played on the accompaniment keyboard, whereupon the previously sustained notes are cleared.

Further features and advantages of the invention will become more readily apparent from the following detailed description when taken in conjunction with the accompanying drawings.

DESCRIPTION OF THE PREFERRED EMBODIMENT

Figure 1:
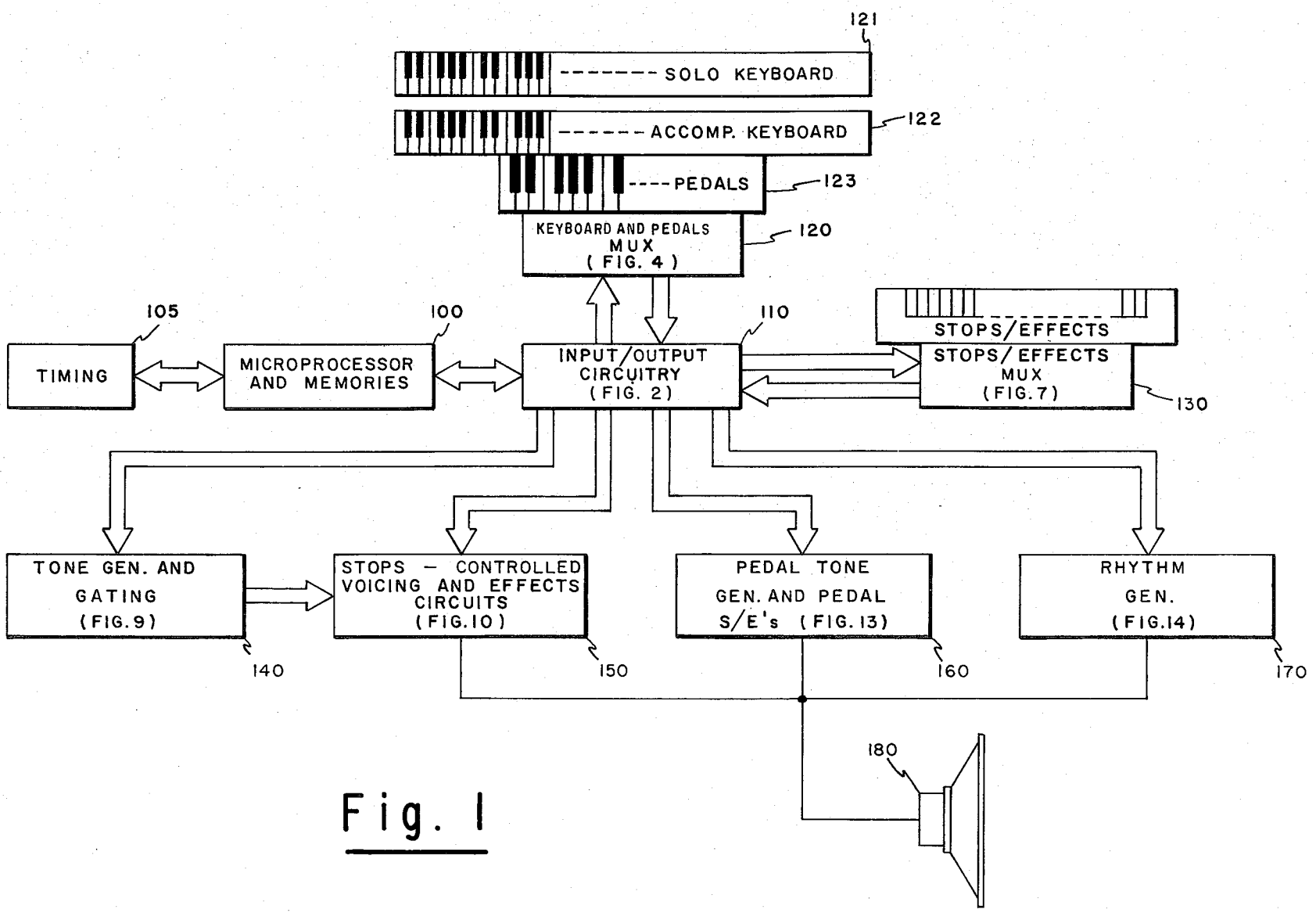
FIG. 1 is a block diagram of an apparatus in accordance with an embodiment of the invention.

Referring to FIG. 1, there is shown a block diagram of an apparatus in accordance with an embodiment of the invention. A microprocessor 100 is provided. In one implementation of the invention, the microprocessor utilized was a model Z-80 manufactured by Zilog Corporation. In the referenced implementation, the microprocessor was equipped with the following memory capabilities: 12,288 bytes of read-only memory (ROM) storage (including room for storage of the operating program), and 1,024 bytes of random-access memory (RAM) storage. It will be understood, however, that other general purpose or special purpose computing means, having suitable memory and logical processing capabilities, could readily by employed consistent with the teachings of the invention. In the present specification, the microprocessor 100 is programmed in accordance with the flow diagrams which shall be set forth. A block 105 represents the timing circuitry which is coupled, in conventional manner, to the microprocessor, consistent with instructions generally set forth by the manufacturer of the particular microprocessor. In the referenced implementation of the invention, the timing block comprises a 4 MHz clock and a Signetics NE555 IC timer chip. A variable resistor, controlled by a potentiometer on the instrument console, determines the clock rate at which interrupts are generated, such as for the purpose of controlling production of rhythms, as will be described.

Communication between the microprocessor and the various operational blocks of FIG. 1 is generally performed via input/output circuitry 100. The circuitry 110 includes output ports (also called output latches) which can be individually enabled to direct information from the microprocessor 100 to the various units of the system. The circuitry 110 also includes input ports (also called input gates) which can be individually enabled to direct the flow of information from the individual operational blocks or units toward the microprocessor 100. In the present embodiment there are sixty-four output ports available and eight input gates available. The input/output circuitry is described in further detail in conjunction with FIG. 2.

An output port of input/output circuitry 110 is coupled to keyboard and pedal multiplexer circuitry 120. Also, the keyboard and pedal multiplexer circuitry 120 is coupled to an input gate of input/output circuitry 110. The keyboard and pedal multiplexer 120 is described in further detail in conjunction with FIG. 4. Briefly, however, it can be noted that the keyboard and pedal multiplexer allows the status of the keyboards and pedals to be efficiently sampled or interrogated and read into RAM memory of the microprocessor 100, this operation being performed at a rate faster than about once every fifteen milliseconds. In the present embodiment the keyboard and pedal multiplexer 120 is coupled to a solo keyboard 121, an accompaniment keyboard 122, and foot pedals 123. The microprocessor 100 also communicates both ways with a stops/effects multiplexer 130 through an output latch of input/output circuitry 110 and an input gate of circuitry 110. The stops/effects multiplexer 130 is described in conjunction with FIG. 7. Outputs from microprocessor 100 are also coupled, via output latches, to: tone generating and gating circuitry 140 (described in conjunction with FIG. 9), stops-controlled voicing and effects circuitry 150 (described in conjunction with FIG. 10), pedal tone generating and pedal stops/effects 160 (described in conjunction with FIG. 13), and rhythm generator circuits 170 (described in conjunction with FIG. 14). These circuits, under control of the microprocessor, as will be described, generate the audio signals which are coupled (with suitable operator-controlled amplification) to speakers 180.

Figure 2:
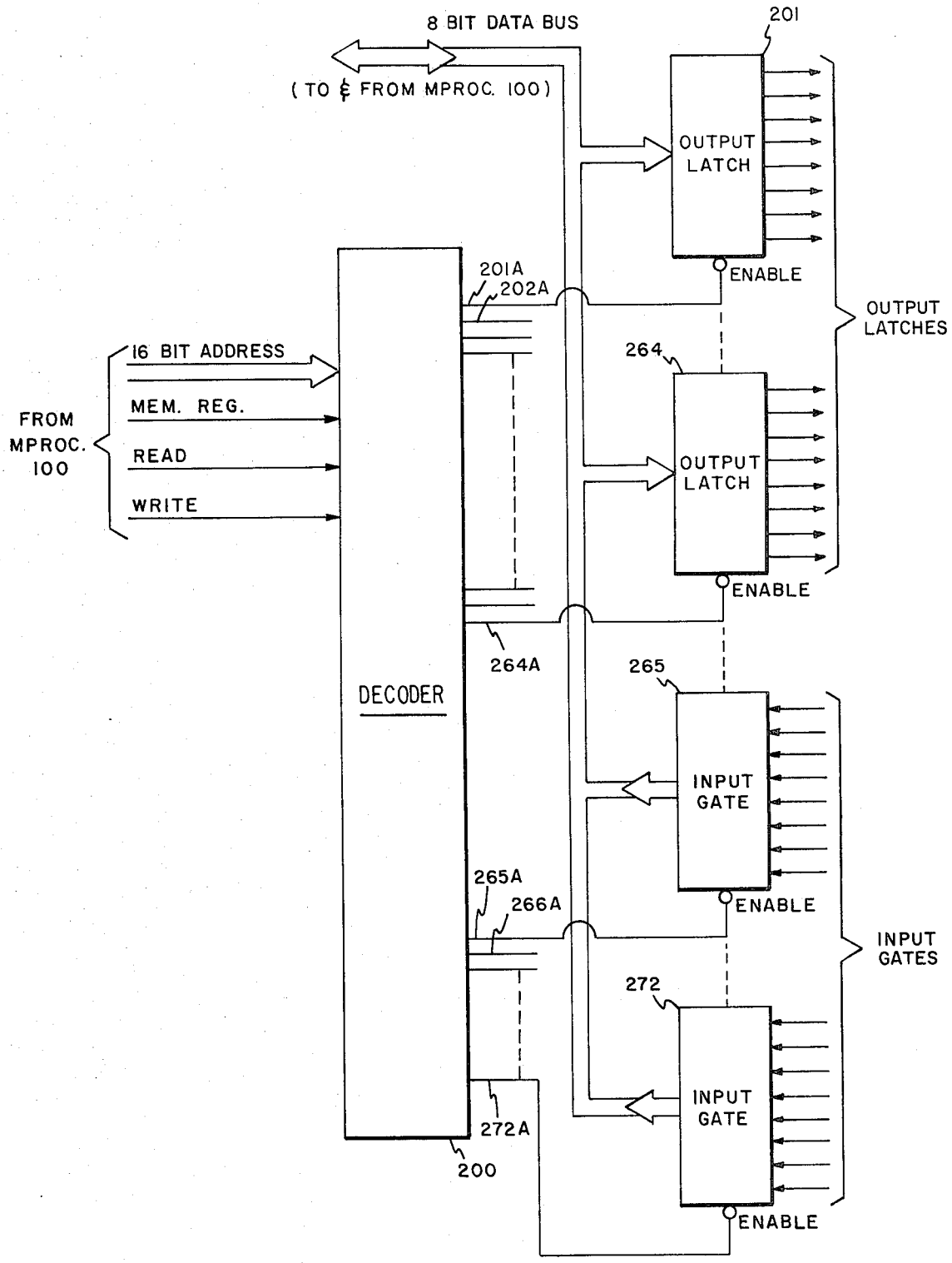
FIG. 2 is a block diagram of the input/output circuitry of FIG. 1 in accordance with an embodiment of the invention.

Referring to FIG. 2, there is shown a block diagram of the input/output circuitry 110 of FIG. 1 in accordance with an embodiment of the invention. A decoder, 200, which may comprise a bank of TTL decoder chips or a ROM, receives at its inputs a "16 bit address bus", a "memory request" line, a "read" line, and a "write" line, which are all conventionally provided from the microprocessor 100. The decoder 200 is responsive to these input signals to generate an output enable signal on one of seventy-two enable lines designated 210A through 272A. Enable lines 201A through 264A are coupled to respective enable terminals of sixty-four output ports which are latches designated by reference numerals 201 through 264. Enable lines 265A through 272A are coupled to respective enable terminals of eight input gates designated by reference numerals 265 through 272. The output latches (or ports) may be of the 74LS373 type TTL latch manufactured by National Semiconductor Corp., and the input gates may be of the 74LS244 type TTL gate, also manufactured by National Semiconductor Corp.

Each of the output latches 201 through 264 and each of the input gates 265 through 272 is coupled on one side to the eight bit data line bus of microprocessor 100. The other sides of the output latches and input gates are coupled to the various units of FIG. 1, such as 120, 130, 140, 150, 160 and 170. The decoder is operative to place an enable signal on one of the lines 201A–272A by decoding an instruction from the microprocessor which consists of an address plus a read or write indication. For example, to place an enable signal on enable line 201A, the microprocessor would issue a signal on the "write" line along with an address whose last eight bits are, say, "00000001" (the first eight bits of the address are used to address the ROM decoder 200 itself). Simultaneously with issuing these commands to the decoder 200, the microprocessor 100 would typically apply to the data bus the eight bits of data which are to be communicated. In this manner, the eight bits of data would be allowed to flow through output latch 201 to a particular unit of the system; e.g. to the keyboard and pedal multiplexer 120. As a further example, to communicate via output latch number 201, the microprocessor 100 would produce a signal on the "write" line and an address whose last eight bits are "00001010" (10 in decimal). This would result in an enable being placed on output line 201A. The microprocessor would simultaneously apply the appropriate data bits to be sent, via output latch 201, to the eight bit data bus. As a still further example, assume that the microprocessor is to receive data via input gate 265. In such case the microprocessor would issue a signal on the "read" line along with an address whose last eight bits are "00000001". (It can be noted that this address of the first input gate is the same as the address of the first output latch. They are distinguished, however, by the fact that one is issued in conjunction with a "write" command, whereas the other is issued in conjunction with a "read" command.) In this case, eight data bits would be received at the microprocessor (via input gate 265) on the data bus. If input gate 265 is, for example, used for communication with keyboard and pedal multiplexer 120, eight data bits from the keyboard and pedal multiplexer would be conveyed to the microprocessor 100.

Figure 3:
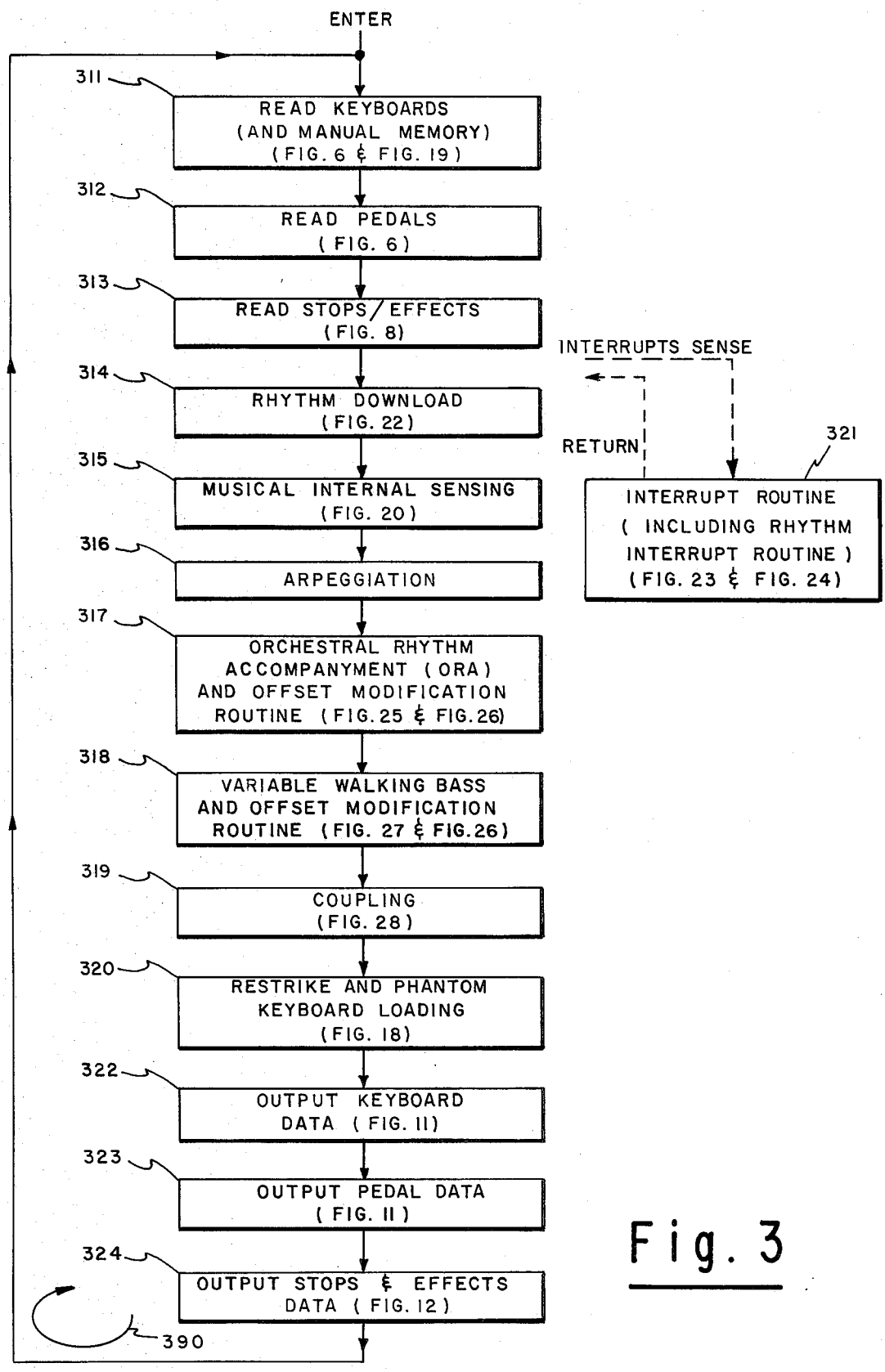
FIG. 3 is a flow diagram of a main operational routine that is useful in understanding the operation of the system of FIG. 1.
Figure 19:
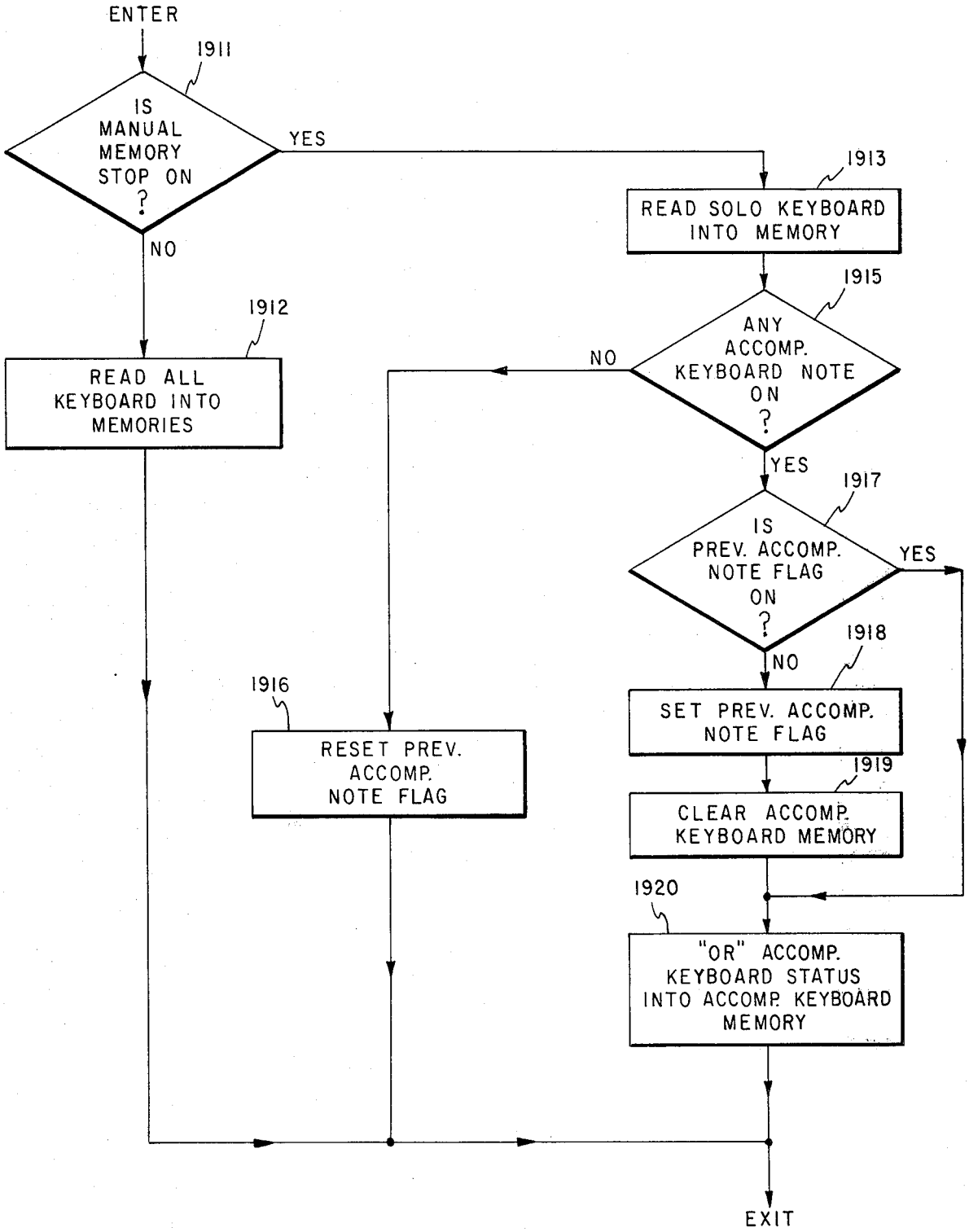
FIG. 19 is a flow diagram for implementing the manual memory feature of the invention.

Referring to FIG. 3, there is shown a flow diagram that is useful in understanding the overall operation of the system of FIG. 1. The microprocessor 100 is programmed in accordance with the flow diagram of FIG. 3, including certain subsidiary flow diagrams referred to in individual blocks of FIG. 3. Block 311 represents the reading of the status of the keyboards into memory. The routine for this function is set forth in further detail in conjunction with the flow diagram of FIG. 6, and the manner in which the key statuses are initially stored in memory is described, inter alia, in conjunction with FIGS. 4 and 5. (A feature called "manual memory", to be described in conjunction with FIG. 19, is also generally represented in the main flow diagram by block 311.)

Figure 6:
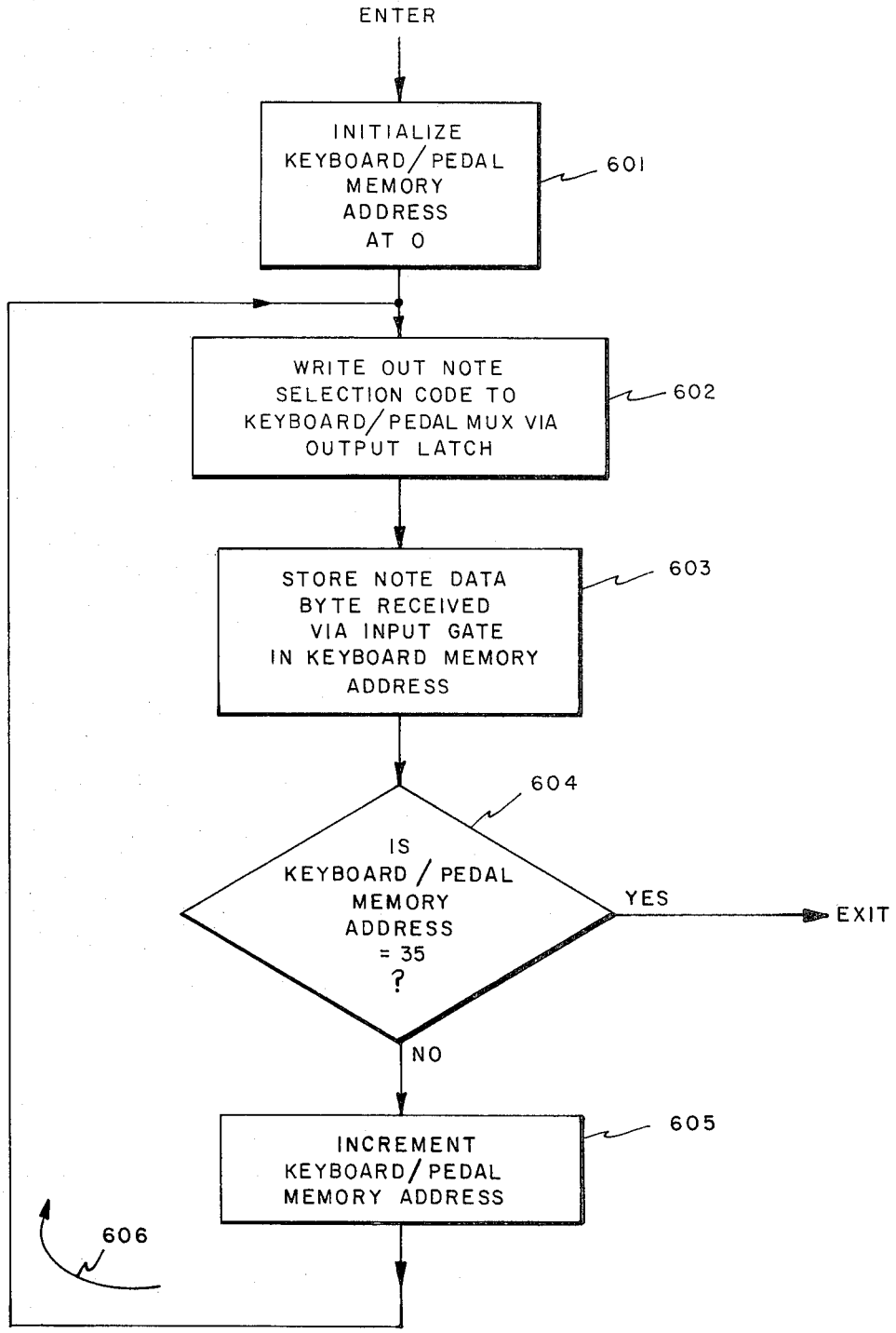
FIG. 6 is a flow diagram of the routine for reading the status of each keyboard and pedal note into the random access memory blocks shown in FIG. 5.

Block 312 represents the reading into memory of the pedal statuses, and description of this function is included in the description of FIG. 6. The next block, 313, represents the reading of the stops and effects switches on/off status into memory. Momentary reference can be made to FIG. 7, which will be described further hereinbelow, for a preliminary view of the stops and effects switches (and associated functions) described in the present embodiment. It will become clear that in addition to those specifically disclosed herein, various other stops/effects and their associated functions can be implemented using the techniques of the invention.

Figure 20A:
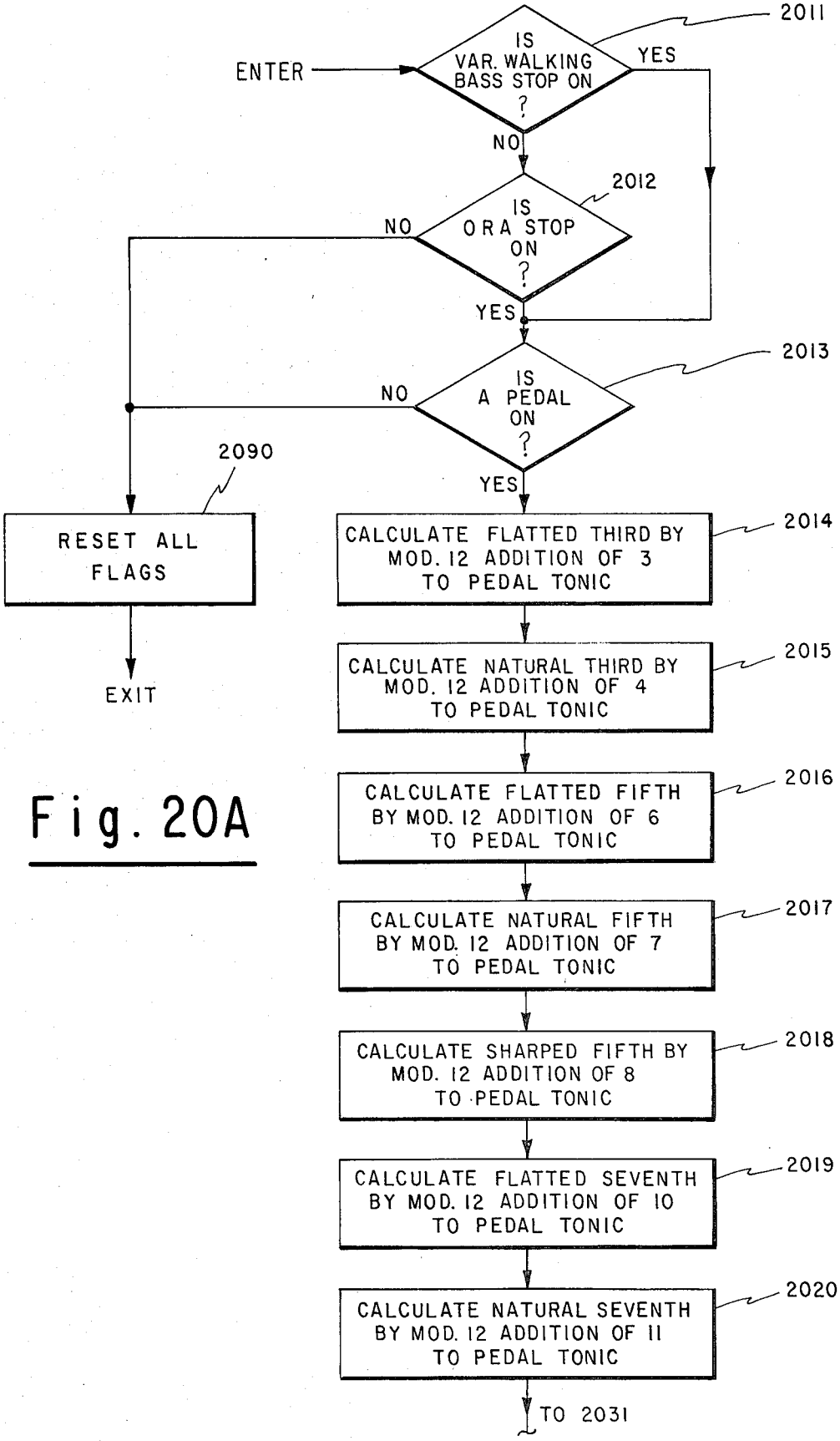
FIG. 20 which includes FIGS. 20A, 20B, and 20C placed one-below-another, is a flow diagram of the routine for automatically sensing musical intervals between notes being played on the accompaniment keyboard and an operator-selected musical tonic.
Figure 20B:
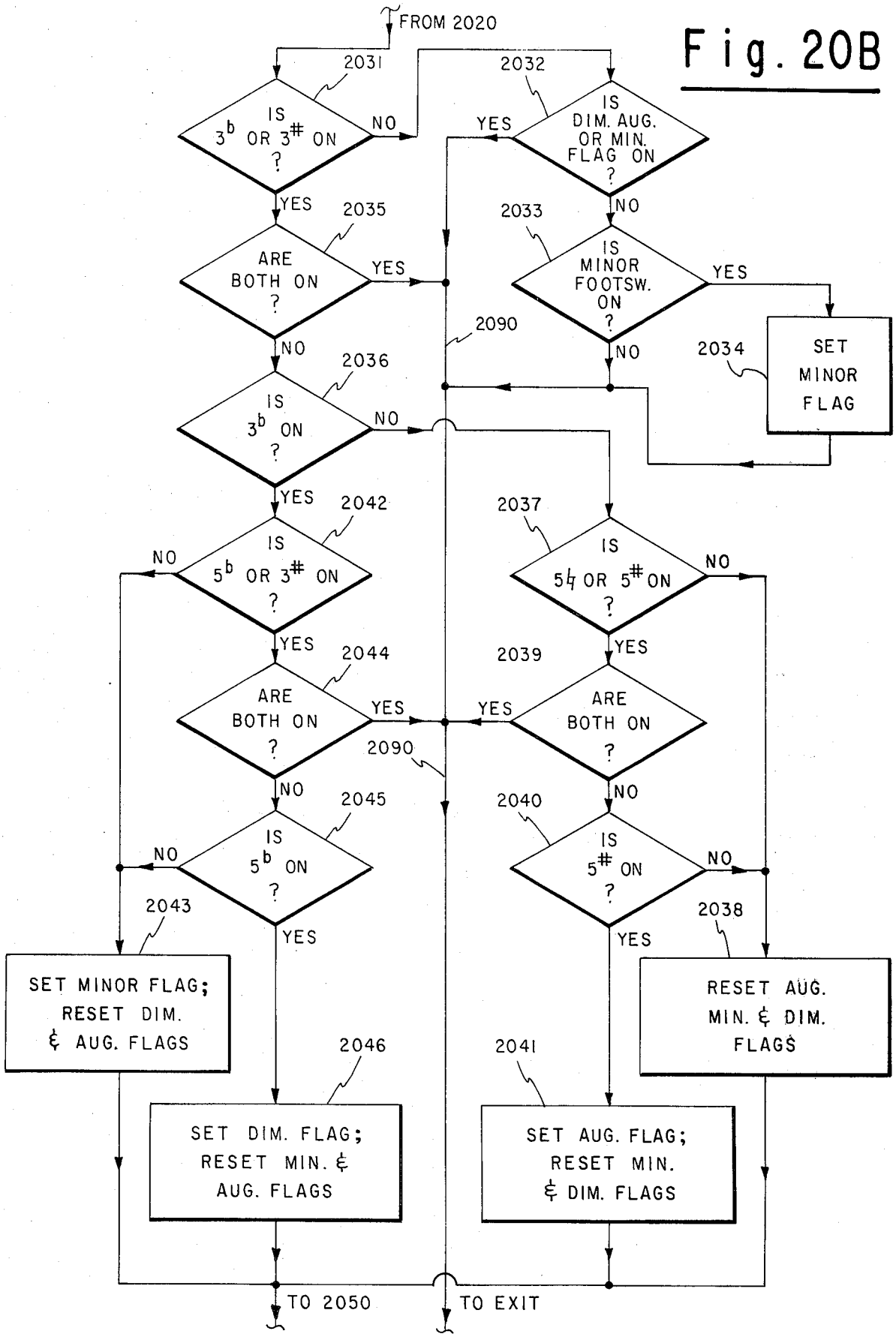
Figure 20C:
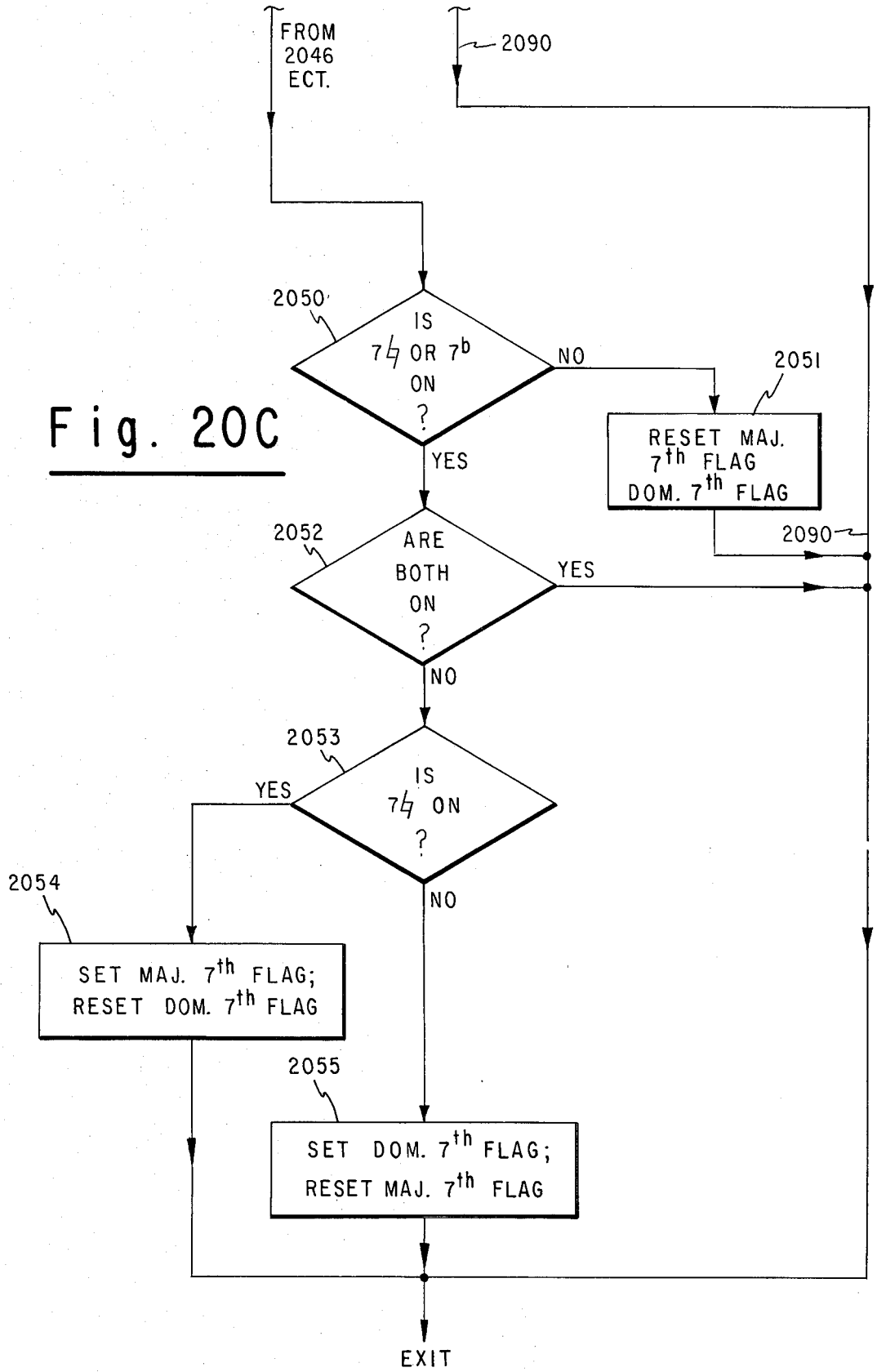
Figure 22:
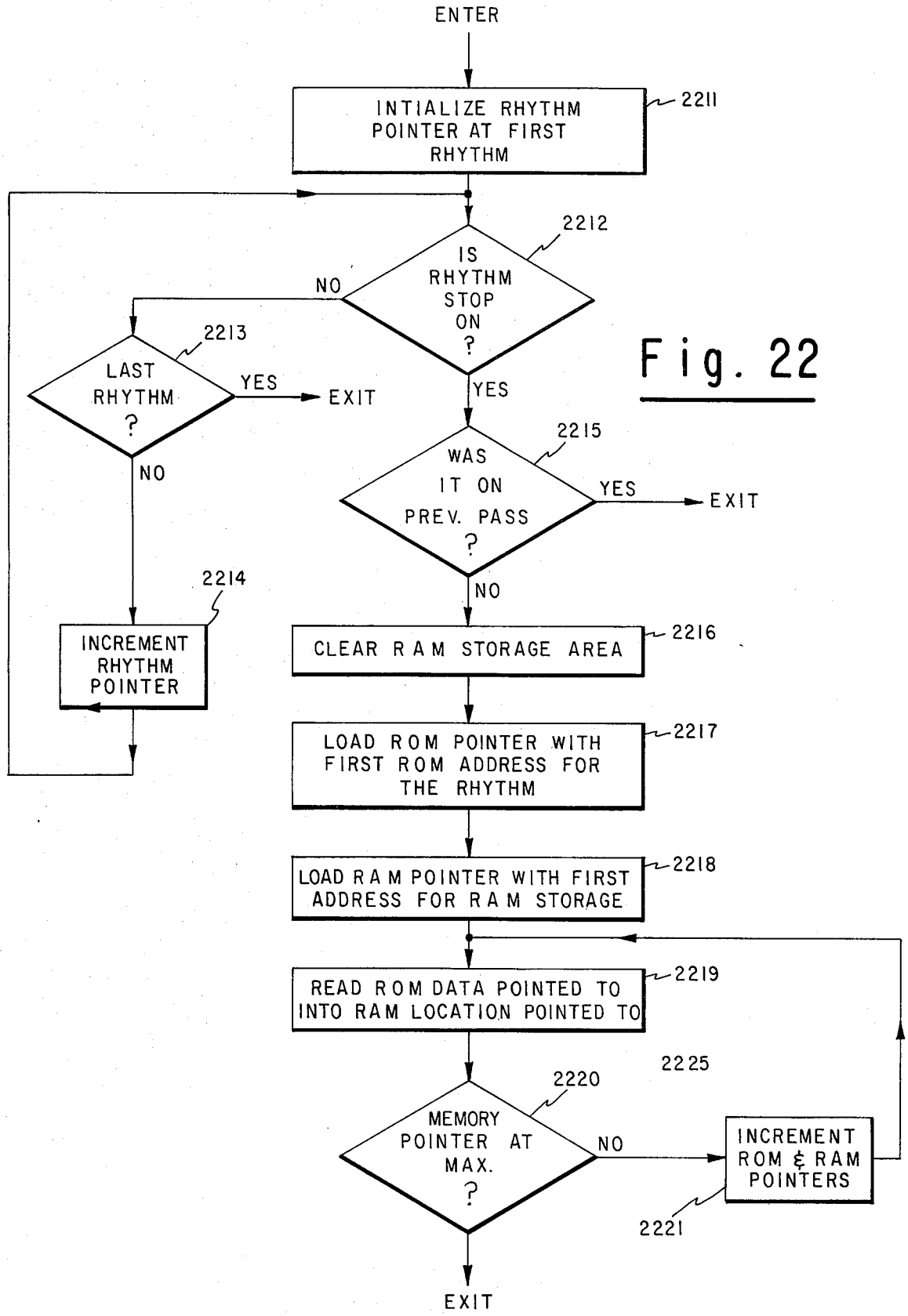
FIG. 22 is a flow diagram of the routine for downloading stored rhythm patterns from read-only memory to random access memory.

The blocks 314–321 represent manipulation of the read-in data and/or generation of other data (some of which is combined with the manipulated read-in data) to obtain finally constituted data that is used to control generation of music and rhythm audio signals by the circuits 140–160 (FIG. 1). Briefly, block 314 represents the "downloading" from ROM memory to RAM memory of predetermined rhythm and musical (rhythm accompaniment) patterns. FIG. 22 shows the downloading routine. Only those preselected rhythms and musical rhythm accompaniment patterns that are being used at a given time are downloaded and processed (as will be described), so other patterns not being used at such time can remain idly in ROM without wasting RAM storage or processing time. The block 315, detailed in conjunction with the flow diagram of FIG. 20, represents the detection of predetermined musical intervals (with respect to a tonic defined by a pedal being played). Representations of the musical intervals found are stored by setting appropriate flags, for subsequent use, as will be explained. The detected musical intervals are used later in the main routine of FIG. 3; specifically during the routines for orchestral rhythm accompaniment (block 317) and variable walking bass (block 318). Arpeggiation (block 316) is a known feature of existing electronic organs, and involves the automatic playing of runs up and/or down a keyboard, the notes used in the runs being dictated by the keys being played at a given time. The manner in which arpeggiation can be implemented (if desired) using the system of the present invention, is described below.

Automatic generation of various rhythms such as "waltz", "samba", "jazz swing", etc., are generated using selected combinations of rhythm instrument sounds, generated by block 170. The rhythm sound generation control is represented within block 321, an "interrupt" routine. When periodic interrupt signals occur, the main routine of FIG. 3 is temporarily interrupted at a given sense point, and the "interrupt" routine of block 321 is performed, after which return is made to the given point of the main routine. Also, during the interrupt routine, certain counters or pointers are set or incremented (as will be described) to keep track of the timing of predetermined rhythm patterns and/or musical rhythm accompaniment patterns and/or arpeggio note timing. One automatically generated musical rhythm accompaniment of the present embodiment is the "variable walking base", control of which is represented by the block 318 of FIG. 3, and detailed in conjunction with the flow diagrams of FIGS. 26 and 27. Briefly, a walking bass generates a repetitive musical accompaniment using the pedal voices, the musical accompaniment being at a rhythm which is in accordance with an operator-selected rhythm and which is played in a key that is operator-selected and determined by the pedal being played. Typically, the musical accompaniment for each rhythm can be different. In accordance with a feature of the invention, the musical pattern of the walking bass is variable and is automatically modified to be compatible with the keyboard music being played. In accordance with a further feature of the invention, a musical rhythm accompaniment called "orchestral rhythm accompaniment" ("ORA") can also be generated, as represented by block 317 in FIG. 3, and detailed in conjunction with the flow charts of FIGS. 26 and 27. The orchestral rhythm accompaniment is generated in the present embodiment using the orchestral voices. This generated musical accompaniment is also variable and automatically modified or adjusted for musical compatibility with the keyboard music being played. Block 319 represents coupling as implemented using the present invention, and described in conjunction with the flow chart of FIG. 28. Block 320 represents the routines for implementing the restrike and phantom keyboard loading features of the invention, which are described further below in conjunction with the flow diagram of FIG. 18.

Figure 11:
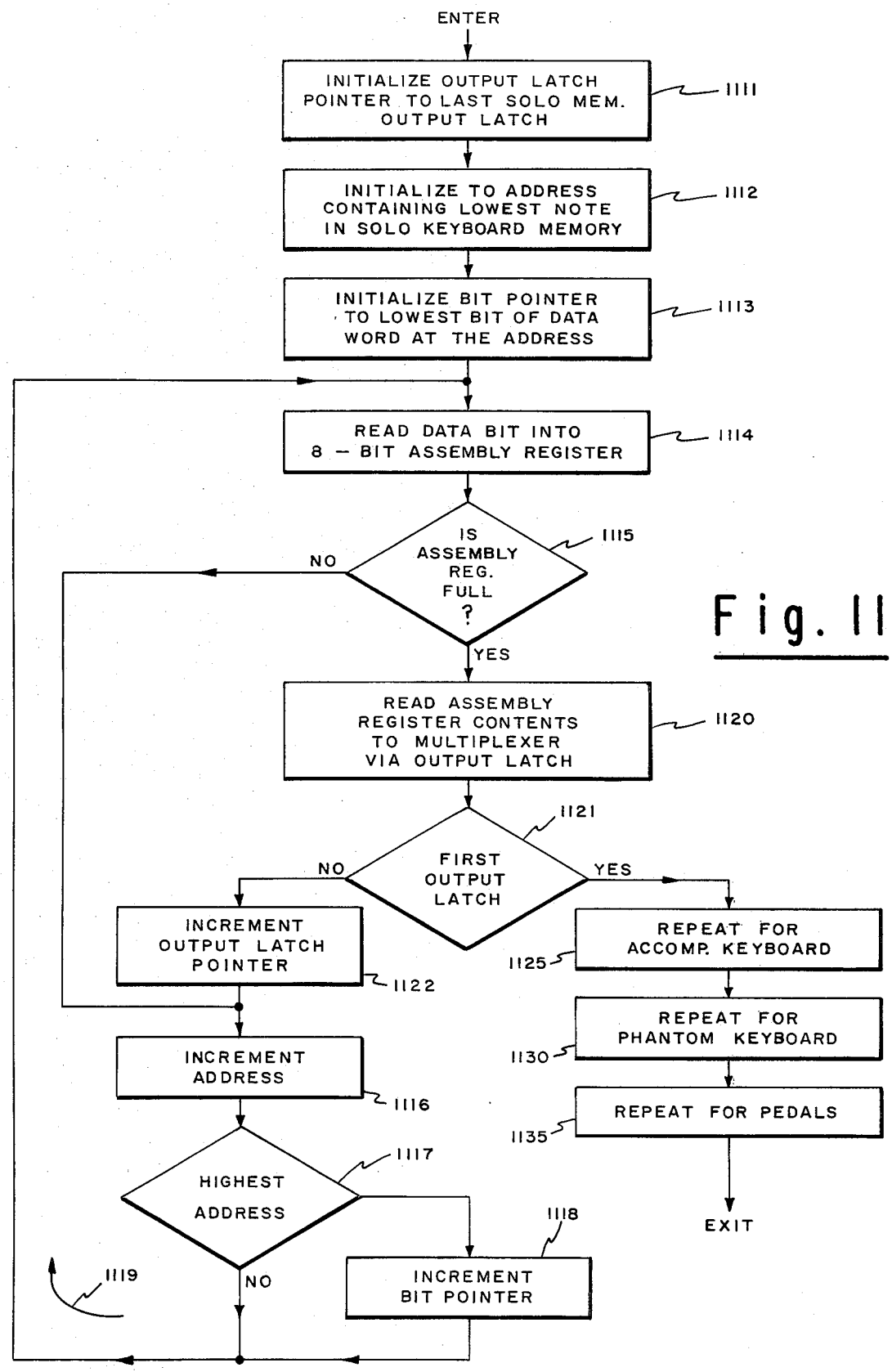
FIG. 11 is a flow diagram of the routine for outputting the keyboard data.

The blocks 322 and 323 represent the readout of the keyboard and pedal memories, the routine therefor being described in conjunction with FIG. 11. The read out information controls the generation of the desired musical tones by the tone generation and gating circuits 140 (FIG. 1). Block 324 represents the readout of the stored stops and effects information, the routine for this function being set forth in conjunction with the flow diagram of FIG. 12.

It is seen from the flow of the main routine, as set forth in FIG. 3, that repetitive cycles of a loop 390 are performed. The routine can be visualized as including reading sampled keyboard, pedal and stops/effects information (blocks 311–313), manipulating and/or adding to the read-in information and putting it into a form that can be used to control music and rhythm generation (blocks 314–321), and outputting the manipulated and/or newly generated information to the output circuitry which generates appropriate voice and rhythm audio signals. The time it takes to cycle through the loop 390 of FIG. 3 depends upon which of the functions (particularly blocks 314–321) are operating at a particular time and, of course, also depends upon the basic clock rate of the microprocessor. For a microprocessor clock frequency of 4 MHz, the cycle time through loop 390 for an operating implementation of the invention varied from less than about 5 milliseconds with the system "idling" to less than about 15 milliseconds with all functions operative.

Figure 4:
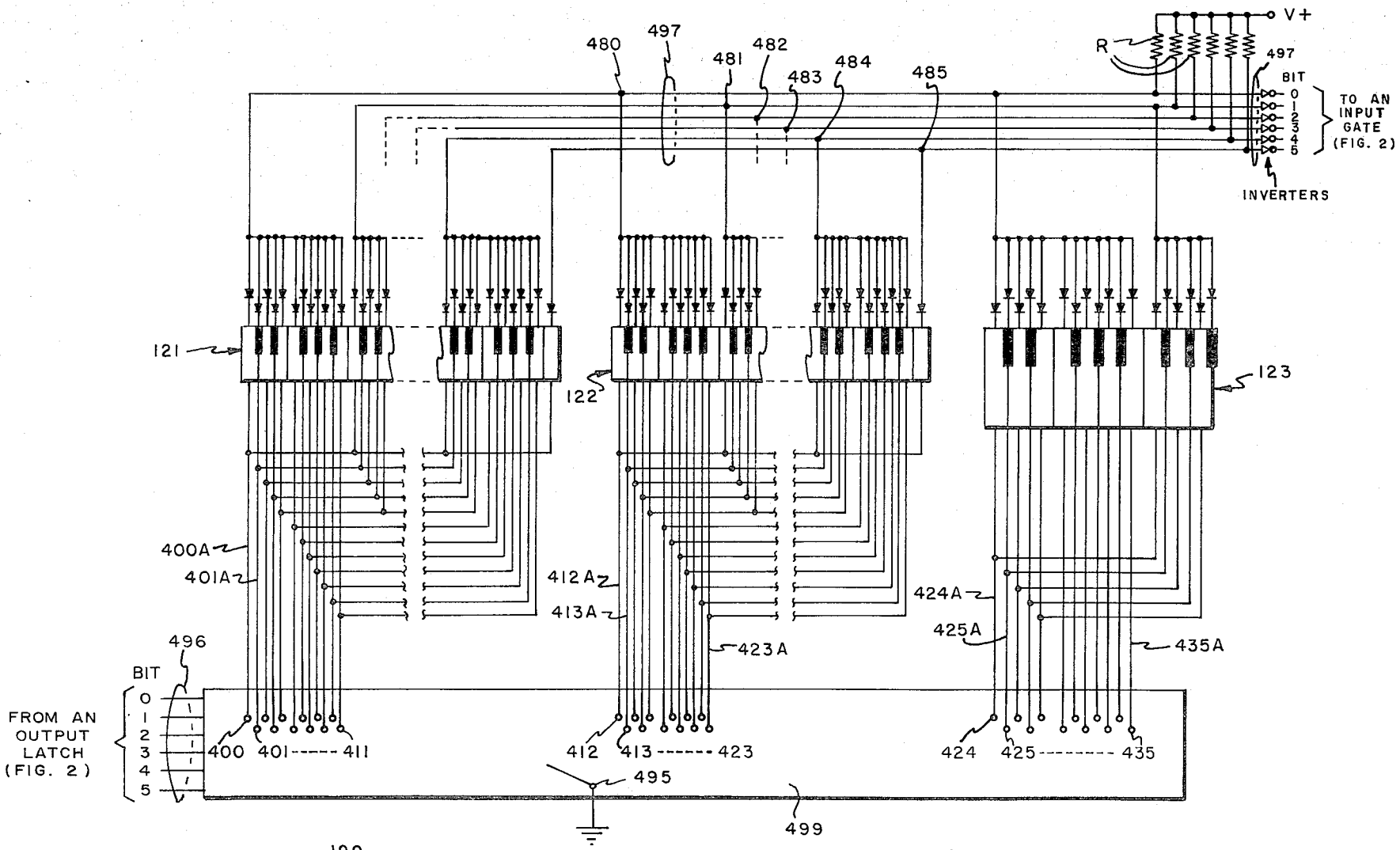
FIG. 4 is a block diagram, partially in schematic form, of the pedal and keyboard multiplexer or sampler of FIG. 1.

Referring to FIG. 4, there is shown a block diagram of the keyboard and pedal multiplexer 120 of FIG. 1, along with the solo keyboard 121, the accompaniment keyboard 122, and the pedals 123. A 36:1 multiplexer 499 is provided for coupling of thirty-six terminals 400 through 436 to a single terminal 495. The single terminal 495 is coupled to ground reference potential. The selection of which of the thirty-six terminals 400 through 435 is coupled to ground potential is controlled by input lines 496 which are the outputs of an output latch (FIG. 2). Thirty-six lines designated 400A–435A are respectively coupled to the thirty-six terminals 400–435. Each of the lines 400A–435A is respectively coupled to one terminal of the key contact of each octave of a particular note of the solo keyboard. For example, the line 400A is coupled to one key contact of each of the C's on the solo keyboard, the line 401A is coupled to all of the C♯'s, and so on. The other key contacts of all notes of each octave of notes on the solo keyboard are coupled in common, via individual diodes, to a common terminal which is, in turn, coupled via a resistor R, to a bias potential V+. Each common terminal is also coupled to one of the lines 497. For example, as seen in FIG. 4, one key contact of each note of the first octave of the solo keyboard 121 is coupled via a diode to common terminal 480 which is, in turn, coupled to bias potential V+ via a resistor R, and also coupled to line "bit 0" of the lines 497. Similarly, one key contact of each note of the second octave of the solo keyboard 121 is coupled to a common terminal 481. The common terminal 481 is coupled to bias potential V+ via a resistor R, and is also coupled to the line designated "bit 1" of the lines 497. The third, fourth, fifth and sixth octaves are similarly respectively coupled to common terminals 482–485 and to the lines designated "bit 2" through "bit 5", as well as to the reference potential V+ via respective resistors R. Each octave of key contacts of the accompaniment keyboard 122 is similarly connected to the same common terminals, to the bias potential V+, and to the lines 497. The same is true of pedals 123.

Operation of the keyboard and pedal multiplexer 120 is generally as follows: The microprocessor 100 issues a 6-bit code (actually, it is the last six bits of an address, as will be explained further hereinbelow), via an output latch, to the multiplexer 499. The 6-bit code (received on lines 486) determines the contact to which the multiplexer "wiper" is coupled, and thereby determines which notes (more precisely, all octaves of the same note on a particular keyboard) have a key contact that is grounded. If one of these keys is being played during this "sampling" instant, the voltage at the common terminal associated with the key being played will drop from a potential of V+ (a logical "1") to ground reference potential (a logical "0"). This results in six output bit (one for each octave of the particular note) appearing on the lines 497 which are coupled, via inverters, to an input gate. This "data" concerning the particular note is then stored by the microprocessor at a memory location having an address whose last six bits correspond to the code which had been originally used to select the particular note (i.e., all octaves thereof) to be interrogated. Having stored a data word which represents the particular note (for example, all C's on the solo keyboard) a new code word (also defining, in part, the next memory address) is issued to the multiplexer to cause the wiper thereof to ground all octaves of the next note (for example, to ground a key contact of all the C#'s on the solo keyboard). Again, depending upon which octaves of the note are being played at this "sampling" instant, the respective lines 497 coupled to the input gate will carry either a logical "0" or a logical "1", and the resultant 6-bit data word will be stored at the specified memory address. This procedure is followed for each of the twelve notes (i.e., C through B) of the solo keyboard 121, each of the twelve notes of the accompaniment keyboard 122, and each of the twelve notes of the pedals 123.

Figure 5:
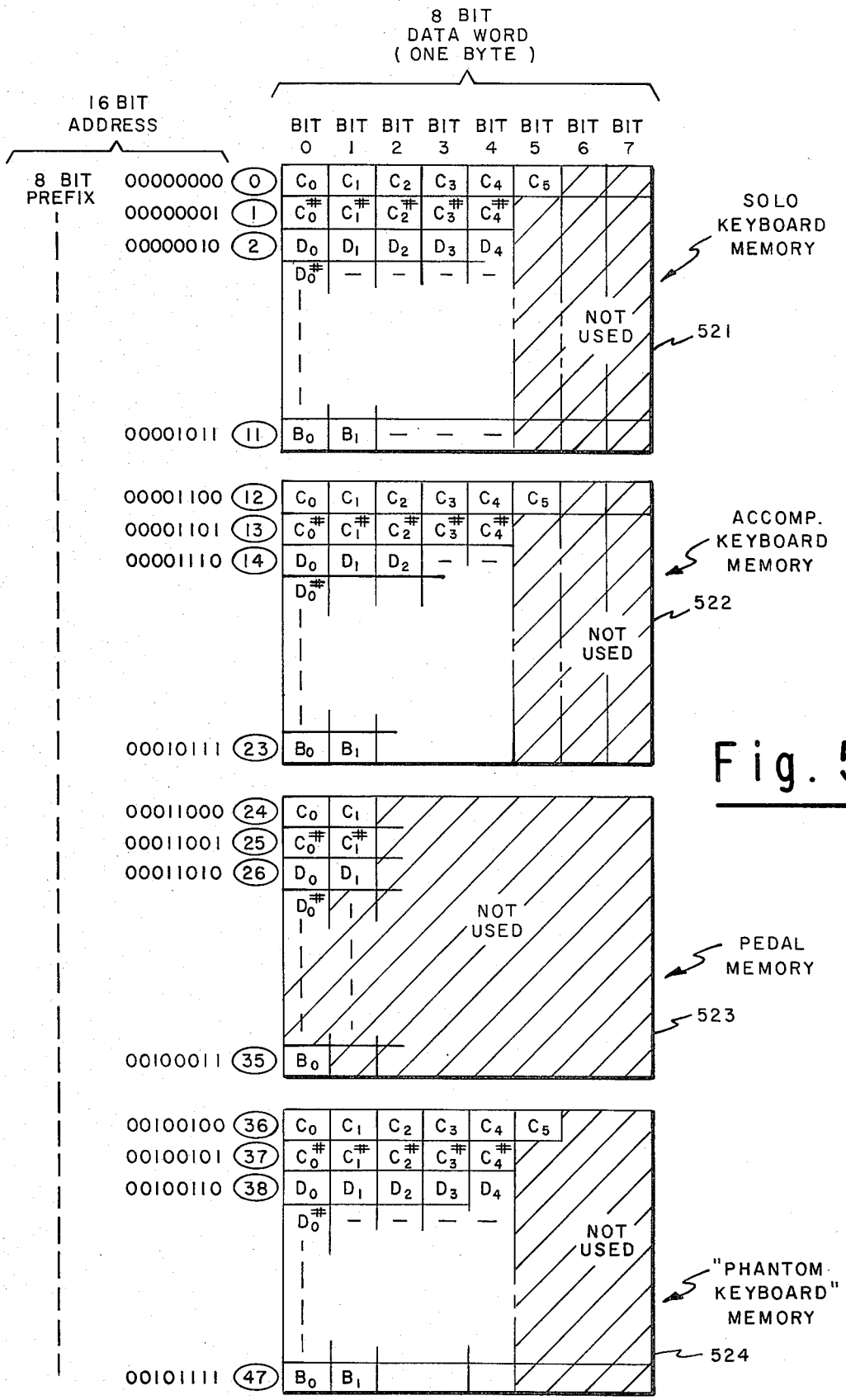
FIG. 5 illustrates address areas or memory blocks of the random access memory associated with the microprocessor as utilized in accordance with the present invention.

A further understanding of the operation of the multiplexer of FIG. 4, as well as an understanding of the manner in which the key statuses are stored in memory, is obtained with the aid of FIG. 5. FIG. 5 illustrates three blocks of random access memory (RAM) 521, 522 and 523 which are respectively used to store the key statuses of the solo keyboard, the accompaniment keyboard, and the pedals. (A fourth block of memory, called the "phantom keyboard memory" will be described hereinbelow.) Each of the solo, accompaniment, and pedal memories includes twelve 8-bit words or bytes (although not all bits of each byte are used), each of the twelve bytes representing the statuses of all octaves of a particular key on that keyboard. For example, the solo keyboard memory includes twelve 8-bit data words or bytes stored at addresses (shown to the left of the solo keyboard memory) whose last eight bits range from 00000000 to 00001011 in binary (0 to 11 in decimal). The decimal equivalents of the last eight bits of the addresses are shown circled. Stored in the first address, 0 (decimal), is an 8-bit data word or byte representative of the status of each C on the solo keyboard. Actually, in the present embodiment, only the first six bits of the byte are used, and these represent the statuses of six octaves of C's (designated $C_0$, $C_1$ . . . $C_5$) and the statuses of five octaves of the other notes (e.g. $B_0$, $B_1$ . . . $B_4$), there being 61 keys on each of the keyboards of this embodiment.

To understand operation and the nature of the first stored byte, assume that the last six bits of the address "00000000" (which is actually the last eight bits of a 16-bit address issued by the microprocessor, the first eight bits thereof designating the overall RAM storage area which includes the memory blocks of FIG. 5) are the same as the code which results in the wiper of multiplexer 499 being coupled to the left-most common terminal (400) which is, in turn, coupled to all of the C key contacts of the solo keyboard. Assume further that the C's of the second and third octaves (i.e., $C_1$ and $C_2$) are being played on the keyboard. In the manner previously described, this will result in bits 1 and 2 (of the lines 497 that are coupled via inverters to an input gate) being "1"'s and the other bits being "0"'s. Accordingly, the byte stored at address "00000000" ("0" in decimal) of memory 521 will be "01100000". In a similar manner, at the address "00000001" ("1" in decimal), there is stored a byte representative of the status of each C# on the solo keyboard. Thus, at the twelve addresses (decimal "0"through decimal "11") of memory 521 there are stored twelve bytes, each of which represents the statuses of the various octaves of each note of the solo keyboard.

The accompaniment keyboard memory 522 includes addresses "12" through "23" (in decimal), in which are stored data bytes obtained as the wiper of multiplexer 499 sequences through the common terminals 412 through 423. Each byte therefore reflects the status of each octave of one of the twelve notes of the accompaniment keyboard.

The pedal statuses are similarly stored in the pedal memory 523, at addresses 24 through 35 (decimal), as the wiper sequence through common terminals 424 through 435 (FIG. 4). There are only thirteen pedals in the present embodiment, so only the first or the first and second bits of each byte in the pedal memory contain meaningful information.

As noted above, a further memory block, designated 524 and including addresses "36" through "47" (in decimal), is used to store the status of notes of a "phantom keyboard" whose operation will be described further hereinbelow.

Referring to FIG. 6, there is shown a flow diagram of the routine for reading the status of each keyboard and pedal note into the RAM memory blocks shown in FIG. 5. Block 601 is first entered and the keyboard memory address pointer (in which a data word or byte is to be stored) is initialized at "0" (decimal). As previously described, this number is also used to code multiplexer 499 to select the proper common terminal (400). Accordingly, the data word "00000000" is put out to multiplexer 499 on the data bus while the address of the output latch (through which data lines 496 are coupled) is put on the address bus, thereby enabling said latch. This is represented by block 602 in FIG. 6. The code on the data bus thereby causes selection of common terminal 400. Now, the address of the input gate, to which lines 497 are coupled, is issued on the address bus to enable said gate, and the desired data byte (representative of the status of all octaves of "C" on the solo keyboard) is read into the keyboard and pedal memory address via said gate and the data bus. This is represented by block 603 in FIG. 6. Decision diamond 604 is then entered and determination is made as to whether or not the keyboard memory address equals 35. If so, the solo, accompaniment, and pedal memories are full, and the routine is exited. If not, block 605 is entered, and the keyboard memory address is incremented. Block 602 is then re-entered and the loop 606 is continued as the statuses of the notes of the keyboards and pedals are stored in the memory blocks of FIG. 5.

Figure 7:
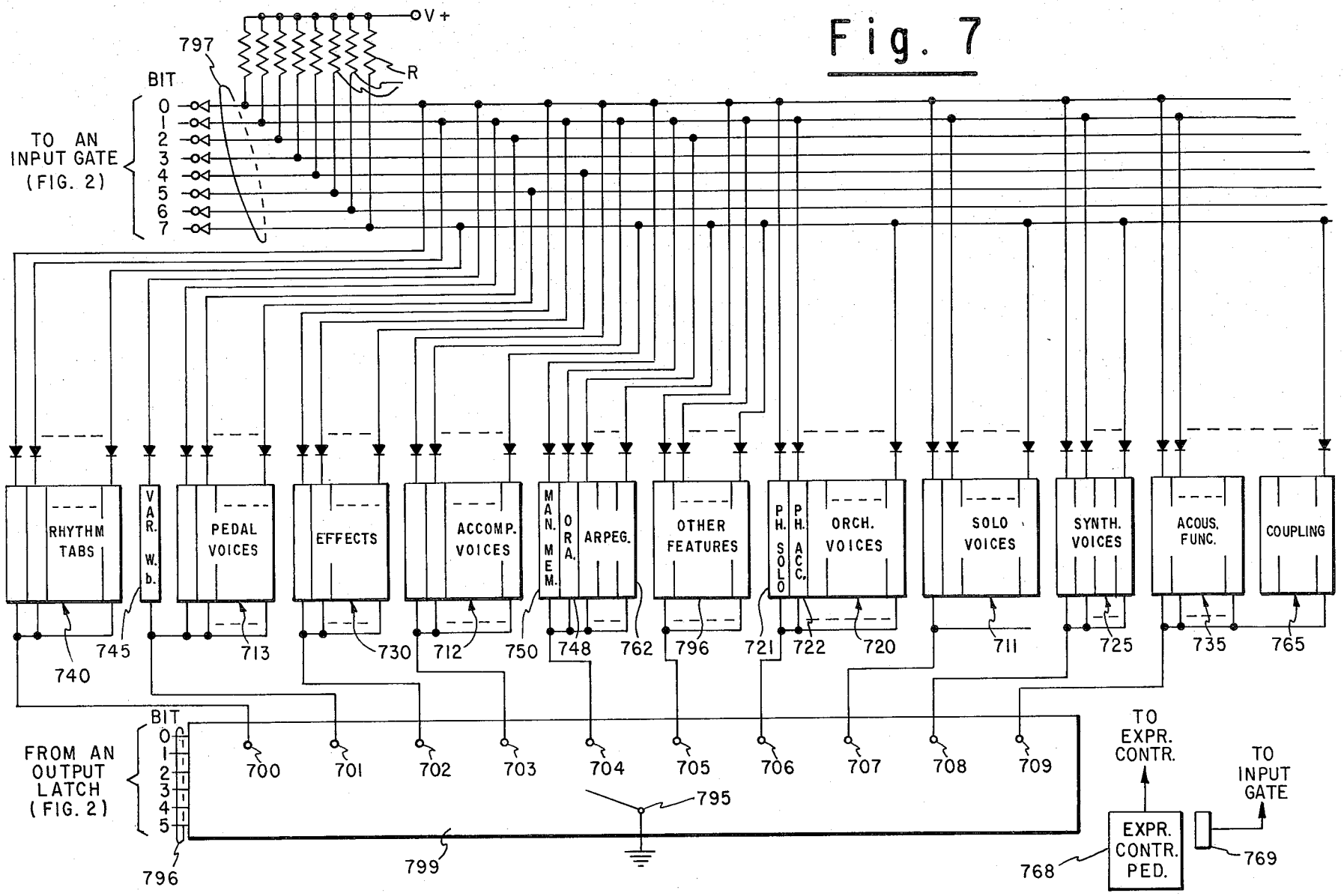
FIG. 7 is a block diagram, partially in schematic form of stops and effects control switches utilized in the present embodiment of the invention.

FIG. 7 illustrates some of the so-called "stops and effects" switches which are used in the present embodiment of the invention. These switches typically operate in the manner of toggle switches and are utilized by the person playing the musical instrument to select the various musical voices, rhythms, acoustical effects, and special features that are used in an electronic musical instrument. The operation of a number of these functions in the present invention will be described in further detail hereinbelow, but a brief explanation of the types of controls available to the person playing the musical instrument will now be set forth to gain some initial understanding. A bank of solo voice stops 711 are provided for controlling the generation of the typical solo voices played from the solo keyboard of an electronic organ; e.g. the various footage levels of tibia, diapson, string, etc. A bank of accompaniment voice stops 712 are provided for controlling the generation of the typical accompaniment voices played from the accompaniment keyboard of an electronic organ; again typically various footage levels of tibia, diapason, etc. A bank of pedal voices 713, which may again be the typical pedal voices of an electronic organ is also provided. A bank of orchestral voice stops 720 includes controls for such orchestral voices as piano, banjo, guitar, etc., and further includes "phantom-solo" and "phantom-accompaniment" stops 721 and 722 which respectively select whether the orchestral voices are to be played from the solo keyboard, the accompaniment keyboard, or both. As will be described further hereinbelow, the orchestral voices, whether played from the solo and/or accompaniment keyboards, are played from data that is stored in the "phantom keyboard" memory referred to above in conjunction with FIG. 5. A bank of synthesizer stops, for voices such as trumpet, trombone, etc., are indicated by reference numeral 725. These voices, like the solo voices, are played from the solo keyboard. Effects, such as "main tremolo", "tibia tremolo", etc., are controlled from tabs 730, and acoustic functions, such as "reverberation" and "sustain" are controlled by banks of stops designated 735. A bank of rhythm tabs 740 are provided for controlling the automatic generation of various rhythms such as "waltz", "samba", "jazz swing", etc. The rhythms are generated using selected combinations of rhythm instrument sounds. Also, when rhythm accompaniment musical voices are generated, the selected rhythm tab determines the rhythm of the automatically generated musical accompaniment. One such automatically generated musical rhythm accompaniment is the "variable walking bass", controlled by stop 745. Briefly, a walking bass generates a repetitive musical accompaniment using the pedal voices, the musical accompaniment being at a rhythm which is in accordance with the selected rhythm tab and which is played in a key that is determined by the pedal played by the person operating the musical instrument. Typically, the musical accompaniment for each rhythm can be different. In accordance with a feature of the invention, the musical pattern of the walking bass is variable and is automatically modified to be compatible with the keyboard music being played. In accordance with a further feature of the invention, a musical rhythm accompaniment called "orchestral rhythm accompaniment" ("ORA") can also be generated under control of a stop 748. The orchestral rhythm accompaniment is generated in the present embodiment using the orchestral voices. The generated musical accompaniment is also variable and automatically modified or adjusted for musical compatibility with the keyboard music being played.

In accordance with a further feature of the invention, there is provided a "manual memory" feature that is controlled by stop 750. When the manual memory feature is on, an overlapping sequence of notes played on the accompaniment keyboard is sustained even after the player's hands or hand (typically the left hand) have been removed from accompaniment keyboard (e.g. for two-handed playing on the solo keyboard, to change a stop, etc.). This condition continues until a new note is played on the accompaniment keyboard, whereupon the previously sustained notes are released.

A bank of stops 765 is provided to control "coupling"; i.e., the automatic generation of one or more higher or lower octaves of a note being played on either the same or a different keyboard. Stops 762 control arpeggiation and another bank of stops, 796, control other features that can be provided, if desired, such as automatic chord generation. A conventional expression control pedal 768 and minor footswitch 769 are also shown in FIG. 7. The expression control is coupled to the output amplification, and the status of the minor footswitch can be read into memory in the same manner as the stop switches.

The status of the stops and effects switches are read into the microprocessor RAM memory in a manner similar to that described in conjunction with the keyboards and pedals and which was described in conjunction with FIGS. 4–6. In particular, a digitally controlled multiplexer 799 has a common terminal and wiper 795 that are coupled to ground reference potential. Groups of the stops and effects switches have one contact thereof coupled to common terminals designated 700 through 709. The common terminal to which the wiper 795 is coupled is determined by the 6-bit code on lines 796. As before, these are six of the eight bits issued by the microprocessor on the data bus and coupled to lines 796 via an output latch. The other terminal of each of the switches associated with a particular common terminal is coupled via a diode to a different one of lines 797, these lines being coupled to the microprocessor 100 via inverters and an input gate, in the manner previously described. The lines 797 are also coupled to a bias potential V+ via resistors R. The statuses of the stops and effects switches are read into memory in the same manner described in conjunction with FIG. 4. As previously described, for those switches whose common terminal is grounded at a particular "sampling" or interrogation time, an open switch will result in a logical "1" on a particular one of data lines 797, and a closed switch will result in a logical "0" on the particular one of data lines 797. The resultant eight bit data word on lines 797 is coupled via inverters and an input gate to the microprocessor and written into a memory location that is assigned to the particular bank of stops/effects. Thus, for example, if the first code word on lines 796 causes the wiper 795 to be coupled to common terminal 700, the 8-bit data word which results on lines 797, and which will be inverted and stored at the stops/effects memory address, will reflect the on/off status of eight rhythm tabs 740.

Figure 8:
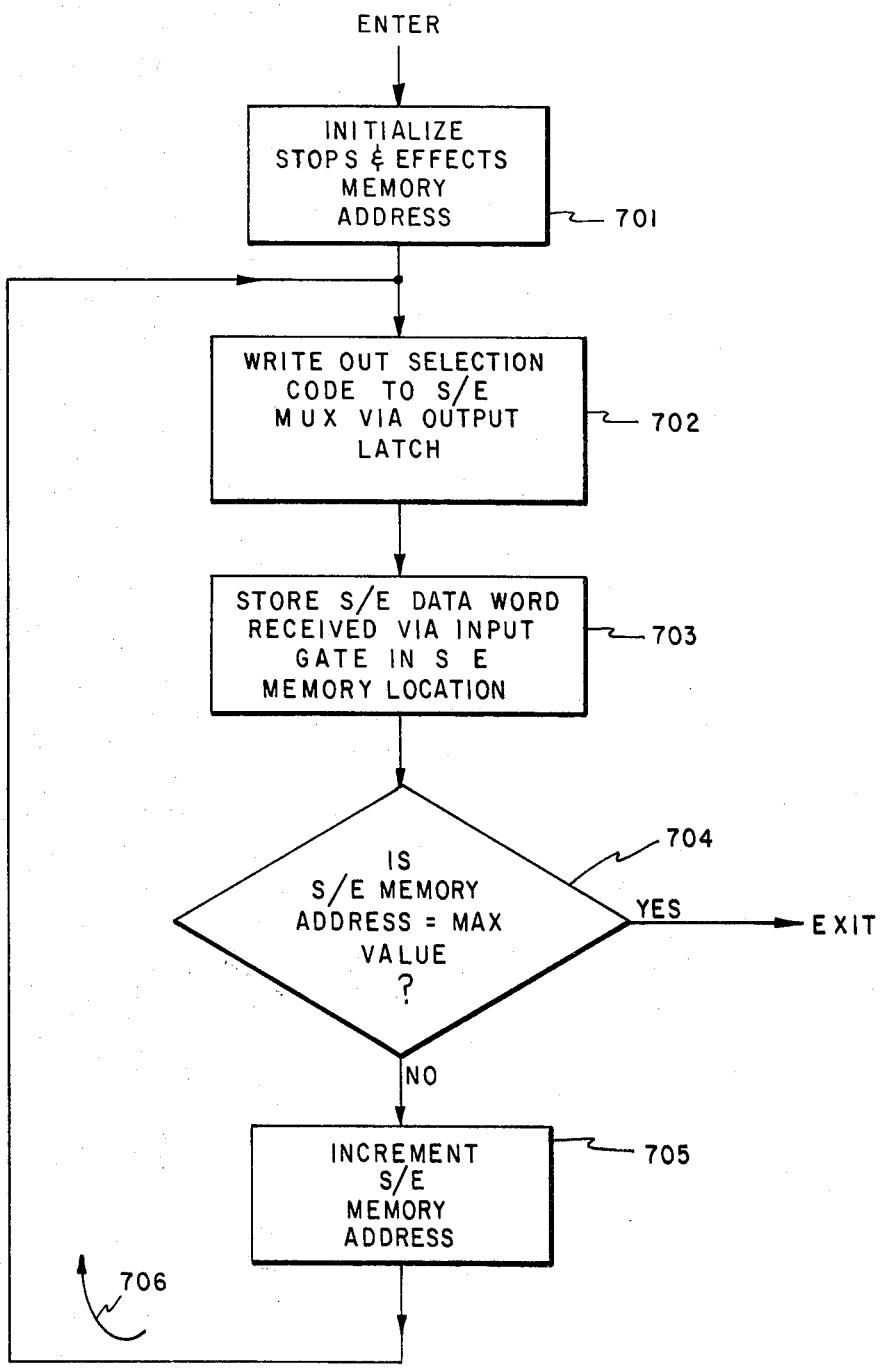
FIG. 8 is a flow diagram of the routine for reading the status of the stops and effects switches into random access memory of the microprocessor.

Referring to FIG. 8, there is shown a flow diagram of the routine for reading the status of the stops and effects switches into RAM memory of the microprocessor. Block 701 is first entered and stops and effects memory address is initialized at the lowest address to be used for this memory block. Block 702 is then entered, this block representing the writing out of the code word (which, as was explained in conjunction with FIG. 6 can be the same as the last six bits of the memory address) to the multiplexer 799 via an output latch. Block 703 is next entered, this block representing the storage of the 8-bit data word or byte received (from the data lines 797 in FIG. 7) via an input gate into the previously designated address of the stops and effects memory. Decision diamond 704 is then entered, and determination is made as to whether the stops and effects memory address is equal to its maximum value, which is determined by the number of stops and effects switch statuses (plus any other statuses to be sampled this way) to be stored. If so, the statuses of all stops and effects switches have been stored, and the routine is exited. If not, block 705 is entered, and the stops and effects memory address is incremented. Block 702 is then re-entered, and the loop 706 is continued as the statuses of the stops and effects are stored in memory.

Figure 9:
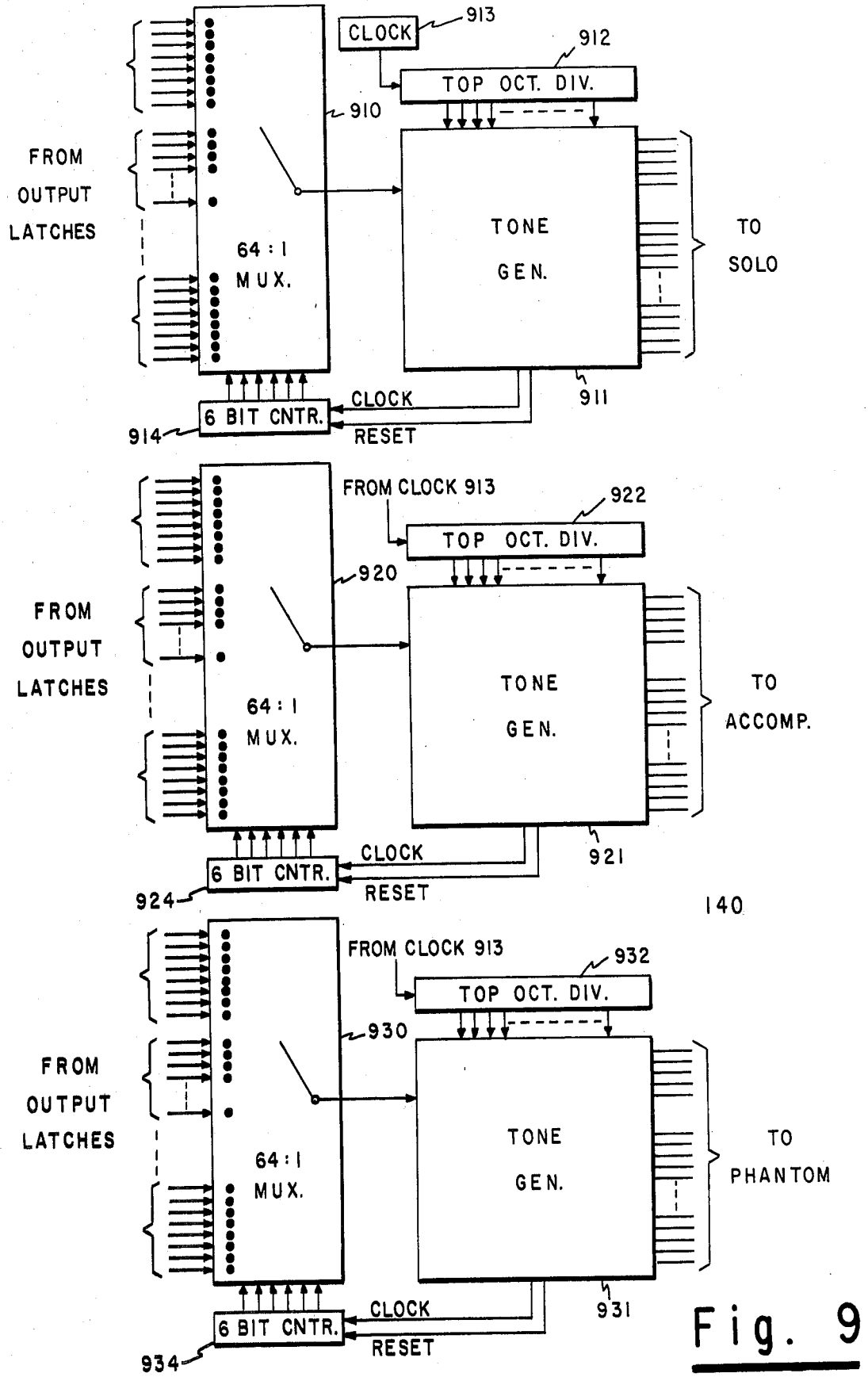
FIG. 9 is a block diagram of the tone generator and gating circuitry of an embodiment of the invention.

Referring to FIG. 9, there is shown a block diagram of the tone generator and gating circuitry 140 (FIG. 1). Three 64:1 addressable multiplexers, 910, 920 and 930, are provided. Each multiplexer may be, for example, a bank of eight RCA 4051 Multiplexer/Demultiplexer circuits or other suitable commercially available multiplexer circuits. Each multiplexer receives at its sixty-four inputs the signals from eight output latches. The output latches which are coupled to multiplexer 910 convey data from the solo keyboard memory 521 (FIG. 5), the output latches which are coupled to multiplexer 920 convey data from the accompaniment keyboard memory 522 (FIG. 5), and the output latches which are coupled to multiplexer 930 convey information from the phantom keyboard memory 524 (FIG. 5). The single outputs of the multiplexers 910, 920 and 930 are respectively coupled to tone generator circuits 911, 921 and 931. In addition to the respective multiplexer outputs, the tone generator circuits 911, 921 and 931 respectively receive the outputs of top octave divider circuits 912, 922, and 932. Each of the top octave divider circuits 912, 922, and 932. Each of the top octave dividers 912, 922 and 932 receives a clock input signal from a clock 913 which, in the present embodiment, operates at 2.0024 MHz. The tone generator circuits 911, 921 and 931 generate clock and reset outputs that are respectively coupled to 6-bit counters 914, 924 and 934. The outputs of counters 914, 924 and 934 are coupled to the multiplexers 910, 920 and 930 and are operative to select which of the multiplexer inputs are coupled to the multiplexer output.

The tone generator circuits and top octave divider circuits of FIG. 9 are well known in the musical instrument art and are not the subject of the present invention. These circuits may comprise commercially available hardware or integrated circuit units that are used in electronic organs. For example, tone generator circuits 911, 921 and 931 may comprise suitable Seimans SM-Type Tone Generator Circuit chips, and the top octave dividers 912, 922 and 932 may comprise MO83 Top Octave Divider chips manufactured by SGS Corp. As is well known in the art, the tone generator circuits receive serial bit streams which represent the on/off status of keyboard notes and have multiple output lines on which square wave frequency representations are generated. The multiple output lines of tone generator circuits 911, 921 and 931 are respectively coupled to the stops-controlled voicing and filter circuits 150 (FIG. 1) and, more particularly, to solo filters 1011, accompaniment filters 1021, and phantom filters 1031, respectively, shown in FIG. 10.

The tone generator circuits 911, 921 and 931 typically require the serial bit stream to be in consecutive note order (i.e., starting at the highest note of the particular keyboard and descending chromatically to the lowest note). While the tone generator circuits used in the present invention are not novel, it is necessary to convert the key status representative data stored in the various keyboard memories (e.g. FIG. 5) into appropriate serial bit streams that are compatible with the form of input required by the tone generator circuits. In the present embodiment this is done, for example, with respect to the solo keyboard memory bits, in the following way: The five lowest keyboard notes (plus three "0"'s) are applied to the last latch input to multiplexer 910 (e.g. the bottom latch input in FIG. 9). The next eight lowest keyboard notes are applied to the next-to-last latch input to multiplexer 910. The next eight lowest keyboard notes are applied to the third-from-last latch input to multiplexer 910, and so on, with the top eight keyboard notes being applied to the first (top) latch input to the multiplexer. (The last latch has only five data inputs since there are sixty-one keys per keyboard in the present embodiment.) The latched signals are applied to the multiplexer once each time the program cycles through the main routine (FIG. 3). The desired bit stream is obtained by having the multiplexer wiper cycle from top to bottom as the counter 914 issues counts from 0 to 63. The counter 914 counts clock pulses which are conventionally issued from tone generator circuits 911, a clock pulse being issued each time the tone generator circuit desires the next bit of the serial bit stream. The counter 914 is reset at the end of a cycle. If a self-clocking tone generator circuit is not employed, the clock signals can be derived from clock 913. The other multiplexers are treated the same way. The flow chart for implementing this procedure is shown in FIG. 11 and will be described later.

Referring again to FIG. 10, the outputs of solo filters 1011, accompaniment filters 1021, and phantom filters 1031 are respectively coupled to summing circuits 1013, 1023 and 1033 via electronically controlled switches 1012, 1022 and 1032, respectively. The electronically controlled switches 1012, 1022 and 1032 may comprise, for example, RCA 4016 Quad Analog Switches. The switches 1012, 1022 and 1032 respectively receive, at their control inputs, the signals from three different output latches which, in turn, latch output information representative of the stored status of the operator-controllable stops (FIG. 7). The manner in which the stored stops and effects statuses are read from memory to these output latches will be described below in conjunction with the routine illustrated in the flow diagram of FIG. 12. The outputs of summing circuits 1013, 1023 and 1033 are input to effects generator 1040 which, as is well known in the art, includes electronically controlled switches that turn on and off the operator-selected effects. Again, in the present embodiment, these switches are controlled via the output of an output latch which latches the data in the stops and effects memory that is representative of the status of effects switches selected by the operator (i.e., effects tabs 730 of FIG. 7). The outputting of this information to the latch which controls the effects is also described further in conjunction with the flow diagram of FIG. 12. The output of effects generator 1040 drives speakers 150 (FIG. 1). It is emphasized that the present invention is not directed to any particular filter circuits or effects circuits, and the filters 1011, 1021, 1031 and the effects circuit 1040 can be any suitable known circuits for implementing filtering and effects respectively. For example, the solo filters would typically generate, on parallel output lines, the electrical signals representative of the possible solo voices; e.g., "solo 8′ tibia", "solo 8′ diapason", . . . "solo 2′ tibia", etc. . . The solo voices are selected by the operator by depressing or releasing the appropriate stops 711 (FIG. 7). In similar manner, the selection of the accompaniment voices is implemented by the operator depressing or releasing the stops 712, and the selection of the voices output from phantom filters 1031 is implemented by the operator depressing or releasing the appropriate stops for orchestral voices 720 which are played from data stored in the phantom keyboard memory (FIG. 5). A more complete description of the phantom memory and the operation thereof will be set forth later. For the present, however, it suffices to say that the phantom filters 1031 produce the orchestral voices, and that these can be played from the solo and/or accompaniment keyboards, as determined by selection of stops 721 and/or 722 (FIG. 7). For a discussion of the design of electronic organ filters and effects, and other prior art electronic organ techniques referred to herein, reference can be made to "Electronic Organs" by N. H. Crowhurst.

Referring to FIG. 11, there is shown a flow diagram of the routine (which is block 322 of FIG. 3) for outputting the keyboard data to the multiplexers 910, 920 and 930 of FIG. 9. Block 1111 represents the initialization of an output latch pointer to the last solo memory output latch; i.e., the bottom latch coupled to multiplexer 910 of FIG. 9. The microprocessor address register is then initialized to the address containing the lowest note in the solo keyboard memory, as represented by the block 1112. As seen in FIG. 5, this would be address 0 (in decimal) of the solo keyboard memory. A bit pointer is then initialized (block 1113) to the lowest bit of the data word at the address (this is seen from FIG. 5 to be bit 0 which represents the status of the lowest C of the solo keyboard memory). The data bit pointed to by the bit pointer is then read into an 8-bit assembly register, as represented by block 1114. Diamond 1115 is then entered and a test is made as to whether or not the assembly register is full. If not, block 1116 is entered, and the address is incremented. The first time through the routine this would increment the address to "1" (decimal). A test is then made (decision diamond 1117) as to whether the highest address ("11" in decimal, in this case) has been reached. If so, the bit pointer is incremented (block 1118) and block 1114 is re-entered. If not, block 1114 is re-entered directly. Accordingly, the block 1118 is operative to move the bit pointer when the highest address of the solo keyboard memory has been reached in the loop 1119. The reentry to block 1114 causes the reading of the next data bit (the lowest C# of the solo keyboard memory) into the assembly register. The loop 1119 continues until the assembly register is full, whereupon the inquiry of diamond 1115 will cause entry into block 1120. This block represents the reading of the contents of the assembly register to the multiplexer 910 via the output latch that is pointed to by the output latch pointer (which, it will be recalled, was initialized at block 1111). Accordingly, the first time block 1120 is entered, the data bits representative of the lowest eight notes of the solo keyboard memory (actually five, for the first pass only) will be coupled to multiplexer 910 via the last output latch that is input to multiplexer 910. A test is then made (diamond 1121) as to whether or not the output latch pointer is pointing to the first output latch. If not, block 1122 is entered and the output latch pointer is incremented. The loop 1119 then continues until eight bits again fill the assembly register, whereupon they will again be read out (block 1120). It should be noted that the incrementing of address by block 1116 is made recirculatory so that address "0" (decimal) follows address "11" (decimal). Also, it will be understood that the diamond 1117 and block 1118 are operative to increment the bit pointer each time the highest address is reencountered so that, for example, the bit representative of note $C_1$ follows the bit representative of note $B_0$ (FIG. 5). Also, as noted above, the first (only) loading of the 8-bit assembly register should be preceded by loading three "0"'s to account for the last latch receiving only five data bits (due to the 61-bit keyboard).

When the last output latch has been reached, block 1125 is entered, and the routine is repeated for the accompaniment keyboard, the information in this case being read into multiplexer 920. The routine is then repeated for the phantom keyboard (block 1130—read into multiplexer 930), and then for the pedals (block 1135—read into multiplexer 1311 of FIG. 13).

Figure 10:
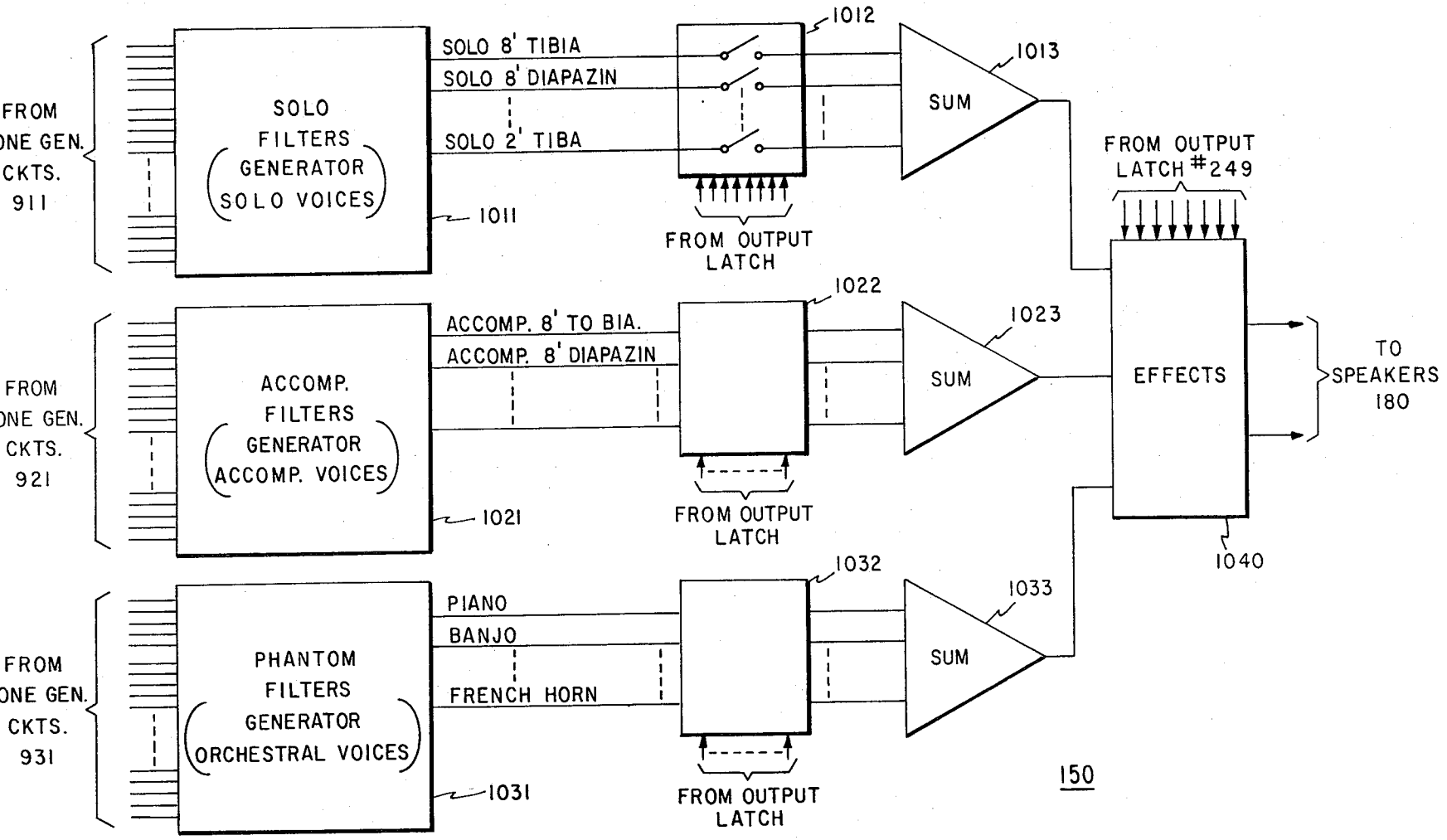
FIG. 10 is a block diagram of the stops-controlled voicing and effects circuits of an embodiment of the invention.
Figure 12:
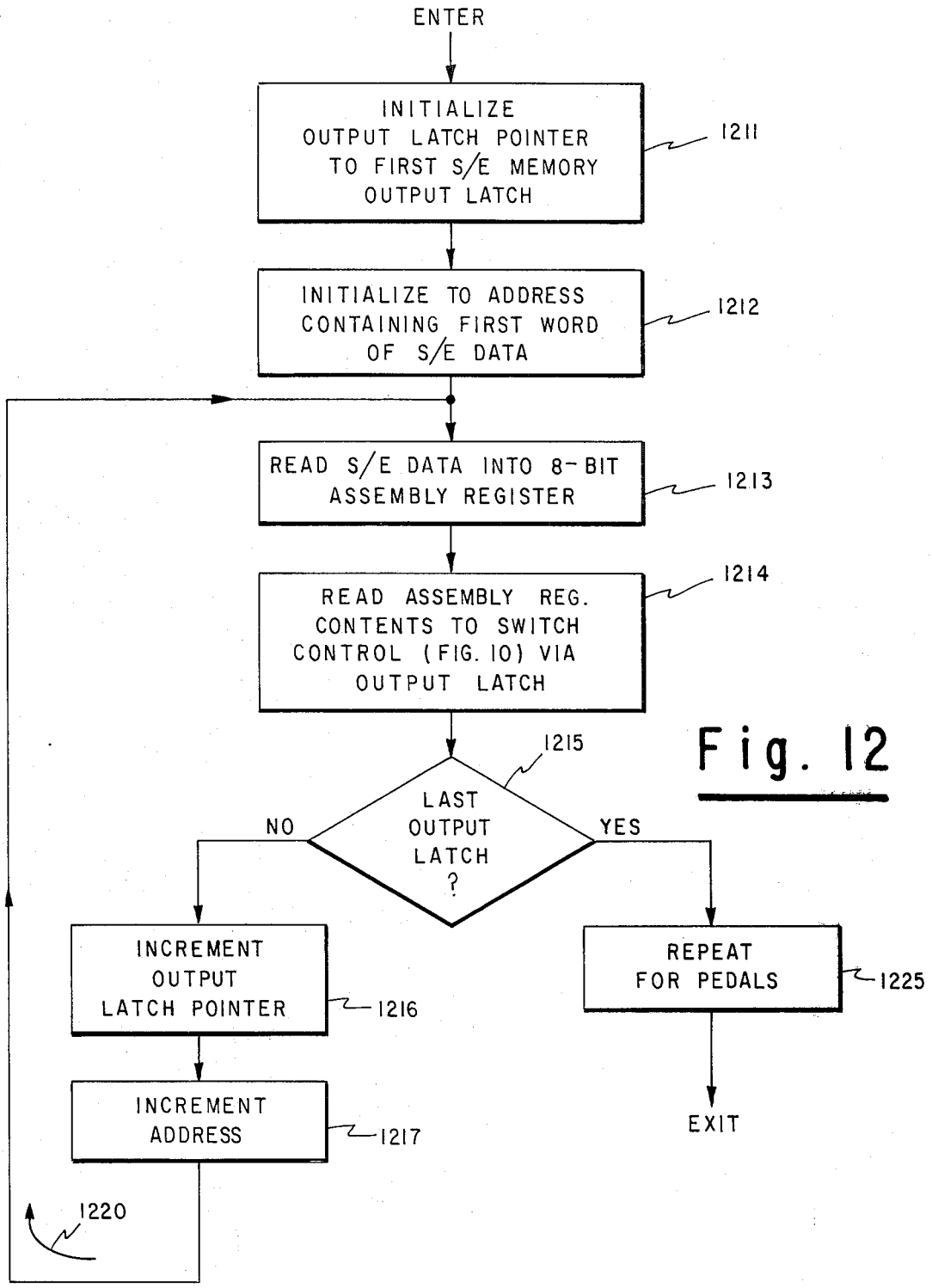
FIG. 12 is a flow diagram of the routine for reading out the stops and effects data.

Referring to FIG. 12, there is shown a flow diagram of the routine for reading out the stops and effects data to the output latches of FIG. 10, and also to any other necessary controls. Block 1211 represents the initialization of an output latch pointer to the first stops/effects memory output latch; i.e., for example, the latch used to output the signals coupled to switch 1012 in FIG. 10. The microprocessor address register is then initialized at the address of the stops/effects memory containing the first word or byte of stops/effects data to be read out. The stops/effects data at this address is then read into an 8-bit assembly register (block 1213), and the contents of the assembly register are coupled to the appropriate switch control (e.g. switch 1012 of FIG. 10) via the output latch pointed to by the output latch pointer (block 1214). A determination is then made (decision diamond 1215) as to whether or not the output latch pointer is pointing to the last output latch to be read out. If not, the output latch pointer is incremented (block 1216) and the stops/effects memory address is incremented (block 1217). The loop 1220 then continues until all of the stops/effects data has been read out to the appropriate switch controls. When this occurs, block 1225 is entered and the stops/effects data for the pedals is read out in the same manner (to the switch controls of FIG. 13). As an example of operation, assume that the "solo 8′ diapason" stop of the solo voices is the only solo voice stop 711 that is depressed (FIG. 7). This will result in a "1" data bit at a particular bit position of a data word in the stops/effects memory, located at a specified address in the stops/effects memory (as previously described in conjunction with FIGS. 7 and 12). During readout, the specified word of memory will be coupled to switch 1012 (FIG. 10), and a "1" at the particular bit position will cause the closing of the switch contacts which couple the output lines designated "solo 8′ diapason" to the summing circuit 1013.

Figure 13:
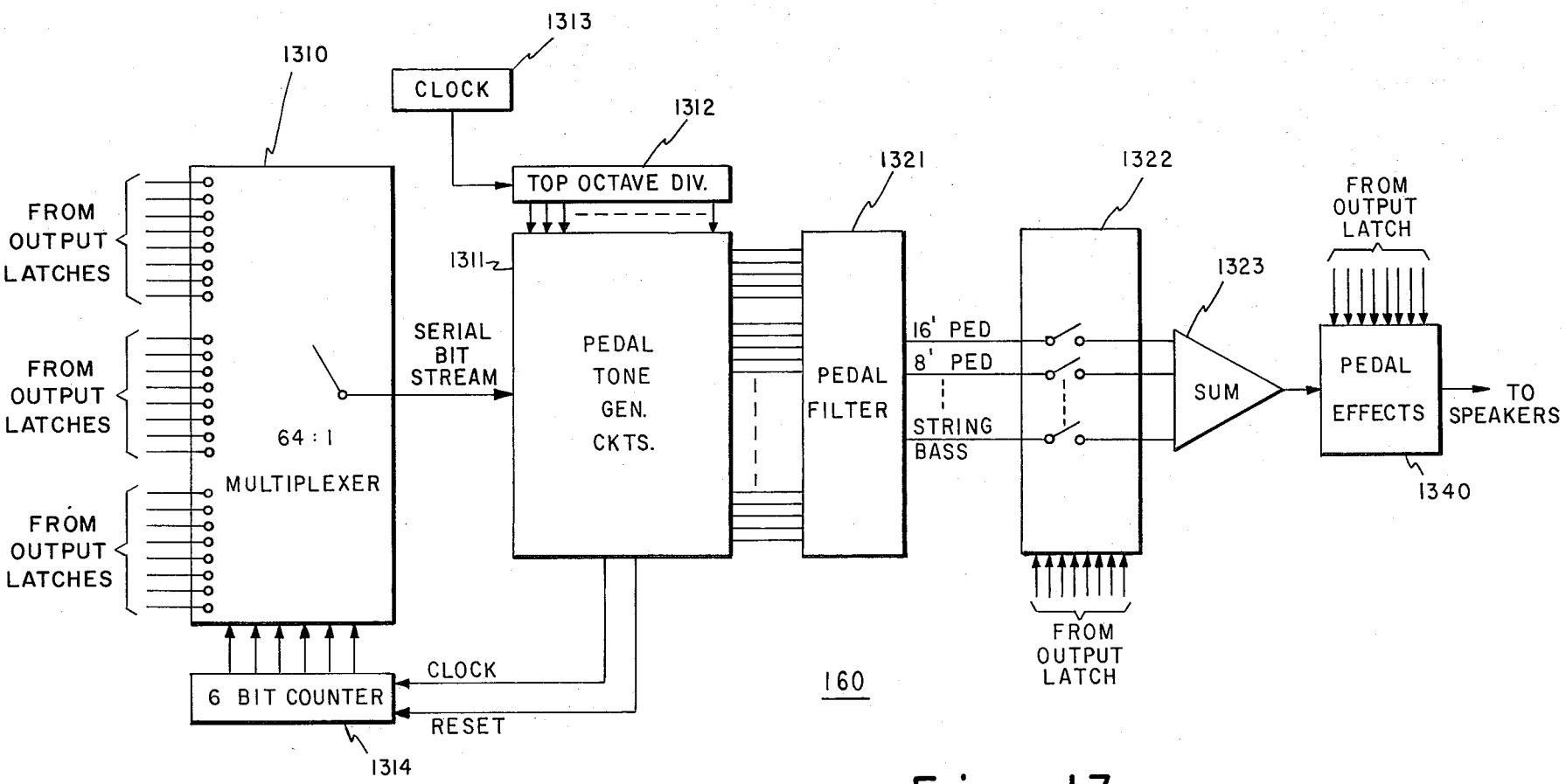
FIG. 13 is a block diagram of the pedal tone generating circuitry, pedal voicing, and pedal stops/effects.

Referring to FIG. 13, there is shown a block diagram of the pedal tone generating and pedal stops/effects represented by block 160 of FIG. 1. The multiplexer 1310, tone generator circuits 1311, top octave divider 1312, clock 1313, and counter 1314 operate in similar fashion to their counterparts in FIG. 9, e.g. units 910–914 respectively. In the case of the pedals, however, only two output latches are coupled to multiplexer 1310 (block 1135 of FIG. 11). Since there are thirteen pedals, only thirteen inputs are used. Except for numerical differences, and the fact a different type of known tone generator (i.e., pedal tone generator 1311) and top octave divider (1312) will be used, operation will be in the same manner as that described in conjunction with FIG. 9 and in the flow diagram of FIG. 11. Similarly, the pedal filters 1321, electronically-controlled switch 1322, summing circuit 1323, and effects circuit 1340 operate in similar manner to their counterparts in FIG. 10; for example, the units 1011, 1012, 1013 and 1040 thereof. Briefly, the pedal voices to be output are selected by switch 1322 under control of an output latch (block 1225 of FIG. 12). The pedal effects are controlled in the same way.

Figure 14:
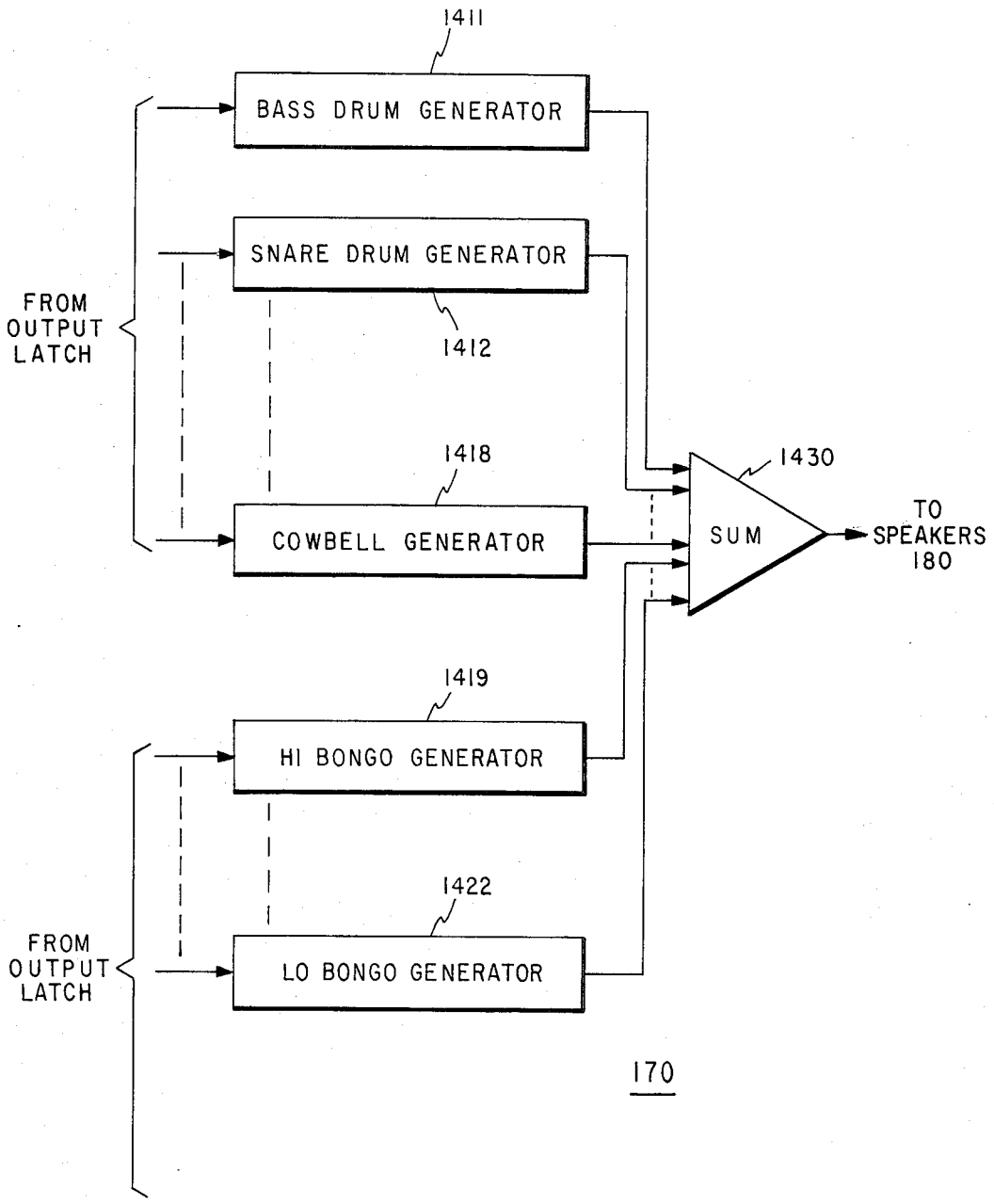
FIG. 14 is a block diagram of the rhythm instrument generators.

Referring to FIG. 14, there is shown a block diagram of the rhythm instrument generators represented by the block 170 of FIG. 1. The rhythm generator includes a bank of percussive noise generators 1411, 1412 . . . 1422. The individual percussion generators, which are well known in the art, upon receipt of an enabling input signal, generate noise signals that can be used to simulate the sound of a base drum, snare drum, cowbell, bongos, etc. The specific generators, and the use thereof to obtain particular desired output sounds, is not the subject of this invention, and for a description of this type of noise generators, reference is made, for example, to articles entitled "Polytonic Percussion Synthesizer" and "Percussion Synthesizer Accessories" by James J. Barbarello, which appeared in the September, October and December, 1979 issues of "Radio Electronics". The inputs to the noise generators are the respective outputs of a pair of output latches that are operative to activate particular combinations of the noise generators at appropriate times. The generation of the signals which control these output latches will be described hereinbelow in conjunction with the routines dealing with rhythm generation. The outputs of the percussive noise generators 1411 in unit 1410 are summed in summing circuit 1430 and then coupled to speakers 180 (FIG. 1).

Figure 15:
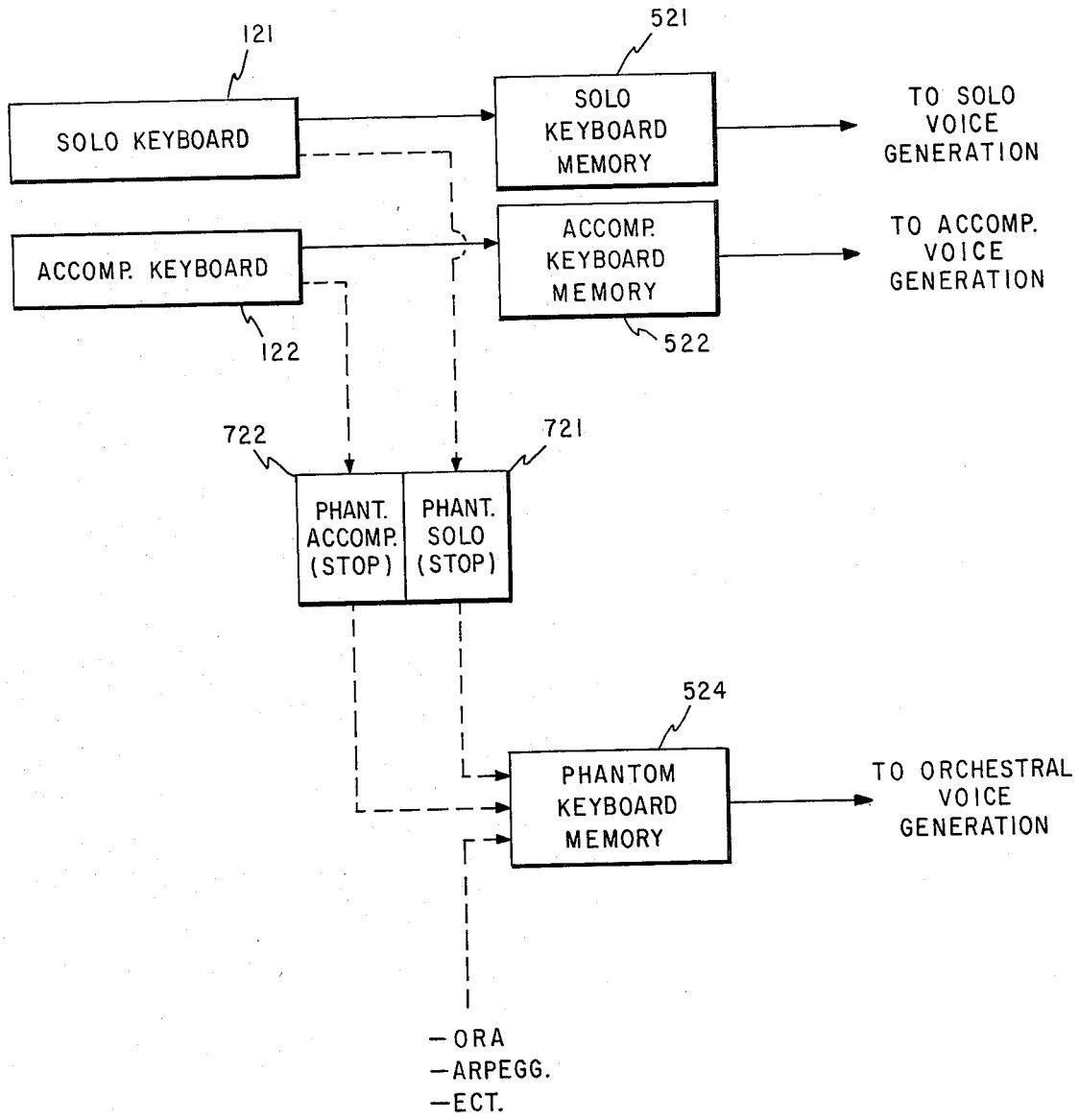
FIG. 15 is a simplified diagram useful in understanding operation of the phantom keyboard memory.

FIGS. 15–18 relate to the phantom keyboard memory that is used herein in generation of the orchestral voices, is also used herein in the production of automatically generated music such as orchestral rhythm accompaniment (ORA), and could also be used in the production of other automatically generated notes, such as in arpeggiation. A feature of the invention called "restrike" is also implemented herein with the aid of the phantom keyboard memory. FIG. 15 illustrates, in simplified terms, the use of the phantom keyboard memory in the present embodiment. The solo keyboard 121 and the accompaniment keyboard 122 (FIG. 1) are respectively shown as feeding data into the solo keyboard memory 521 and the accompaniment keyboard memory 522 (FIG. 5), as has been previously described in detail. As also previously described, the information stored in these memories is eventually output to circuitry which produces the solo voices and accompaniment voices, respectively. In the simplified diagram of FIG. 15, the solo and accompaniment keyboards are also shown as feeding into the phantom keyboard memory 524, under control of "phantom solo" and "phantom accompaniment" stops 721 and 722 (FIG. 7) that control the selection of which keyboard is used to play the orchestral voices. The output of the phantom keyboard memory is shown as being used to produce these voices, as was described in conjunction with FIGS. 9 and 10. Also feeding into the phantom keyboard memory are automatically generated note patterns, such as the patterns for orchestral rhythm accompaniment (ORA) and arpeggiation. These patterns are generated with the aid of an "automatically generated note pattern memory" which will be described momentarily in conjunction with FIG. 16.

A feature of the present invention which results in better sounding music is called "restrike". There are a number of situations that can be encountered when playing an electronic organ which result in the disturbing occurrence of a note "missing" from a musical sequence. Sucn situations occur when a particular note has been played and is being sustained, and during such sustenance the note is again played from another source (e.g. from the other keyboard or from an automatically generated note pattern such as an automatically generated chord, arpeggiation, or orchestral rhythm accompaniment.) When this occurs, the note being sustained will not strike again. For a situation such as two piano voices, the resultant "dead" spot is particularly noticeable and unpleasant. With the "restrike" feature of the present invention, the situation of a sustained note being again played from another source is sensed and the appropriate manipulations in memory are made to cause a restrike of the note, thereby eliminating the "dead" spot in the music.

Figures 16, 17:
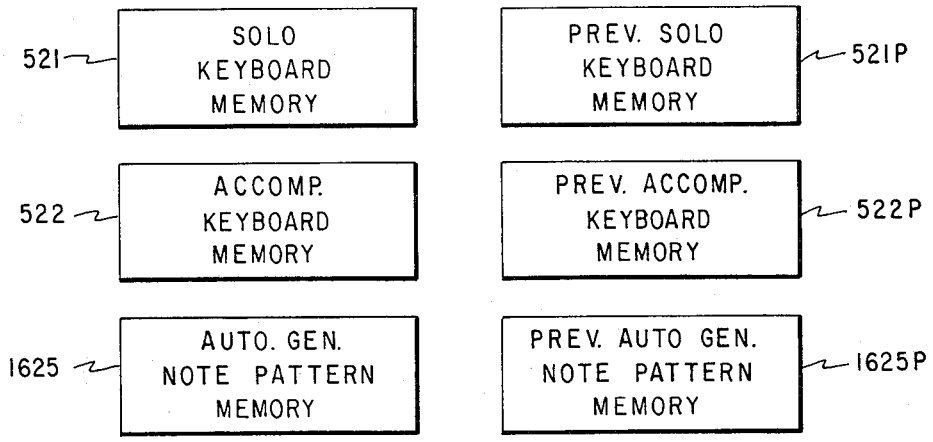
FIG. 16 is a simplified illustration of memory blocks useful in describing the restrike feature of the invention.
FIG. 17 illustrates an example of how the restrike feature is implemented.

Referring to FIG. 16, there is shown a simplified illustration of the memory blocks which are used (in conjunction with the phantom keyboard memory—FIG. 5) to implement the restrike feature of the invention. The solo keyboard memory 521 and the accompaniment keyboard memory 522 are the twelve byte memories which were previously set forth in FIG. 5. Four additional memory blocks, which comprise four additional twelve byte portions of the microprocessor's RAM storage in the present embodiment, are also illustrated in FIG. 16. One of these is an "automatically generated note pattern memory" 1625 which is sometimes herein called by the shorter name "note pattern memory". The three other memory blocks to the right of those already described, are "previous pass" versions of their counterparts to the left. Each of these "previous pass" memories also comprises a twelve byte block of memory, so the total amount of memory illustrated in FIG. 16 is seventy-two bytes. As indicated by the names applied, the "previous pass solo memory" 521P is used to remember what was the status of the solo memory 521 during the previous pass through the main routine of FIG. 3, the "previous pass accompaniment memory"

522P is used to remember what was the status of the accompaniment memory during the previous pass, and the "previous pass automatically generated note pattern memory" 1625P is used to remember what was the status of the automatically generated note pattern memory during the previous pass. The manner in which the note pattern memory 1625 is loaded has not yet been described and will be set forth hereinbelow. It suffices for purposes of understanding this part of the description of the restrike feature to state that this memory is loaded with the notes used to play automatically generated note patterns (such as for orchestral rhythm accompaniment and arpeggiation) and the information in this memory 1625 is ultimately transferred into the phantom keyboard memory 524 (FIG. 5) for controlling the playing of orchestral voices (e.g. FIG. 15).

Reference can now be made to FIG. 17 for an illustration of how the restrike is achieved. (The flow diagram therefor is subsequently set forth in FIG. 18.) Assume, for purposes of this example, that both the "phantom solo" stop 721 and the "phantom accompaniment" stop 722 are "on" along with one or more orchestral voice stops, so that the orchestral voice(s) is being played from both keyboards. In FIG. 17 the processing of the first byte of information of the solo keyboard is illustrated. It will be recalled from the description of FIG. 5 that the first byte of the solo keyboard memory contains the information concerning the status of all C's of the solo keyboard. Assume, for purposes of the example of FIG. 17, that the most recent information read into the solo keyboard memory (first byte) is as shown as at 1711. This data byte indicates that when the keys of the solo keyboard were just "sampled" or interrogated, the keys for playing $C_1$ and $C_3$ were found to be depressed. Assume further, for purposes of this example, that $C_1$ was also being played during the previous sampling interval, but that the note $C_3$ was found to be depressed for the first time during the current sampling interval. This condition is reflected in the byte of data 1712, which is the first data byte (for this example) in the previous solo memory 521P. A register 1713 is shown as having a "1" at every bit position in which a "0"-to-"1" transition has occurred. In the example set forth, there would accordingly be a "1" at the bit-4 position. The register 1714 is shown as containing the inverse of register 1713; i.e., a "0" at the bit position of every "0"-to-"1" transition between the previous and present conditions, and a "1" at all other bit positions. The register 1715 is shown as containing a "restrike mask" which is always initially all "1"'s. As will become clear, there are twelve restrike masks in all, one for each note (i.e., all octaves of said note in all three memories.) Accordingly, in FIG. 17, the register 1715 is shown as containing the initial restrike mask for the C's of the solo, accompaniment, and features memories. The data in register 1716 is obtained by ANDing the data byte in register 1714 with the restrike mask. As seen, this results in a zero at the bit-4 position of the restrike mask. The same procedure is then performed for the first data byte in the accompaniment keyboard memory (i.e., the C's of the accompaniment keyboard memory). More precisely, the procedure illustrated with respect to 1711–1716 of FIG. 17 is repeated for the "C" byte of the accompaniment keyboard memory, but the already once-processed restrike mask (register 1716) is used this time. The procedure is then again repeated for the first byte (again, the C's) of the note pattern memory 1625, and the restrike mask is again modified (if another "0"-to-"1" transition is found present) in accordance with the procedure set forth. As a result of this procedure, there is obtained a final restrike mask, designated 1750 in FIG. 17. In the example given, it is assumed that $C_4$ was the only newly played note among the C's, so the final restrike mask for the C's, as illustrated at 1750, has a single "0" at the bit-4 position. A register 1751 is loaded with the combined ("ORed") present key status data from the solo, accompaniment, and note pattern memories 521, 522 and 1625. (It can be noted that a new "1" now appears at the bit-2 position—by virtue, for example, of $C_2$ being on, although not for the first time, in memory 522 or 1625.) The information in the "combined state" register 1751 is now ANDed with the final restrike mask 1750, and the result is shown at 1752. It is important to note that the "0" at the bit-3 position of the restrike mask results in there being a "0" at the bit-3 position of the data byte shown at 1752. The asterisk over bit-3 is to emphasize that $C_3$ was just played for the first time, but is nonetheless a "0" in the data 1752. The data byte 1752 can now be entered into the first address of the phantom keyboard memory 524 (36 in decimal for the C's—see FIG. 5). The entire procedure of FIG. 17 is then performed for the C-sharp's, and then for the D's, and so on for all twelve notes. It can be noted that the solo keyboard memory and the accompaniment keyboard memory are only included in the just described procedure if their respective "phantom" stop (721 or 722—see FIG. 7 and FIG. 15) is "on". In other words, only the memory sources feeding the orchestral voices are applied to the phantom keyboard memory (and subject to the "restrike" processing) in this embodiment. Tne note pattern memory, however, always feeds the phantom keyboard memory since the automatically generated note patterns are played by the orchestral voices via the phantom keyboard.

The results of the procedure described in conjunction with the example of FIG. 17 are as follows: The contents of the note pattern memory 1625 and none, one, or both of the solo and accompaniment keyboard memories 521 and 522 (depending on which, if either, of these memories is being used to cause playing of orchestral voices from the solo and/or accompaniment keyboards) are combined and entered into the phantom keyboard memory 524. However, by virtue of the use of the restrike masks in the manner described, the first time a new note is sensed from any active source (i.e., any of the three contributing memories), the note is entered into the phantom keyboard memory as a "0" at the appropriate bit position of the data byte. During the next and subsequent sampling intervals for which the note is sustained (and, for the indicated sampling interval of less than 15 milliseconds, any played note will typically be sustained for many sampling intervals) the note being played will be entered as a "1" in the data byte that is put into the phantom keyboard memory. The initial entry of a "0" each time a new note is played from any of the three active sources results in the note being effectively turned "off" for one sampling interval before it is turned "on". If the note is not already being sustained from some other source, this will have no effect other than the voicing circuitry being activated one sampling interval later. (For sampling intervals of the order of 15 milliseconds, this will be of no consequence to the listener.) However, if the note was already being played and sustained from one of the other of the three memory sources of FIG. 16, the result will be that the note will be turned "off" for one sampling interval. This, in turn, will result in a new strike or "restrike" from the voicing circuitry when the note is subsequently indicated as again being "on" during the next sampling interval. For example, in the situation set forth in FIG. 17, assume that the note $C_3$ was previously played and was being sustained on the piano (voice), the note having originated from either accompaniment keyboard or the note pattern memory. In such case, during each time interval of the sustenance of the note, a "1" was entered at the $C_3$ bit position in the phantom keyboard memory (having been transferred from the accompaniment keyboard memory 522 or the note pattern memory 1625, as previously described—e.g. when data byte 1751 was transferred to the phantom keyboard memory). When the same note, $C_3$, is now played on the piano from the solo keyboard, the result of the procedure of FIG. 17 will be that a "0" will be entered in the phantom keyboard memory $C_3$ bit position for one sampling interval. During the next sampling interval, a "1" will again be restored at that bit position of the phantom keyboard memory, and this will result in the restriking of the piano note $C_3$, even while it is still being sustained from its other source.

Figure 18:
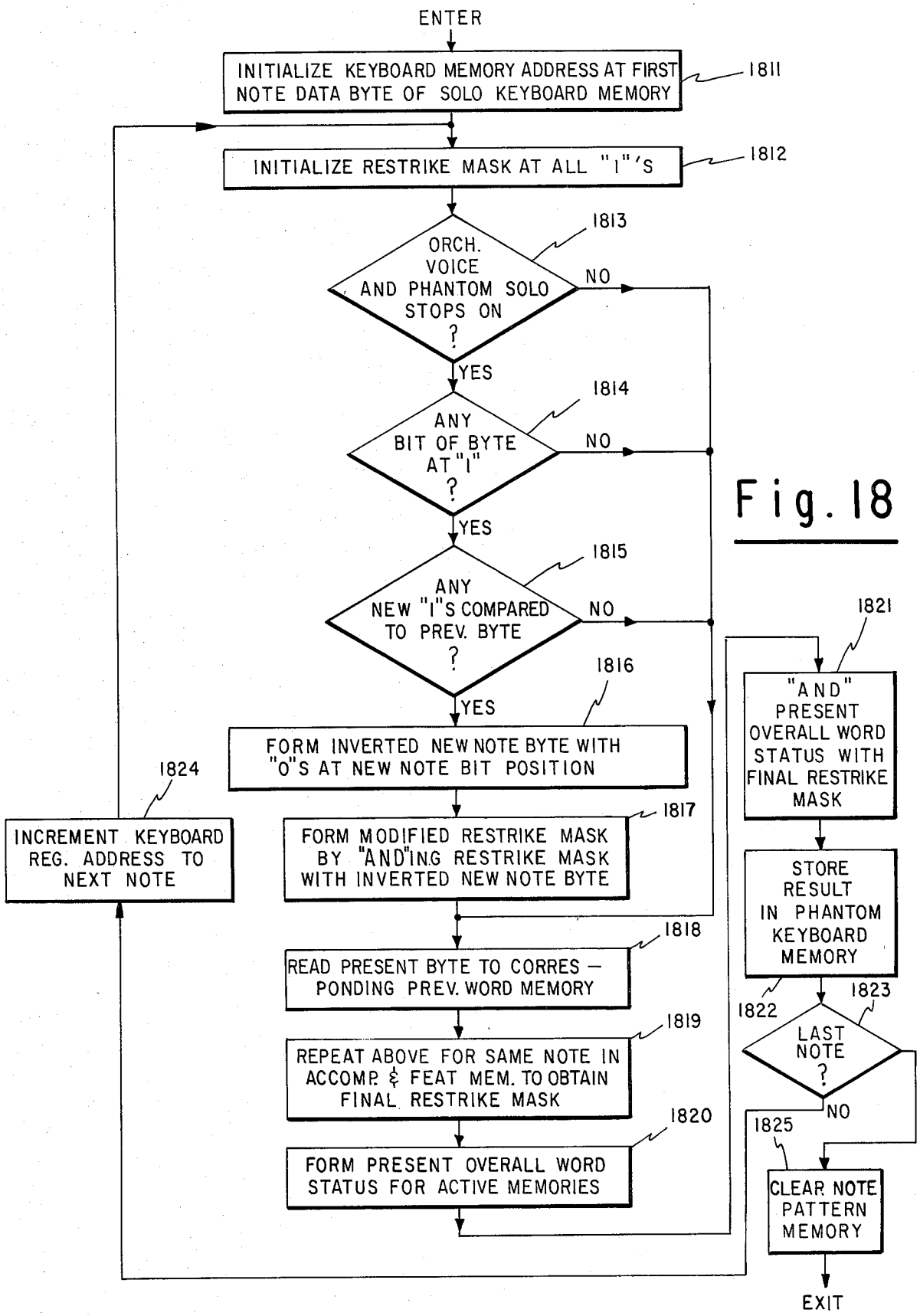
FIG. 18 is a flow diagram for implementing the technique for loading the phantom keyboard memory of the invention.

Referring to FIG. 18, there is shown a flow diagram for implementing the technique for loading the phantom keyboard memory, along with provision for "restrike", as represented by the block 320 of FIG. 3 and as just described in conjunction with FIG. 16 and the example of FIG. 17. The keyboard memory address is initialized at the first note data byte of the solo keyboard memory (block 1811); i.e., the C's of the solo keyboard memory. The block 1812 is then entered and the restrike mask is initialized at all "1"'s (1715 in FIG. 17). Diamond 1813 is then entered and determination is made as to whether or not the stops have been selected which play orchestral voices via the solo keyboards; i.e., whether or not an orchestral voice stop (720) is on in conjunction with the "phantom solo" stop 721 (e.g. FIG. 15). If not, block 1818 is entered directly. If so, diamond 1814 is entered, and determination is made as to whether any bit of the data byte is a "1". If not, block 1818 is entered directly, whereas if so, diamond 1815 is entered and inquiry is made as to whether any new "1"'s are present in the byte as compared to the same byte during the previous sampling interval. This is done by comparing the byte against the corresponding byte in the previous solo memory 521P (FIG. 16). If there are no new "1"'s, block 1818 is entered directly. If any new "1"'s are present, however, block 1816 is entered. The block 1816 represents the formation of a byte with "0"'s at a new note bit positions (1714 in FIG. 17). The original restrike mask (all "1"'s) is then modified (block 1817) by "ANDing" with the inverted new note byte to form the modified restrike mask (1716 of FIG. 17). Block 1818 is then entered (or was directly entered via the "no" branches of diamonds 1813, 1814, and 1815), and the present byte is nondestructively read into the corresponding address in the previous memory; i.e., the previous solo keyboard memory 521P for this part of the routine. As described, previous memory will later be used during the next sampling interval when determining the presence of "0"-to-"1" note transitions. The block 1819 is then entered, this block representing a repeat of the above for the same note byte in the accompaniment keyboard memory 522 and the note pattern memory 1625 to obtain the final restrike mask (1750 of FIG. 17). Block 1820 is then entered, and the combined status byte is obtained for those of the memories 521 and 522 which are active as well as for memory 1625, this being done by "ORing" the bytes for the note in question in those memories which are to feed into the phantom keyboard memory. In the example of FIG. 17, the combined status byte is represented at 1751. Block 1821 is then entered and the combined status byte is "ANDed" with the final restrike mask. The result (1752 in FIG. 17) is stored in the corresponding address of the phantom keyboard memory (block 1822); e.g. the first address of the phantom keyboard memory for the C's. Diamond 1823 is next entered and inquiry is made as to whether or not the last note byte (i.e., B) has been processed. If not, block 1824 is entered and the keyboard memory address is incremented to the address of the next note byte (C# for the next pass through the routine). The routine continues until 12 combined note bytes, modified with the restrike as defined, have been entered in the phantom keyboard memory. The inquiry of diamond 1823 will then be answered in the affirmative, and block 1825 is entered. This block represents the clearing of the note pattern memory 1625. The routine is then exited.

Referring to FIG. 19, there is shown a flow diagram for implementing the "manual memory" feature of the invention. As previously noted, the "manual memory" feature can be selected by the stop 750 (FIG. 7). When the manual memory feature is on, a continuous (in time) sequence of notes played on the accompaniment keyboard is sustained even after the player's hands have both been removed from the accompaniment keyboard (e.g. for two-handed playing on the solo keyboard, to change a stop, etc.) and this condition continues until a new note is played on the accompaniment keyboard, whereupon the previously sustained notes are cleared. The manual memory feature was parenthetically noted in conjunction with the block 311 in FIG. 3, but was not described at that point to avoid unduly complicating the initial explanation of the reading of the keyboard statuses into memory. When the manual feature of the invention is employed, the block 311 of FIG. 3 will be in accordance with the flow diagram set forth in FIG. 19. In accordance with FIG. 19, decision diamond 1911 is first entered, and inquiry is made as to whether or not the manual memory stop (750—FIG. 7) is on. If not, block 1912 is entered, all keyboards are read into memory in accordance with the routine set forth in FIG. 6, and the routine is exited. If the manual memory stop is on, block 1913 is entered, this block representing the reading and storage of the status of the solo keyboard (only). This can again be done in accordance with the routine of FIG. 6, except that only the addresses for the solo keyboard memory are cycled through. Decision diamond 1915 is then entered, and the accompaniment keyboard is scanned to determine if any notes thereof are being played. This may be done in the same manner that the accompaniment keyboard would normally be read in, but instead of storing each data byte, the received data bytes are merely tested for the presence of "1" bits. If no accompaniment keyboard keys are being played, block 1916 is entered, this block representing the resetting of a "previous accompaniment note" flag, whose purpose will become clear momentarily. If an accompaniment keyboard key is being played, diamond 1917 is entered, and inquiry is made as to whether or not the previous accompaniment note flag is on. If it is not, then the accompaniment keyboard notes being played are new notes. In such case, the block 1918 is entered which represents the setting of the previous accompaniment note flag, and then the block 1919 is entered which represents the clearing of the accompaniment keyboard memory 522 (FIG. 5). The block 1920 is then entered, this block also being entered from the "yes" output branch of diamond 1917. The block 1920 represents the "ORing" of the status of the accompaniment keyboard (i.e., the twelve bytes thereof) into the accompaniment keyboard memory. The routine is then exited, exit also having been implemented from the output of block 1912.

In operation, a new accompaniment keyboard note will cause the setting of the "previous accompaniment note flag" (block 1918), the clearing of the accompaniment keyboard memory (block 1919), and the entry of the present accompaniment keyboard status into the accompaniment keyboard memory that was just cleared (block 1920). So long as a continuous sequence of notes is played and/or sustained on the accompaniment keyboard, the answer to the inquiry of diamond 1915 will be in the affirmative. Since the previous accompaniment note flag is now set, the output of diamond 1917 will be from the "yes" branch thereof, which will cause any new accompaniment keyboard keys that are played to be "ORed" into the accompaniment keyboard memory (block 1920). When both hands are lifted from the accompaniment keyboard, the answer to the inquiry of diamond 1915 will be "no", and the previous accompaniment note flag will be reset (block 1916). However, the accompaniment keyboard memory is not cleared, so the note-representative bytes therein will continue to cause sustained music generation based on the notes played before release. The next new note played on the accompaniment keyboard will then clear the old data from the accompaniment keyboard memory (block 1919). Alternatively, the sustained music produced can be terminated by turning off the manual memory stop 750.

Referring to FIG. 20, there is shown a flow diagram of the routine represented in FIG. 3 by block 315 for automatically sensing musical intervals between notes being played on the accompaniment keyboard and an operator-selected musical tonic. In the present embodiment the tonic is selected by playing one of the foot pedals. (The pedal played also determines the key in which the variable walking bass and/or ORA are played. The presence of certain musical intervals is memorized by setting a plurality of flags which are indicative of such presence. These flags are then used during subsequently performed routines (such as the variable walking bass routine and the variable orchestral rhythm accompaniment routine) to vary the automatically generated note patterns to be compatible with whatever is being played on the accompaniment keyboard. In this manner, musical dissonances are avoided. A particular advantage of the provision for adjustment of automatically generated note patterns is that much greater flexibility becomes available in preselecting the makeup of the automatically generated note patterns. If adjustments of automatically generated note patterns were not performed, the patterns used would have to be restricted to relatively "safe" patterns that would not be disturbingly dissonant if certain notes happened to be played on the accompaniment keyboard. In the present invention, however, the automatically generated note patterns for the variable walking bass and/or the variable orchestral rhythm accompaniment can be selected beforehand with great flexibility as to musical content, and without undue regard for avoiding potential dissonances.

In FIG. 20 the diamond 2011 is first entered and determination is made as to whether or not the variable walking bass stop (701—FIG. 7) is on. If it is not, diamond 2012 is entered, and determination is made as to whether or not the orchestral rhythm accompaniment stop (748—FIG. 7) is on. If neither of these stops is on, the musical interval sensing is not performed, block 2090 is entered, and all flags associated with this routine are reset. If either the variable walking bass or the orchestral rhythm accompaniment feature is on, diamond 2013 is entered, and determination is made as to whether or not any footpedal is on. In the present embodiment the footpedals are used to select the key in which the automatically generated note pattern (variable walking bass or ORA) will be played, so if no pedal is on, these features are not operative and block 2090 is entered directly to reset all flags. If a pedal is on, the block 2014 is entered and the note value a flatted third above the tonic is calculated by a modulo-12 addition of three to the pedal tonic. The pedal note being played is considered in the simple coded form C=0, C#=1, D=2, . . . B=11. Whatever pedal tonic is being played, a flatted third above the pedal tonic is seen to be three (modulo-12) above the pedal tonic. (In other words, three semitones above the pedal tonic.) For example, if the pedal tonic is a C, its code is zero. Three modulo 12 added to zero equals three, which is D#, the desired result. As another example, if the pedal tonic is A#, (decimal code equals 10), then the 3 modulo-12 addition thereto yields 1 (i.e., C#), the desired result since C# is a flatted third above A#.

The manner in which the calculated flatted third, and other note values calculated to be at particular intervals with respect to the tonic (as calculated in accordance with the calculations of the blocks 2015 through 2020) are to be used will be clarified below in conjunction with the latter part of the routine. Briefly, however, these calculations are a convenience to perform beforehand as they simplify later tests regarding the notes actually being played on the accompaniment keyboard. The block 2015 represents the calculation of a natural third above the pedal tonic by a modulo-12 addition of 4 to the pedal tonic code. The next block, 2016, represents the calculation of a flatted fifth above the pedal tonic by an addition of 6 modulo-12 to the pedal tonic. The block 2017 represents the calculation of a natural fifth above the pedal tonic by addition of 7 modulo-12 to the pedal tonic. The next block, 2018, represents the calculation of a sharped fifth above the pedal tonic by addition of 8 modulo-12 to the pedal tonic. The next block 2019 represents the calculation of a flatted seventh above the pedal tonic by the addition of 10 modulo-12 to the pedal tonic. Finally, the block 2020 represents the calculation of a natural seventh above the pedal tonic by the addition of 11 modulo-12 to the pedal tonic.

During the next part of the routine, the accompaniment keyboard memory 522 (FIG. 5) is interrogated to determine if notes are being played on the accompaniment keyboard which result in the previously calculated musical intervals and, if so, flags representative of certain intervals are set or reset, as necessary. Diamond 2031 is entered and determination is made as to whether a flatted third or a natural third is being played on the accompaniment keyboard (i.e., is in the accompaniment keyboard memory). This is simply done by looking at the address of the note value previously calculated as being a flatted third or natural third above the pedal tonic. For example, assume that the pedal tonic was a C. In such case, the flatted third and natural third would have been previously respectively calculated as being three semitones and four semitones above the C; i.e., a D# and an E, respectively. Accordingly, the inquiry of diamond 2031 is answered by examining the D# and E bytes of the accompaniment keyboard memory (FIG. 5) to determine if either of these bytes includes a "1" at any bit position. If so, the inquiry is answered positively and, if not, the inquiry is answered negatively. If a negative answer, the diamond 2032 is entered, and inquiry is made as to whether the diminished, minor, or augmented flags are on (e.g. from previous sampling intervals). If so, the conditions is considered as an "invalid state" and no changes in flag settings are made. In such case the routine is exited via line 2090. In other words, if the diminished, augmented, or minor flag is on (which normally indicate compatibility with a natural or flatted third), then no change in the flags is made at this time merely because no natural or flatted third is being played. If the answer to diamond 3022 is in the negative, diamond 2033 is entered, and inquiry is made as to whether or not the minor footswitch (769—FIG. 7) is on. If not, exiting is effected via line 2090. If so, however, the minor flag is set (block 2034) before exiting. If both flatted third and natural third notes were found to be on (in the prior inquiry of diamond 2031) diamond 2035 is entered, and inquiry is made as to whether both are on. If so, an invalid state is indicated, and the routine is exited via line 2090. If not, diamond 2036 is entered and inquiry is made as to whether or not a flatted third note is on. If not (a response which indicates a natural third, due to the prior inquiry of diamond 2031 having been answered in the affirmative), diamond 2037 is entered, and inquiry is made as to whether either a natural fifth or a sharped fifth is present in the accompaniment keyboard memory. If not, a major mode is indicated and block 2038 is entered, this block representing the resetting of the augmented, minor, and diminished flags. If the answer to the inquiry of diamond 2037 had been in the affirmative, diamond 2039 is entered, and inquiry is made as to whether both the natural fifth and sharped fifth are on. If so, an invalid state is assumed, and the routine is exited via line 2090. If not, decision diamond 2040 is entered, and inquiry is made as to whether or not a sharped fifth is being played (i.e., present in the accompaniment keyboard memory). If not, block 2038 is entered for resetting of the augmented, minor and diminished flags (since a major mode is again indicated). If the answer to the inquiry of diamond 2040 is positive, however, block 2041 is entered, this block representing the setting of the augmented flag and the resetting of the minor and diminished flags (since the combination of a natural third and sharped fifth indicates an augmented mode.) The diamond 2050 is then entered.

Returning to the "yes" output branch of diamond 2036 (flatted third on, natural third not on), diamond 2042 is entered, and inquiry is made as to whether either a flatted fifth or a natural fifth is being played. If not, block 2043 is entered, the minor flag is set and the diminished and augmented flags are reset. If the answer to the inquiry of diamond 2042 is in the affirmative, diamond 2044 is entered, and inquiry is made as to whether both the flatted fifth and natural fifth are on. If "yes", an invalid state is assumed and the routine is exited via line 2090. If "no", diamond 2045 is entered, and inquiry is made as to whether a flatted fifth is being played. If not, block 2043 is entered, the minor flag is set and the diminished and augmented flags are reset. If, however, a flatted fifth is being played, block 2046 is entered, and the diminished flag is set (since the flatted third and the flatted fifth are both present to get to this point) and the minor and augmented flags are reset. Diamond 2050 is then entered, this decision diamond also having been previously entered from the outputs of blocks 2038 and 2041. The diamond 2050 represents the inquiry as to whether either a natural seventh or a flatted seventh is being played. If not, block 2051 is entered, and the major seventh and dominant seventh flags are reset. If the inquiry of diamond 2050 is answered in the affirmative, diamond 2052 is entered, and determination is made as to whether both a natural seventh and flatted seventh are being played. If so, an invalid state is assumed and the routine is exited. If not, diamond 2053 is entered, and inquiry is made as to whether or not a natural seventh is present. If so, a major seventh mode is indicated and the major seventh flag is set while the dominant seventh flag is reset. If the answer to the inquiry of diamond 2053 is negative, a flatted seventh is indicated and the dominant seventh flag is set while the major seventh flag is reset (block 2055). The musical interval sensing routine is then complete and is exited.

Figure 21:
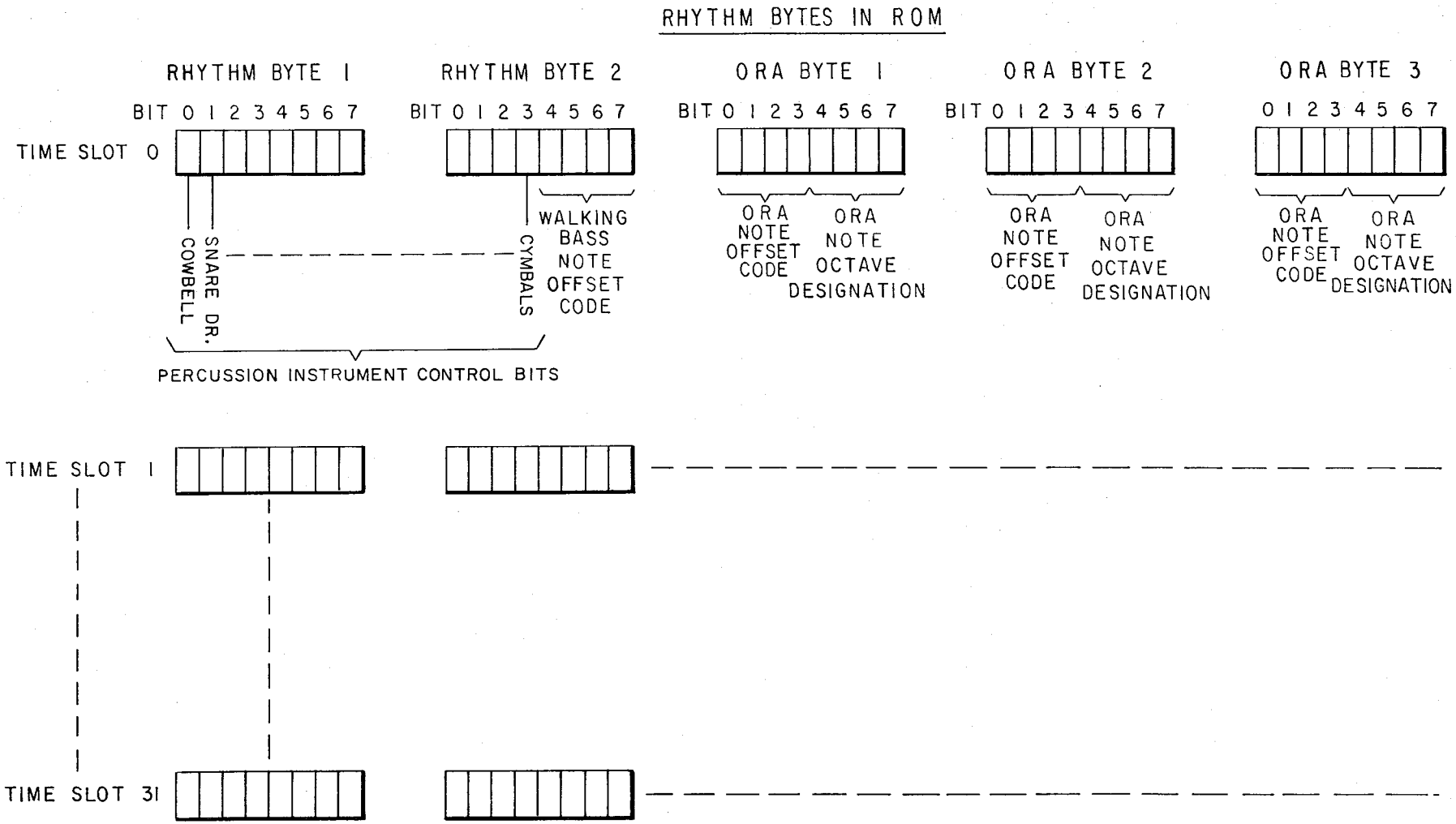
FIG. 21 is a diagram which illustrates the manner in which rhythm-representative information and rhythm accompaniment information is stored in the present embodiment of the invention.

Referring to FIG. 21, there is shown a diagram which illustrates the manner in which rhythm-representative information and rhythm accompaniment information is stored in the present embodiment of the invention. As previously described, a bank of rhythm tabs 740 (FIG. 7) are provided for controlling the automatic generation of various rhythms such as "waltz", "samba", "jazz-swing", etc. The rhythms are generated using the selected combinations of percussion instrument sounds of the rhythm generator (FIG. 14). Also, when the automatic rhythm accompaniment voices are generated (i.e., variable walking bass and orchestral rhythm accompaniment), the selected rhythm tab determines the rhythm of the automatically generated musical accompaniment. The variable walking bass is controlled by stop 745. As previously noted, the walking bass generates a repetitive musical accompaniment using the pedal voices, the musical accompaniment being at a rhythm which is in accordance with the selected rhythm tab and which is played in a key that is determined by the pedal being played at the time by the operator. Another musical rhythm accompaniment is called "orchestral rhythm accompaniment" (ORA) and is turned on by stop 748. In the present embodiment, the orchestral rhythm accompaniment is generated using the orchestral voices. Both the variable walking bass and the orchestral rhythm accompaniment are automatically variable to adjust for musical compatibility with whatever is being played on the accompaniment keyboard.

In the present embodiment, all of the rhythm instruments and the musical rhythm accompaniments are based on repetitive patterns of 32 time slots. The time between time slots determines the tempo of the rhythm and is adjustable by an operator-controllable adjustment of a potentiometer on the musical instrument console. The potentiometer controls timing block 105 (FIG. 1) to generate interrupt pulses at the tempo-determining rate. The interrupts are generated at regular intervals, and when an interrupt occurs, the main routine of FIG. 3 is temporarily exited and an interrupt routine (set forth in conjunction with FIG. 23) is performed. As will be described, during the interrupt routine appropriate output bits are coupled to the output latches which control the rhythm generation (FIG. 14). Also, appropriate note-representative bits are loaded into the pedal memory and phantom keyboard memory for generation of the musical rhythm accompaniments (variable walking bass and orchestral rhythm accompaniment). Toward this end, a plurality of 32×5 patterns are stored in the microprocessor's read only memory (ROM) storage, one such pattern being stored for each available rhythm ("waltz", "samba", . . . etc.). (It will be understood that, if desired, more than one pattern could be stored for each rhythm, and this would provide more selection options.) The format of one such rhythm pattern is illustrated in FIG. 21. At each of the thirty-two time slots of the pattern (designated time slot 0 through time slot 31), five bytes are provided. As designated in FIG. 21, the first byte and the first four bits of the second byte are used to control the percussion instruments (FIG. 14) i.e., a one or a zero at each bit position respectively controls the on/off status of one of the percussion instruments 1411, 1412 . . . , etc. The last four bits of the second rhythm byte are used to control the variable walking bass; i.e., the four bits represent a note offset code with respect to the pedal note which determines the key in which the walking bass pattern is to be played. By using offsets to represent the stored patterns, the patterns can be set forth without regard to the key in which they will be played in any given instance. The last three bytes at each time slot are designated as ORA byte 1, ORA byte 2, and ORA byte 3. Each of these bytes represents one note to be played, so up to three different ORA notes can be played at a time (actually, as will be seen, a plurality of octaves of each of the three notes can be played at a time). The first four bits of each ORA byte represent the offset code for the respective ORA note to be played, and the last four bits of each byte indicates the octaves in which the note is to be played. This means that in the present embodiment the ORA music is played within a four octave span.

It will be understood that although 32 consecutive time slots of bytes are provided for each pattern, some or many of the bytes may represent silence during given parts of the pattern; e.g. by providing zeros as appropriate.

Referring to FIG. 22, there is shown the routine represented by block 314 of FIG. 3, for downloading the stored rhythm pattern (e.g. FIG. 21) from ROM memory to RAM memory. In the present embodiment only a single rhythm pattern whose stop has been turned on is downloaded into RAM storage. Block 2211 is entered and a rhythm pointer, which is used to sequence through the various rhythm stops, is initialized at the first rhythm designation. Diamond 2212 is then entered, and inquiry is made as to whether or not the rhythm stop is on. If not, diamond 2213 is entered. If so, however, diamond 2215 is entered for determination of whether the particular rhythm was on during the previous pass. If it was, the rhythm has already been downloaded into RAM, and the routine is exited. If it was not, the block 2216 is entered and the RAM storage to be used is cleared. Block 2217 is next entered, and a ROM pointer is loaded with the first ROM address of the rhythm under consideration. The block 2218 is then entered, this block representing the loading of a RAM pointer with the first address to be used in the RAM storage area for holding the downloaded rhythm. Next, the ROM data pointed to is read into the RAM location pointed to (block 2219). Diamond 2220 is then entered and inquiry is made as to whether ROM and RAM pointers are at their maxima. If not, the ROM and RAM pointers are incremented (block 2221) and block 2219 is re-entered. The loop 2225 is then continued until all of the data for the rhythm has been loaded into the designated RAM storage area. In the present embodiment, there are 32×5=160 bytes loaded into the RAM storage area (see FIG. 21). With the selected rhythm having been downloaded into RAM storage, the routine is exited. The routine will also be exited via diamond 2213 if no rhythms are found to be on, or via diamond 2215, as previously explained, if the rhythm which is on is found to have been on during the previous pass (such that it was already downloaded into RAM storage and is still available there). In the present embodiment provision is made for having only one rhythm on at a time. However, at least as far as the percussion instruments are concerned, it will be understood that multiple rhythms could be implemented simultaneously by ORing the rhythm instrument bits (the first one-and-a-half bytes of the illustrated five bytes for each time interval) into RAM storage. Even if multiple rhythms are allowed for the rhythm instruments, it is not recommended for musical rhythm accompaniments since different musical patterns played simultaneously would generally not be desirable.

Figure 23:
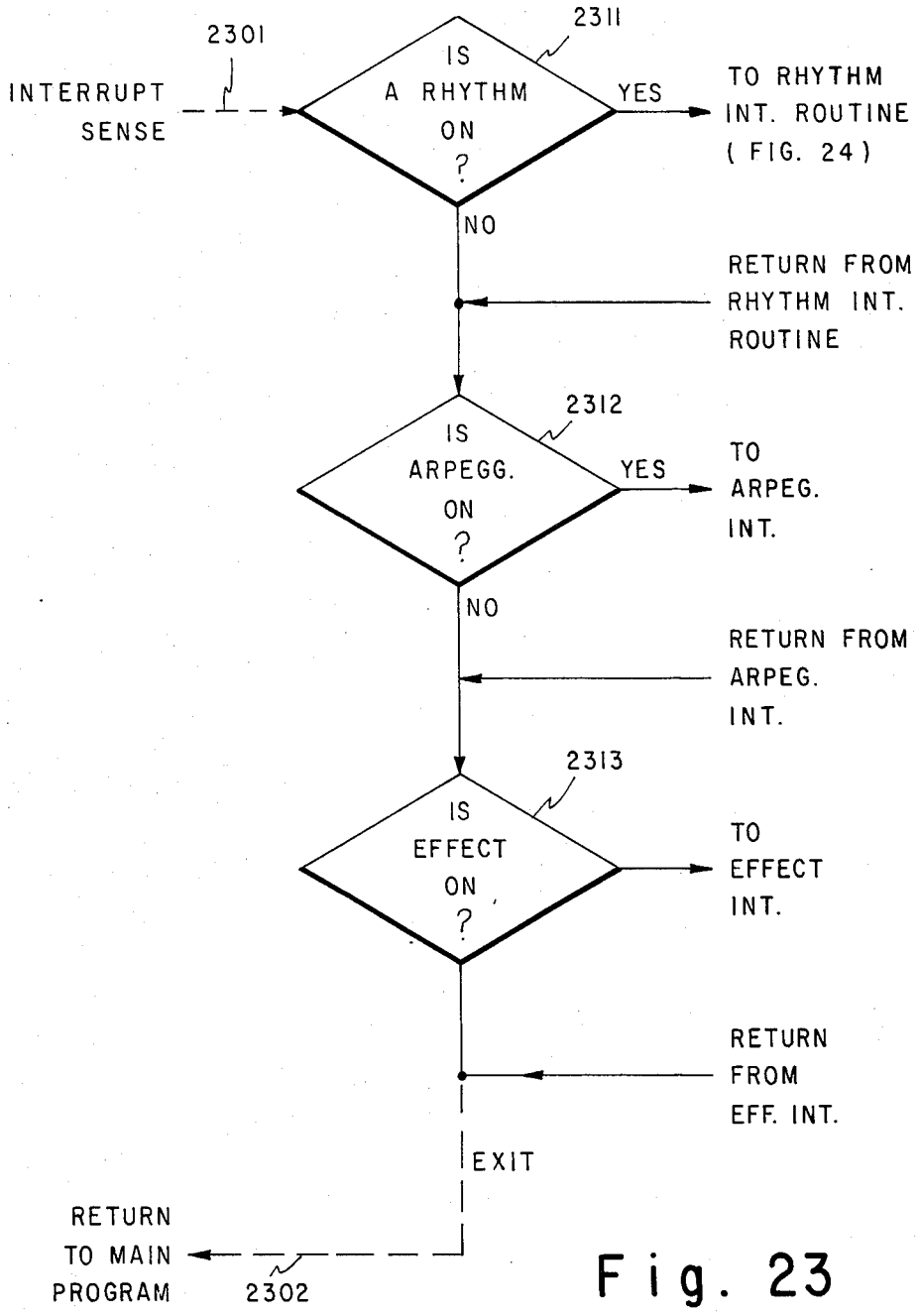
FIG. 23 is a flow diagram of the interrupt routine.
Figure 24:
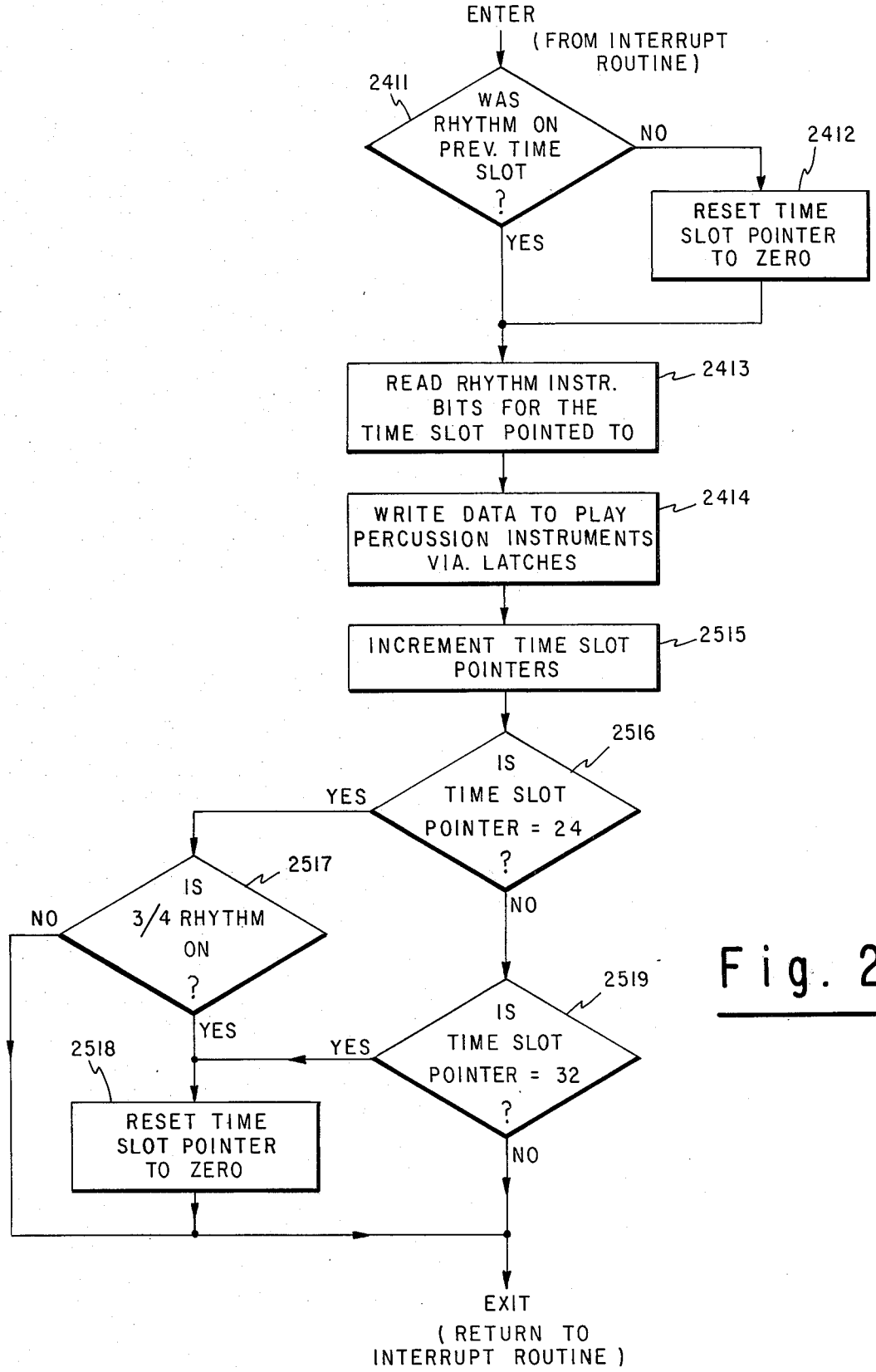
FIG. 24 is a flow diagram of the rhythm interrupt portion of the interrupt routine.

Referring to FIGS. 23 and 24, there are shown flow diagrams of the interrupt routine represented generally by the block 321 of FIG. 3. When an interrupt signal is generated by the timing block 105 (FIG. 1), the routine of FIG. 3 is interrupted, and the interrupt routine of FIG. 23 is entered (dashed line 2301). After the interrupt routine has been performed, return is made (dashed line 2302) to the appropriate place in the main routine for the continuation thereof. In FIG. 23, diamond 2311 is entered, and inquiry is made as to whether or not a rhythm stop is on. If so, the rhythm interrupt routine of FIG. 24 is entered. If not, diamonds 2312 and 2313 are successively entered for inquiry as to whether or not the arpeggiate stops are on or the effects stops are on. Specific arpeggiate and effects techniques are not the subject of the present invention, so specific routines therefor are not set forth herein. However, if such routines are implemented, the timing of notes to be generated can be performed in accordance with an interrupt scheme, analogous to that set forth in the rhythm interrupt routine of FIG. 24. For example, with regard to arpeggiation, an arpeggiation interrupt routine would be used to keep track of the times at which the calculated notes of arpeggios (calculated in accordance with the block 316 of FIG. 3) would be output (played). The same is true for generation of special effects such as "reiterate" which can utilize an interrupt technique for generating the necessary output controls.

FIG. 24 is the rhythm interrupt routine, entered from the "yes" branch of diamond 2311 of the interrupt routine of FIG. 23. Diamond 2411 is first entered and determination is made as to whether or not the rhythm was on during the previous time slot. If not, a time slot pointer is reset to zero (block 2412). The time slot pointer designates the time slots from 0 to 31 (see FIG. 21). Block 2413 is then entered, this block also being entered from the "yes" output branch of diamond 2411. The block 2413 represents the reading, from the downloaded rhythm in RAM, the percussion instrument bits (i.e., the first one and one-half bytes, as shown in FIG.

21) for whatever time slot is pointed to. These bits are then written out to play the percussion instruments (FIG. 14) by applying the bits to the output latches of FIG. 14 (block 2414 of FIG. 24). The time slot pointer is then incremented (block 2515) and diamond 2516 is entered for a determination of whether the time slot pointer equals 24. If so, diamond 2517 is entered, and determination is made as to whether the $\frac{3}{4}$ time rhythm is on. (The $\frac{3}{4}$ time control may be, for example, a flag stored in conjunction with each rhythm.) If not, return is made to the interrupt routine of FIG. 23. If $\frac{3}{4}$ time is on, however, block 2518 is entered, this block representing the resetting of the time slot pointer to zero. Returning to the "no" output of diamond 2516, the diamond 2519 is next entered for a determination of whether or not the time slot pointer equals 32. If not, the routine is exited, whereas if so, block 2518 is entered for a resetting of the time slot pointer to zero. Accordingly, when conventional 4/4 time is selected, the time slot pointer sequences through all 32 time slots and is then reset to zero to start over. If the $\frac{3}{4}$ time is on, recycling occurs after 24 time slots.

Figure 25A:
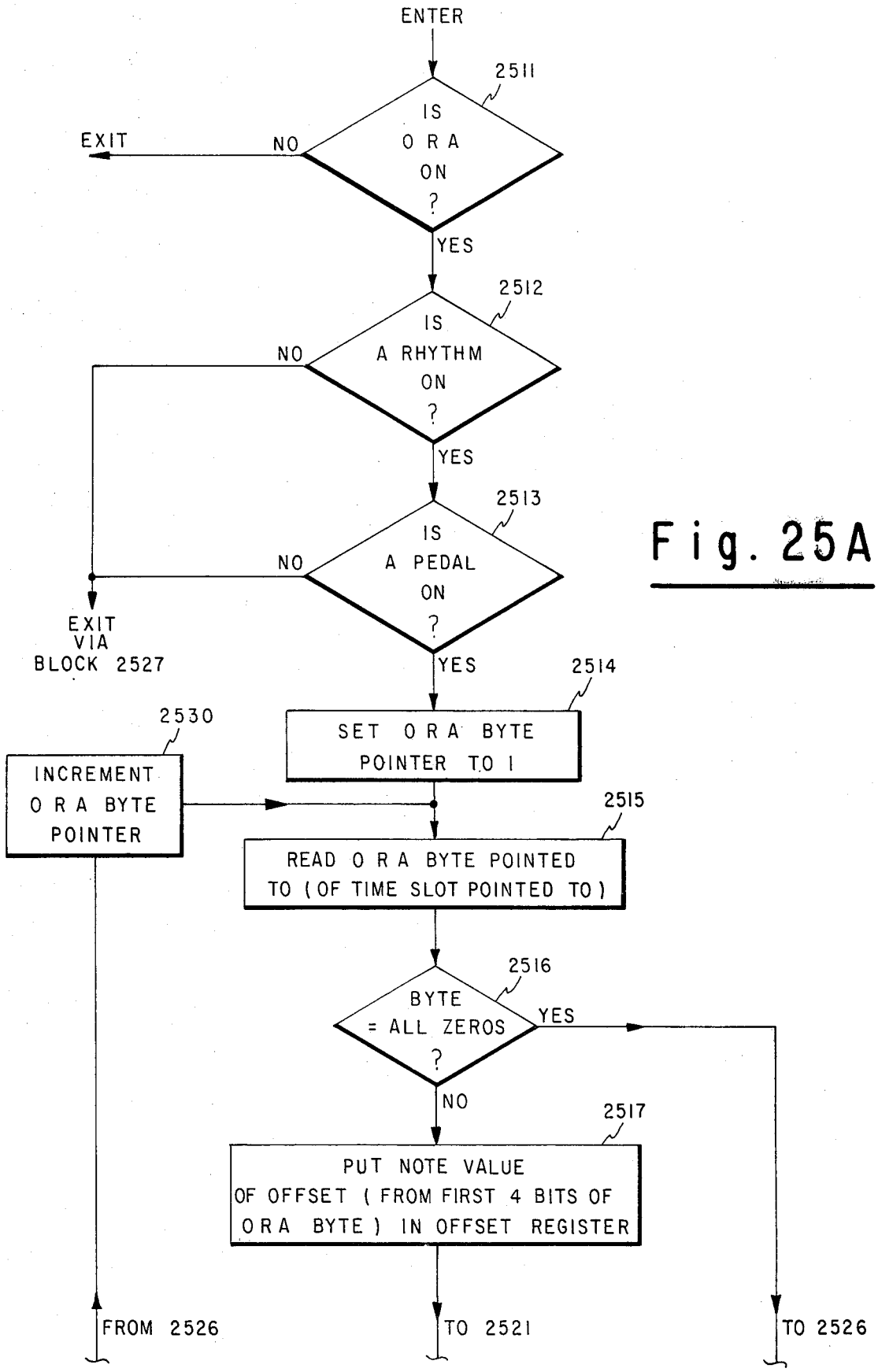
FIG. 25, consisting of FIGS. 25A and 25B, placed one-below-another, is a flow diagram of the routine for implementing the orchestral rhythm accompaniment feature of the present invention.
Figure 25B:
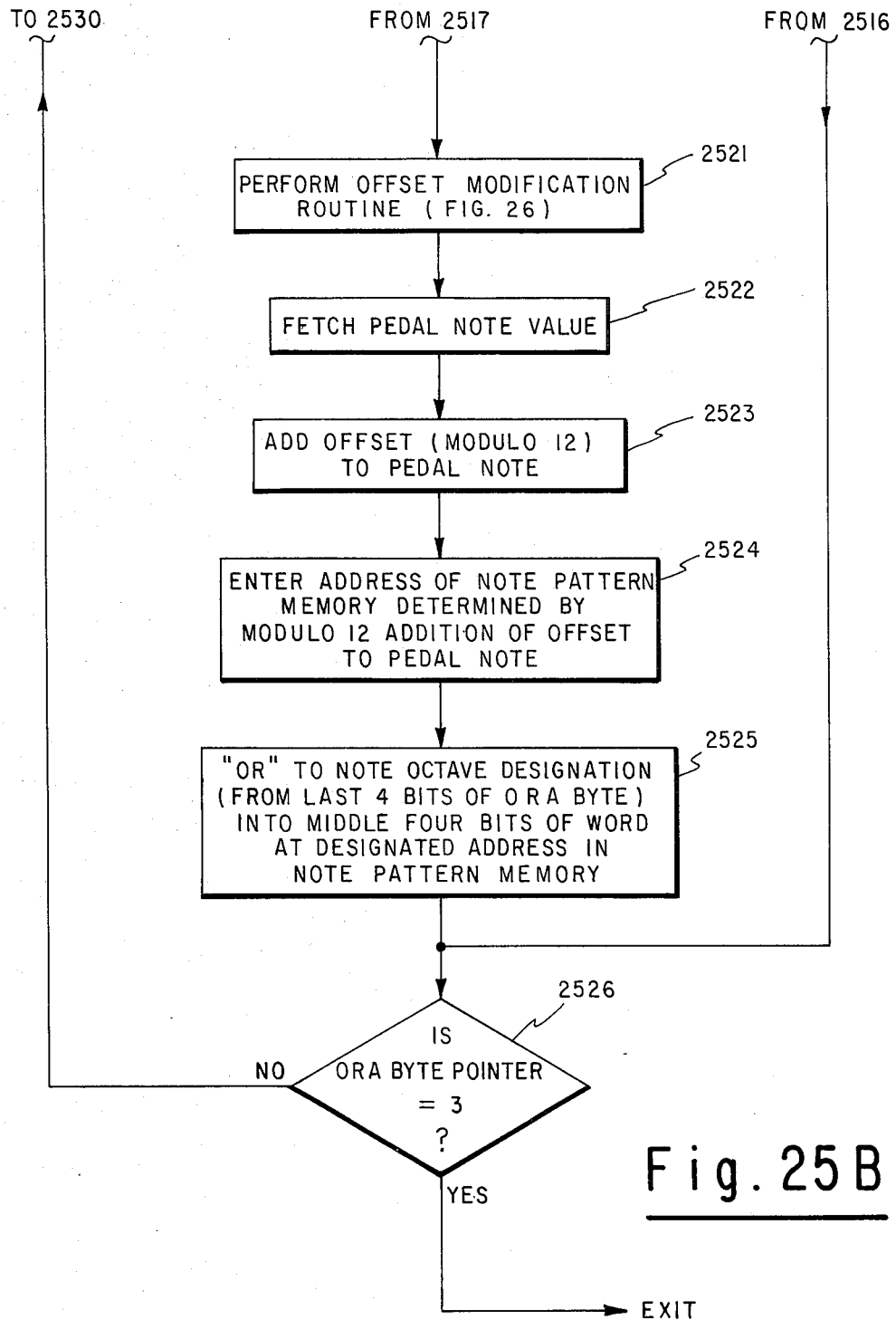
Figure 26:
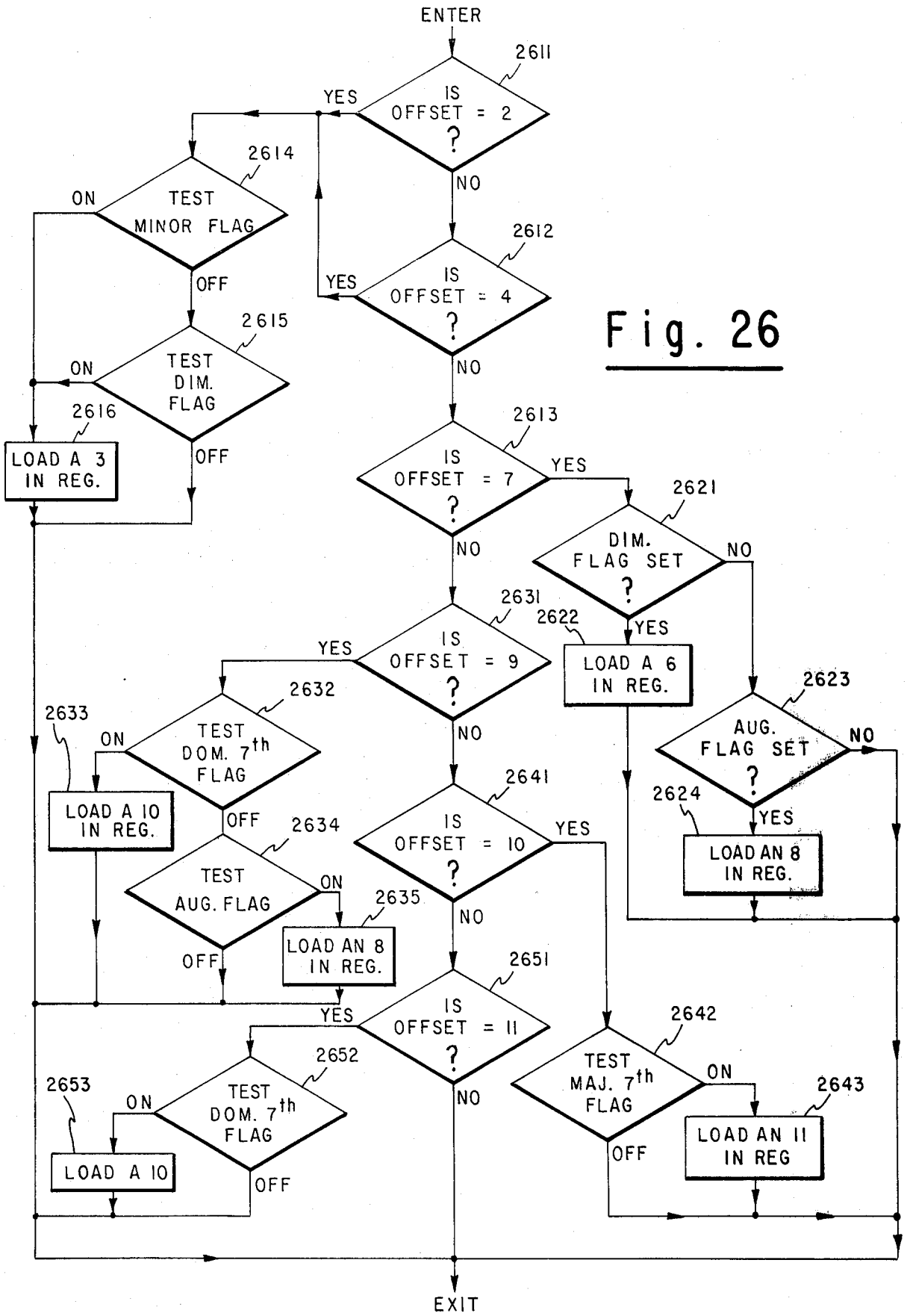
FIG. 26 is a flow diagram of the routine for modifying rhythm accompaniment offsets for compatibility with whatever is being played on the accompaniment keyboard.

Referring to FIG. 25, there is shown a flow diagram of the routine for implementing the orchestral rhythm accompaniment, as represented by the block 317 of FIG. 3. This routine also involves use of the routine of FIG. 26 for modification of the orchestral rhythm accompaniment note pattern for compatibility with whatever is being played on the accompaniment keyboard. Diamond 2511 is entered, and inquiry is made as to whether or not the orchestral rhythm accompaniment (ORA) stop is on. If not, the routine is exited, whereas if so, diamonds 2512 and 2513 are successively entered to determine if a rhythm is on and a pedal is being played. Since the orchestral rhythm accompaniment feature is only operative if both a rhythm is on and a pedal is being played (the pedal being determinative of the key in which the ORA pattern is played), the routine is also exited if the answer to either of these inquiries is in the negative. The exit, in this case, is via block 2527, which is described below. If the conditions of diamonds 2511–2513 are satisified, block 2514 is entered, this block representing the setting of an ORA byte pointer to one. The ORA byte pointer is used to identify which of the three ORA bytes (FIG. 21) is being processed in a particular pass through this routine. Block 2515 is next entered, this block representing the reading of the ORA byte pointed to of the time slot pointed to. It will be recalled that the time slot under consideration is determined by the time slot pointer which was established and incremented, as necessary, in accordance with the rhythm interrupt routine of FIG. 24. Determination is next made as to whether or not the pointed to byte is all zeros (diamond 2516). If so, diamond 2526 is entered directly so that certain processing of this byte is bypassed. If not, block 2517 is entered, and the note value of the offset, stored as the first four bits of the ORA byte (as previously described in conjunction with FIG. 21) is entered in an offset register. The block 2521 is next entered, and the offset modification routine of FIG. 26 is performed in order to modify the offset (if necessary) to be compatible with whatever is being played on the accompaniment keyboard. This routine will be described hereinbelow. The note value of the pedal being played is read (block 2522) and the offset is added, modulo-12, to the pedal note to obtain the note value of the ORA note to be played (block 2523). The note value is entered in the automatically generated note pattern memory 1625 (FIG. 16) from which it is ultimately transferred to the phantom keyboard memory (as described in conjunction with the routine of FIG. 18) for playing via the orchestral voices. This function is represented by the block 2524. Having determined the appropriate byte of the note pattern memory 1625 (for example, the byte which represents all octaves of the F♯'s in this memory), the last four bits of the ORA byte under consideration (FIG. 21) are used to determine which octaves of the note are to be played. In other words, when originally devising the ORA note pattern for storage in ROM, up to four different octaves of each of the three ORA notes (as represented by the three ORA bytes of FIG. 21) can be designated for playing during a particular time slot. These last four bits of the ORA byte are "0Red" into bit positions, bit-1 through bit-4, of the designated byte in the note pattern memory 1625. Thus, for example, if the ORA note (as determined from the pedal note and offset, as previously described) as in F♯, and the last four bits of the ORA byte are "0110", then the placement of "1"'s will be at the bit-2 and bit-3 positions of the F♯ byte in the note pattern memory 1625, and this will result in the playing of the notes $F\#_2$ and $F\#_3$ during the particular time interval. The reason that the data is "0Red" into the note pattern memory is to combine the notes to be played pursuant to the ORA feature with any notes to be played via the note pattern memory pursuant to other features (e.g. arpeggiation). Diamond 2526 is next entered, and inquiry is made as to whether or not the ORA byte pointer equals 3. If so, the routine is exited, whereas if not, the block 2530 is entered for incrementing of the ORA byte pointer. The next ORA byte is then processed in the same manner.

Referring to FIG. 26, there is shown a flow diagram of the routine for modifying the offset for compatibility with whatever is being played on the accompaniment keyboard, as represented in FIG. 25 by the block 2521, and later in FIG. 27 by the block 2717 (when the routine is used in conjunction with the variable walking bass routine). Diamond 2611 is entered, and inquiry is made as to whether or not the offset equals 2 (decimal to be used throughout this part of the description). If so, diamond 2614 is entered, and determination is made as to whether or not the minor flag is set. (Recall the setting of flags which was performed in conjunction with the musical interval sensing routine of FIG. 20.) If the minor flag is on, a 3 is loaded into the offset register (block 2616) in place of the 2 which had been in there. Thus, the dissonance which might result from the playing of a second or a tenth in conjunction with a minor mode being played on the accompaniment keyboard is avoided by modifying the note to result in a minor interval offset. If the minor flag is off, the diminished flag is tested (diamond 2615), and, again, a 3 is loaded into the offset register (block 2616) if the diminished flag is found to be on. If the diminished flag is off, the routine is exited, and exit is also evident after block 2616. If the inquiry of diamond 2611 was in the negative, determination is made as to whether or not the offset equals 4 (diamond 2612). If so, diamond 2614 is entered for modifications (if necessary) as just described; i.e., to load a 3 into the offset register (in place of the 4) so that the note played is compatible with the minor or diminished mode (as the case may be), and to avoid playing the indicated incompatible major third which would be played if the offset of 4 was left unchanged.

If the answer to the inquiry of diamond 2612 was negative, diamond 2613 is entered, and the offset is tested to see if it is a 7. If so, a musical fifth is indicated, and the diminished flag is next tested (diamond 2621). If the diminished flag is on, a 6 is loaded into the offset register (i.e., the note in the offset register is diminished), as indicated by block 2622. If the diminished flag was off, the augmented flag is tested (diamond 2623). If the augmented flag is on, the interval to be played is changed to an augmented fifth by loading an 8 into the offset register (block 2624). The "no" output branch of diamond 2623 and the outputs of blocks 2622 and 2624 all lead to the exit of the routine. Returning to the "no" output branch of diamond 2613, an offset of 9 is next tested for (diamond 2631). If a 9 is present, a musical sixth is indicated, and diamond 2632 is entered to test the dominant seventh flag. If the dominant seventh flag is on, a 10 is loaded into the offset register in place of the 9, so that the sixth will not be played in conjunction with the dominant seventh mode. Rather, a note resulting in a dominant seventh interval will be played. If the dominant seventh flag was off, the augmented flag is tested (diamond 2634), and if it is on, an 8 is loaded into the offset register (block 2635) so that an augmented fifth is played instead of the original sixth. The routine exits from the "off" output branch of diamond 2634 and from the outputs of blocks 2633 and 2635. The "no" output branch of diamond 2631 is input to diamond 2641 where the offset is tested for the presence of a 10 (musical dominant seventh). If a 10 is found to be present, the major seventh flag is tested (diamond 2642). If it is on, an 11 (musical major seventh) is loaded into the offset register (block 2643), the routine is exited, as it is from the "off" output branch of diamond 2642. The "no" output branch of diamond 2641 is input to diamond 2651 where the presence of an offset of 11 is detected. If the offset equals 11, indicating a musical major seventh, the dominant seventh flag is tested (diamond 2652). If the dominant seventh flag is on, an offset of 10 is loaded into the offset register (block 2653) so as to change the note being played to result in a dominant seventh interval instead of a major seventh interval. Exiting of the routine is then effected from the "no" output branch of diamond 2651, the "off" output branch of diamond 2652, and the output of block 2653. Accordingly, it is seen that the interval-representative number in the offset register is modified for compatibility with the flags which were set, the flags having, in turn, been set in accordance with what is currently being played on the accompaniment keyboard. This results in the automatically generated note patterns being compatible with what is being played on the accompaniment keyboard, and undesirable dissonances are avoided.

Figure 27:
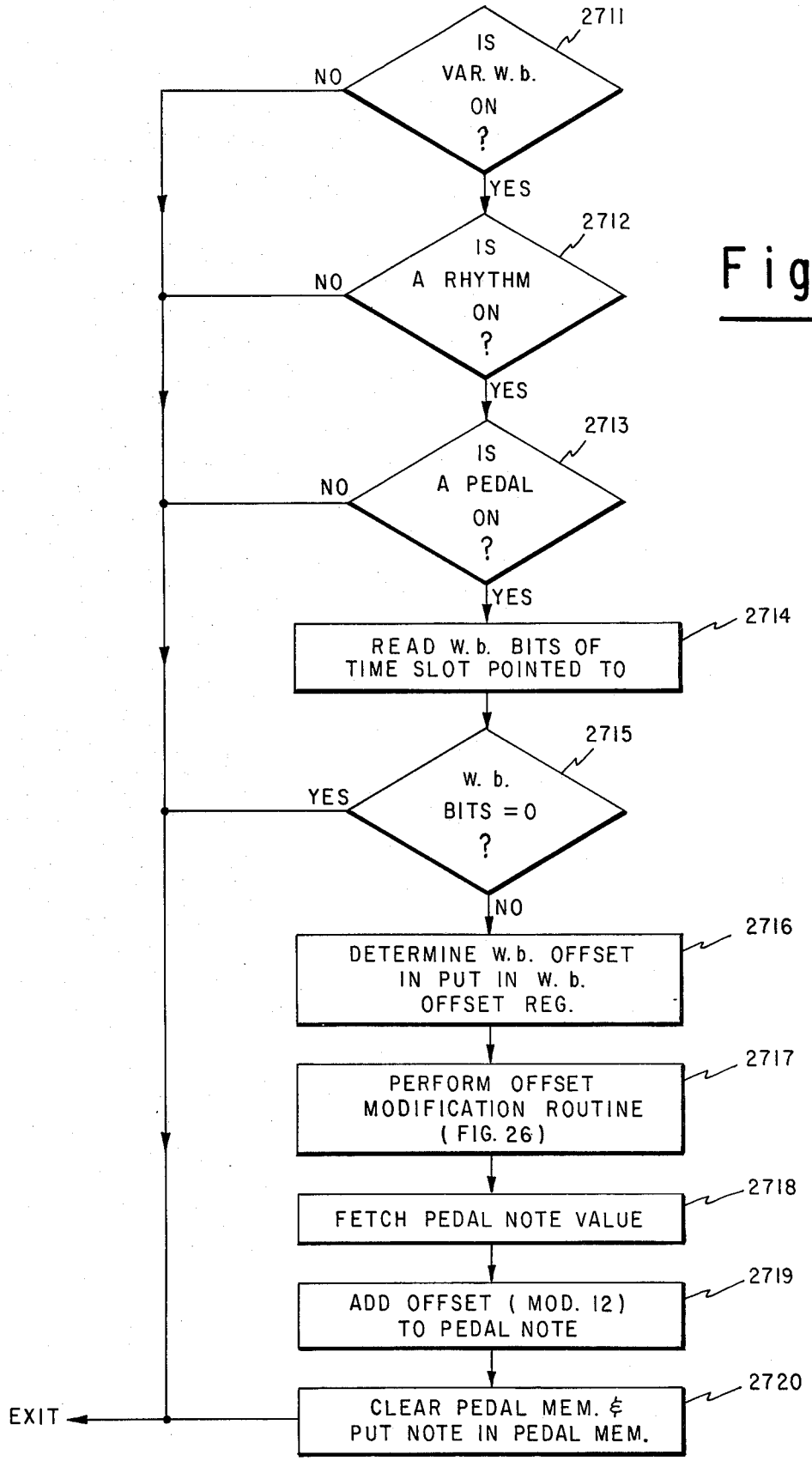
FIG. 27 is a flow diagram for implementing the variable walking bass routine of the invention.

FIG. 27 is a flow diagram for implementing the variable walking bass routine represented by the block 318 of FIG. 3. As previously noted, this routine also involves use of the routine of FIG. 26 for modification of the orchestral rhythm accompaniment note pattern for compatibility with whatever is being played on the accompaniment keyboard. Diamond 2711 is entered, and inquiry is made as to whether or not the variable walking bass stop is on. If not, the routine is exited, whereas if so, diamonds 2712 and 2713 are successively entered to determine if a rhythm is on and a pedal is being played. Since the variable walking bass feature is only operative if both a rhythm is on and a pedal is being played (the pedal being determinative of the key in which the walking bass pattern is played), the routine is also exited if the answer to either of these inquires is in the negative. If the conditions of diamonds 2711–2713 are satisfied, block 2714 is entered, this block representing the reading of the variable walking bass bits of the time slot pointed to (FIG. 21). It will again be recalled that the time slot under consideration is determined by the time slot pointer which was established and incremented, as necessary, in accordance with the rhythm interrupt routine of FIG. 24. Determination is next made as to whether or not the variable walking bass bits are all "1"'s (diamond 2715). (In the coding scheme used, "1111" indicates silence, an offset of "0000" indicating the tonic itself.) If so, the routine is exited. If not, block 2716 is entered, and the note value of the offset is entered in an offset register. The block 2717 is next entered, and the offset modification routine of FIG. 26 is performed, as previously described, in order to modify the offset (if necessary) to be compatible with whatever is being played on the accompaniment keyboard. The note value of the pedal being depressed is read (block 2718) and the offset is added, modulo-12, to the pedal note to obtain the note value of the variable walking bass pedal note to be played. Next, the pedal memory (523—FIG. 5) is cleared (so that the actual pedal depressed will not be played), and the computed note value of the variable walking bass note to be played is entered in the pedal memory (block 2720). The routine is then exited.

Figure 28:
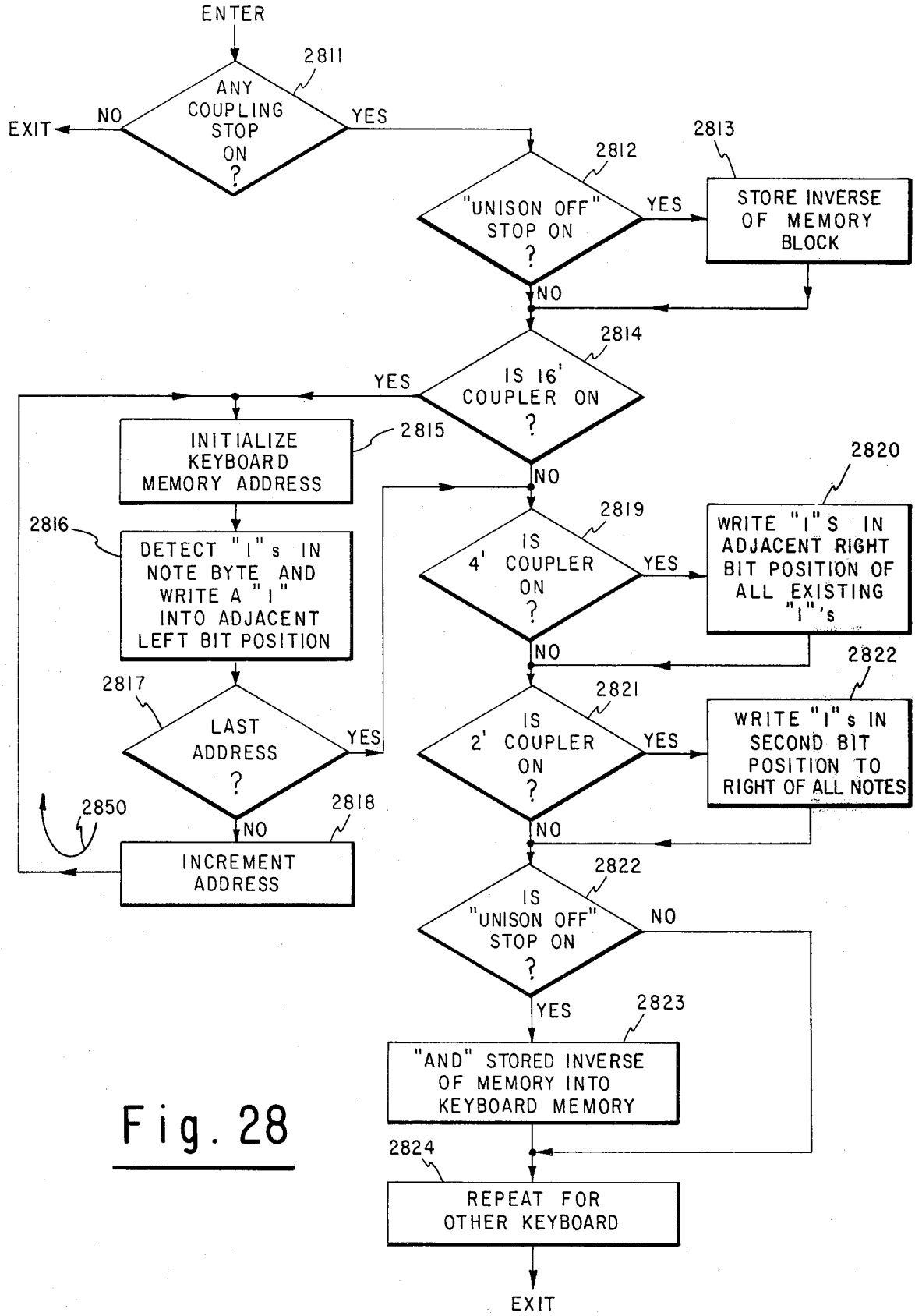
FIG. 28 is a flow diagram of the routine for implementing coupling.

FIG. 28 is a flow diagram of routine for coupling that is represented by the block 319 of FIG. 3. Since, for each keyboard, all octaves of each note are represented within a single byte located at a single address location, the implementation of coupling is facilitated in the present invention. In particular, all that is necessary is that the presence of "1"'s (i.e., notes "on") be detected in each byte, and the appropriate neighboring bits within the byte be turned "on" in accordance with the level of coupling. In FIG. 28 diamond 2811 is entered, and determination is made as to whether or not any of the coupling stops 765 (FIG. 7) are on. If not, the routine is exited. If so, however, diamond 2812 is entered, and determination is made as to whether or not the "unison off" stop is active. Normally, if one or more coupling stops are on, the coupled levels will be played in unison with the note of the key actually being depressed. However, if the "unison off" stop is depressed, the notes of the keys actually depressed will be omitted and only the coupled notes will be output for playing. If the "unison off" stop is active, block 2813 is entered, this block representing the storage of an inverse of the keyboard memory which the coupler is controlling. For example, assume that the coupling stops control coupling on the solo keyboard. In this instance, the block 2813 represents the storage of an inverse of the solo keyboard memory 521 (FIG. 5); i.e., 12 bytes having "0"'s (instead of "1"'s) at the positions of those octaves of each note that is to be played. This inverted memory will be used later to delete the outputting of music with respect to the keys actually being depressed in compliance with the "unison off" stop condition. Diamond 2814 is next entered, and determination is made as to whether or not the 16′ coupler is on. If so, the loop 2850 is entered. In this loop, each byte in the particular keyboard memory (solo in this example) is examined, and a "1" is written into the adjacent left bit position next to any existing "1"'s in the keyboard memory. Due to the manner in which the key statuses are coded in the present invention, this means that for each key that is being depressed, the note one octave lower will be stored to be played; i.e., the desired result for a 16′ coupling operation. In the loop 2850 the recited functions are achieved by initializing the keyboard memory address (block 2815), detecting "1"'s in the note byte at the address, and writing a "1" into the adjacent left bit position (block 2816), testing the address (diamond 2817), and incrementing the address (block 2818) unitl the last address is reached (diamond 2817), whereupon the loop is exited and diamond 2819 is entered. The inquiry of diamond 2819 determines whether or not the 4′ coupler is on. If it is, the block 2820 is entered, and "1"'s are written into the adjacent right bit positions next to the existing "1"'s. Similarly, the diamond 2821 and block 2822 operate, when the 2′ coupler is on, to write "1"'s in the second bit position to the right of the "1"'s representative of the depressed keys. The diamond 2822 is next entered, and determination is made as to whether or not the "unison off" stop is on. If so, the stored inverse (block 2813 above) is "ANDed" into the memory with the effect of deleting the "1"'s representative of the originally depressed keys. The block 2824 is then entered (and is also entered from the "no" output branch of diamond 2822), this block representing the repeating of the procedure for the accompaniment keyboard with respect to any accompaniment keyboard couplers that are on. It will be understood that, if desired, coupling between keyboards can readily be implemented by sensing the position of "1"'s in one keyboard and writing "1"'s into the appropriate positions of the corresponding note byte in the other keyboard memory.

The coding format of the present invention, wherein all octaves of each note of a keyboard are represented within a single byte located at a single address location, also facilitates implementation of arpeggiation. To implement arpeggiation, a note pointer can be moved up (and/or down, depending upon the operator-selected direction of arpeggiation) the keyboard from the lowest note thereof to the highest note thereof. The count up is readily performed by counting interrupts (e.g. an arpeggiate interrupt routine-output of diamond 2312 of the interrupt routine of FIG. 23). As each note is reached, determination is made as to whether any lower octave of the note is being played on the keyboard. In terms of the coding of the present invention wherein all octaves of a note are contained within a single word in memory, this merely involves examining the bits of the particular word (byte) below the bit representative of the note pointed to, to determine if any "1"'s are indicated. If so, the note is effectively "played" by placing the "1" at the corresponding bit position of the automatically generated note pattern memory (1625—FIG. 16).

The invention has been described with reference to a particular embodiment, but variations within the spirit and scope of the invention will occur to those skilled in the art. For example, it will be understood that features such as automatic chord generation and transposition, as well as other known features, can be readily implemented by appropriate manipulation and/or supplementation of words in memory, and without the need for any significant additional hardware. Also, the availability of the RAM and ROM memories indicated in the present embodiment facilitates implementation of stops/effects presets and stops/effects captures. Finally, it will be understood that other conventional electronic organ features can readily be implemented with the present invention, for example, provision for various indicator lamps. Indicator lamps can, for example, be driven via an output latch fed with the information as to which lamps should be on at a given time.

I claim:

1. An electronic musical instrument, comprising:

at least one keyboard having a plurality of octaves of keys;

a digital processor;

random access memory means coupled to said digital processor;

key sampling means, controlled by said digital processor, for sampling, during successive time intervals, the statuses of said keys, said key sampling means forming, during each time interval, a set of digital words, each word having a plurality of bits that respectively represent the key statuses of the different octaves of a note of the chromatic scale;

music generating means coupled to said digital processor;

said digital processor being operative to store the statuses of said keys in said random access memory means and to read out key-representative signals from said random access memory means to said music generating means.

2. The musical instrument as defined by claim 1 wherein said digital processor is operative to: generate keyboard storage addresses specifying keyboard storage locations in said random access memory means; and store the statuses of said keys in said random access memory means at said keyboard storage addresses.

3. The musical instrument as defined by claim 2 wherein said digital words are stored in said random access memory means at said keyboard storage addresses and subsequently read out of said addresses to said music generating means.

4. The musical instrument as defined by claim 1 wherein said set of digital words comprises twelve words, the number of bits per word being a function of the number of octaves on said keyboard.

5. The musical instrument as defined by claim 3 wherein said set of digital words comprises twelve words, the number of bits per word being a function of the number of octaves on said keyboard.

6. The musical instrument as defined by claim 1 wherein said music generating means includes: tone generating circuitry for receiving key-representative signals; voicing generation circuitry for receiving the output of said tone generating circuitry and producing audio signals; and output transducer means for producing output acoustical signals in response to the audio signals output from said voicing generation circuitry.

7. The musical instrument as defined by claim 3 wherein said music generating means includes: tone generating circuitry for receiving key-representative signals; voicing generation circuitry for receiving the output of said tone generating circuitry and producing audio signals; and output transducer means for producing output acoustical signals in response to the audio signals output from said voicing generation circuitry.

8. The musical instrument as defined by claim 1 further comprising:

a plurality of stops/effects control switches;

stops/effects sampling means, controlled by said digital processor, for sampling, during successive time intervals, the statuses of said stops/effects control switches;

and wherein said digital processor is operative to store the statuses of said stops/effects control switches in said random access memory means and to read out stops/effects-representative signals from said random access memory means to said music generating means.

9. The musical instrument as defined by claim 3 further comprising:

a plurality of stops/effects control switches;

stops/effects sampling means, controlled by said digital processor, for sampling, during successive time intervals, the statuses of said stops/effects control switches;

and wherein said digital processor is operative to store the statuses of said stops/effects control switches in said random access memory means and to read out stops/effects-representative signals from said random access memory means to said music generating means.

10. The musical instrument as defined by claim 8 wherein said music generating means includes: tone generating circuitry for receiving key-representative signals; voicing generation circuitry for receiving the output of said tone generating circuitry and the stops-/effects-representative signals from said random access memory means and for producing audio signals with voices that depend upon stops/effects-representative signals; and output transducer means for producing output acoustical signals in response to the audio signals output from said voicing generation circuitry.

11. The musical instrument as defined by claim 9 wherein said music generating means includes: tone generating circuitry for receiving key-representative signals; voicing generation circuitry for receiving the output of said tone generating circuitry and the stops-/effects-representative signals from said random access memory means and for producing audio signals with voices that depend upon stops/effects-representative signals; and output transducer means for producing output acoustical signals in response to the audio signals output from said voicing generation circuitry.

12. The musical instrument as defined by claim 2 wherein said digital processor is operative to: generate phantom storage addresses specifying phantom keyboard storage locations in said random access memory means; store note status information in said random access memory means at said phantom storage addresses; and read out note-representative signals from said phantom storage addresses to said music generating means.

13. The musical instrument as defined by claim 3 wherein said digital processor is operative to: generate phantom storage addresses specifying phantom keyboard storage locations in said random access memory means; store note status information in said random access memory means at said phantom storage addresses; and read out note-representative signals from said phantom storage addresses to said music generating means.

14. The musical instrument as defined by claim 12 wherein said note status information is derived from the key statuses stored at said keyboard storage addresses.

15. The musical instrument as defined by claim 13 wherein said note status information is derived from the key statuses stored at said keyboard storage addresses.

16. The musical instrument as defined by claim 12 further comprising auxiliary memory means for storing predetermined note patterns; and wherein said note status information is derived from said predetermined note patterns.

17. The musical instrument as defined by claim 13 further comprising auxiliary memory means for storing predetermined note patterns; and wherein said note status information is derived from said predetermined note patterns.

18. The musical instrument as defined by claim 12 further comprising auxiliary memory means for storing predetermined note patterns; and wherein said note status information is derived from the key statuses stored at said keyboard storage addresses and from said predetermined note patterns.

19. The musical instrument as defined by claim 13 further comprising auxiliary memory means for storing predetermined note patterns; and wherein said note status information is derived from the key statuses stored at said keyboard storage addresses and from said predetermined note patterns.

20. The musical instrument as defined by claim 16 wherein said auxiliary memory means comprise read-only memory means.

21. The musical instrument as defined by claim 17 wherein said auxiliary memory means comprise read-only memory means.

22. The musical instrument as defined by claim 18 wherein said auxiliary memory means comprise read-only memory means.

23. The musical instrument as defined by claim 19 wherein said auxiliary memory means comprise read-only memory means.

24. The musical instrument as defined by claim 1 further comprising auxiliary memory means for storing predetermined musical rhythm accompaniment note pattern sequences, and wherein said processor is operative to:

store an operator selection of the musical key in which a musical rhythm accompaniment is to be played;

detect, for the stored keyboard key statuses, the presence of predetermined musical intervals between the tonic of the operator-selected musical key and the notes corresponding to keys being played on said keyboard;

modify the predetermined musical rhythm accompaniment note pattern to be compatible with the detected musical intervals; and read out, at spaced time intervals, the modified note pattern sequence to said music generating means.

25. The musical instrument as defined by claim 3 further comprising auxiliary memory means for storing predetermined musical rhythm accompaniment note pattern sequences, and wherein said processor is operative to:

store an operator selection of the musical key in which a musical rhythm accompaniment is to be played;

detect, from the stored keyboard key statuses, the presence of predetermined musical intervals between the tonic of the operator-selected musical key and the notes corresponding to keys being played on said keyboard;

modify the predetermined musical rhythm accompaniment note pattern to be compatible with the detected musical intervals; and read out, at spaced time intervals, the modified note pattern sequence to said music generating means.

26. The musical instrument as defined by claim 12 further comprising auxiliary memory means for storing predetermined musical rhythm accompaniment note pattern sequences, and wherein said processor is operative to:

store an operator selection of the musical key in which a musical rhythm accompaniment is to be played;

detect, from the stored keyboard key statuses, the presence of predetermined musical intervals between the tonic of the operator-selected musical key and the notes corresponding to keys being played on said keyboard;

modify the predetermined musical rhythm accompaniment note pattern to be compatible with the detected musical intervals; and read out, at spaced time intervals, the modified note pattern sequence to said music generating means.

27. The musical instrument as defined by claim 24 wherein said auxiliary memory means comprise a read-only memory means.

28. The musical instrument as defined by claim 25 wherein said auxiliary memory means comprise a read-only memory means.

29. The musical instrument as defined by claim 26 wherein said auxiliary memory means comprise a read-only memory means.

30. The musical instrument as defined by claim 24 wherein said predetermined musical rhythm accompaniment note pattern sequences comprise sequences of musical offsets with respect to a tonic.

31. The musical instrument as defined by claim 28 wherein said predetermined musical rhythm accompaniment note pattern sequences comprise sequences of musical offsets with respect to a tonic.

32. The musical instrument as defined by claim 29 wherein said predetermined musical rhythm accompaniment note pattern sequences comprise sequences of musical offsets with respect to a tonic.

33. The musical instrument as defined by claim 29 wherein said processor is operative to: transfer an operator-selected musical rhythm accompaniment note pattern from said read-only memory means to said random access memory means; and store, after modification for compatibility with said detected musical intervals, the modified note pattern information in said phantom keyboard storage locations.

34. The musical instrument as defined by claim 4 wherein said digital processor is operative to: sense when a key status to be entered in random access memory indicates an off-to-on condition; and temporarily modify the key status to an off condition so as to result in a restrike by the music generating means to the event that the note was already being sustained by the music generating means.

35. The musical instrument as defined by claim 12 wherein said digital processor is operative to: sense when a key or note status to be entered in random access memory indicates an off-to-on condition; and temporarily modify the key or note status to an off condition so as to result in a restrike by the music generating means in the event that the note was already being sustained by the music generating means.

36. The musical instrument as defined by claim 26 wherein said digital processor is operative to: sense when a key or note status to be entered in random access memory indicates an off-to-on condition; and temporarily modify the key or note status to an off condition so as to result in a restrike by the music generating means in the event that the note was already being sustained by the music generating means.

37. The musical instrument as defined by claim 29 wherein said digital processor is operative to: sense when a key or note status to be entered in random access memory indicates an off-to-on condition; and temporarily modify the key or note status to an off condition so as to result in a restrike by the music generating means in the event that the note was already being sustained by the music generating means.

38. The musical instrument as defined by claim 33 wherein said digital processor is operative to: sense when a key or note status to be entered in random access memory indicates an off-to-on condition; and temorarily modify the key or note status to an off condition so as to result in a restrike by the music generating means in the event that the note was already being sustained by the music generating means.

39. The musical instrument as defined by claim 1 wherein said digital processor is operative, in response to an operator control, to:

detect, during a continuous sequence of time intervals, a continuous sequence of "on" keys from said key sampling means;

accumulate, during said continuous sequence, the key statuses in said random access memory means by ORing sampled key statuses into said random access memory means; and clearing the key statuses from said random access memory means upon sensing, from said key sampling means, a condition of no "on" keys followed by an "on" key.

40. The musical instrument as defined by claim 3 wherein said digital processor is operative, in response to an operator control, to:

detect, during a continuous sequence of time intervals, a continuous sequence of "on" keys from said key sampling means;

accumulate, during said continuous sequence, the key statuses in said random access memory means by ORing sampled key statuses into said random access memory means; and clearing the key statuses from said random access memory means upon sensing, from said key sampling means, a condition of no "on" keys followed by an "on" key.

41. The musical instrument as defined by claim 13 wherein said digital processor is operative, in response to an operator control, to:

detect, during a continuous sequence of time intervals, a continuous sequence of "on" keys from said key sampling means;

accumulate, during said continuous sequence, the key statuses in said random access memory means by ORing sampled key statuses into said random access memory means; and clearing the key statuses from said random access memory means upon sensing, from said key sampling means, a condition of no "on" keys followed by an "on" key.

42. An electronic musical instrument, comprising:

at least one keyboard having a plurality of octaves of keys;

a digital processor;

random access memory means coupled to said digital processor;

key sampling means, controlled by said digital processor, for sampling, during successive time intervals, the statuses of said keys;

musical generating means coupled to said digital processor;

said digital processor being operative to: generate keyboard storage addresses specifying keyboard storage locations in said random access memory means; generate phantom storage addresses specifying phantom keyboard locations in said random access memory means; store the statuses of said keys in said random access memory means at said keyboard storage addresses; store note status information in said random access memory means at said phantom storage addresses; read out key-representative signals from said keyboard storage locations to said music generating means; and read out note-representative signals from said phantom storage addresses to said music generating means.

43. The musical instrument as defined by claim 42 wherein said note status information is derived from the key statuses stored at said keyboard storage addresses.

44. The musical instrument as defined by claim 42 further comprising auxiliary memory means for storing predetermined note patterns; and wherein said note status information is derived from said predetermined note patterns.

45. The musical instrument as defined by claim 42 further comprising auxiliary memory means for storing predetermined note patterns; and wherein said note status information is derived from the key statuses stored at said keyboard storage addresses and from said predetermined note patterns.

46. The musical instrument as defined by claim 44 wherein said auxiliary memory means comprise read-only memory means.

47. The musical instrument as defined by claim 45 wherein said auxiliary memory means comprise read-out memory means.

48. The musical instrument as defined by claim 42 further comprising auxiliary memory means for storing predetermined musical rhythm accompaniment note pattern sequences, and wherein said processor is operative to:

store an operator selection of the musical key in which a musical rhythm accompaniment is to be played;

detect, from the stored keyboard key statuses, the presence of predetermined musical intervals between the tonic of the operator-selected musical key and the notes corresponding to keys being played on said keyboard;

modify the predetermined musical rhythm accompaniment note pattern to be compatible with the detected musical intervals; and read out, at spaced time intervals, the modified note pattern sequence to said music generating means.

49. The musical instrument as defined by claim 42 wherein said digital processor is operative to: sense when a key status to be entered in random access memory indicates an off-to-on condition; and temporarily modify the key status to an off condition so as to result in a restrike by the music generating means in the event that the note was already being sustained by the music generating means.

50. The musical instrument as defined by claim 42 wherein said digital processor is operative, in response to an operator control, to:

detect, during a continuous sequence of time intervals, a continuous sequence of "on" keys from said key sampling means;

accumulate, during said continuous sequence, the key statuses in said random access memory means by ORing sampled key statuses into said random access memory means; and clear the key statuses from said random access memory means upon sensing, from said key sampling means, a condition of no "on" keys followed by an "on" key.

51. An electronic musical instrument, comprising:

at least one keyboard having a plurality of octaves of keys;

a digital processor;

random access memory means coupled to said digital processor;

key sampling means, controlled by said digital processor, for sampling, during successive time intervals, the statuses of said keys;

music generating means coupled to said digital processor;

auxiliary memory means for storing predetermined musical rhythm accompaniment note pattern sequences;

said digital processor being operative to:

store the statuses of said keys in said random access memory means and read out key-representative signals from said random access memory means to said music generating means;

store an operator selection of the musical key in which a musical rhythm accompaniment is to be played;

detect, for the stored keyboard key statuses, the presence of predetermined musical intervals between the tonic of the operator-selected musical key and the notes corresponding to keys being played on said keyboard;

modify the predetermined musical rhythm accompaniment note pattern to be compatible with the detected musical intervals; and read out, at spaced time intervals, the modified note pattern sequence to said music generating means.

52. The musical instrument as defined by claim 51 wherein said auxiliary memory means comprise a read-only memory means.

53. The musical instrument as defined by claim 51 wherein said predetermined musical rhythm accompaniment note pattern sequences comprise sequences of musical offsets with respect to a tonic.

54. The musical instrument as defined by claim 52 wherein said predetermined musical rhythm accompaniment note pattern sequences comprise sequences of musical offsets with respect to a tonic.

55. The musical instrument as defined by claim 51 wherein said digital processor is operative to: sense when a key status to be entered in random access memory indicates an off-to-on condition; and temporarily modify the key status to an off condition so as to result in a restrike by the music generating means in the event that the note was already being sustained by the music generating means.

56. The musical instrument as defined by claim 51 wherein said digital processor is operative, in response to an operator control, to:

detect, during a continuous sequence of time intervals, a continuous sequence of "on" keys from said key sampling means;

accumulate, during said continuous sequence, the key statuses in said random access memory means by ORing sampled key statuses into said random access memory means; and clear the key statuses from said random access memory means upon sensing, from said key sampling means, a condition of no "on" keys followed by an "on" key.

57. An electronic musical instrument, comprising:

at least one keyboard having a plurality of octaves of keys;

a digital processor;

random access memory means coupled to said digital processor;

key sampling means, controlled by said digital processor, for sampling, during successive time intervals, the statuses of said keys;

music generating means coupled to said digital processor;

said digital processor being operative to:

store the statuses of said keys in said random access memory means and to read out key-representative signals from said random access memory means to said music generating means;

sense when a key status to be entered in random access memory indicates an off-to-on condition; and temporarily modify the key status to an off condition so as to result in a restrike by the music generating means in the event that the note was already being sustained by the music generating means.

58. An electronic musical instrument, comprising:

at least one keyboard having a plurality of octaves of keys;

a digital processor;

random access memory means coupled to said digital processor;

key sampling means, controlled by said digital processor, for sampling, during successive time intervals, the statuses of said keys;

music generating means coupled to said digital processor;

said digital processor being operative, in response to an operator control, to:

detect, during a continuous sequence of time intervals, a continuous sequence of "on" keys from said key sampling means;

accumulate, during said continuous sequence, the key statuses in said random access memory means by ORing sampled key statuses into said random access memory means; and clear the key statuses from said random access memory means upon sensing, from said key sampling means, a condition of no "on" keys followed by an "on" key.

59. An electronic musical instrument, comprising:

a solo keyboard having a plurality of octaves of keys;

an accompaniment keyboard having a plurality of octaves of keys;

a plurality of foot pedals;

a plurality of stops/effects control switches;

a digital processor;

random access memory means coupled to said digital processor;

key/pedal sampling means, controlled by said digital processor, for sampling, during successive time intervals, the statuses of said keys and pedals, said key/pedal sampling means forming, during each time interval, a set of digital words for each one of the solo keyboard, accompaniment keyboard, and pedals, each word having a plurality of bits that respectively represent the key or pedal statuses of the different octaves of one note of the chromatic scale of the associated keyboard or pedals;

stops/effects sampling means, controlled by said digital processor, for sampling, during successive time intervals, the statuses of said stops/effects control switches;

music generating means coupled to said digital processor, said music generating means including tone generating circuitry; voicing generation circuitry for receiving the output of said tone generating circuitry and producing audio signals; and output transducer means for producing output acoustical signals in response to the audio signals;

said digital processor being operative to: store the statuses of said keys and pedals in said random access memory means; store the statuses of said stops/effects in said random access memory means; read out the statuses of said keys and pedals to said tone generating circuitry; and read out the statuses of said stops/effects to control said voicing generation circuitry.

60. An electronic musical instrument, comprising:

a solo keyboard having a plurality of octaves of keys;

an accompaniment keyboard having a plurality of octaves of keys;

a plurality of foot pedals;

a plurality of stops/effects control switches;

a digital processor;

random access memory means coupled to said digital processor;

key/pedal sampling means, controlled by said digital processor, for sampling, during successive time intervals, the statuses of said keys and pedals;

stops/effects sampling means, controlled by said digital processor, for sampling, during successive time intervals, the statuses of said stops/effects control switches;

music generating means coupled to said digital processor, said music generating means including: tone generating circuitry including a solo tone generator, an accompaniment tone generator, an orchestral tone generator, and a pedal tone generator; voicing generation circuitry for receiving the output of said tone generating circuitry and producing audio signals, said voicing generation circuitry including a solo voicing generator, an accompaniment voicing generator, an orchestral voicing generator, and a pedal voicing generator which respectively receive the outputs of their associated tone generators; and output transducer means for producing output acoustical signals in response to the audio signals;

said digital processor being operative to: generate solo keyboard, accompaniment keyboard, and pedal storage addresses respectively specifying solo keyboard, accompaniment keyboard, and pedal storage locations in said random access memory means; generate stops/effects storage addresses specifying stops/effects storage locations in said random access memory means; generate phantom storage addresses specifying phantom keyboard storage locations in said random access memory means; store the statuses of the solo keys, the accompaniment keys, and the pedals at said solo keyboard, accompaniment keyboard, and pedal storage addresses, respectively; store the statuses of said stops/effects at said stops/effects storage addresses; store note status information at said phantom storage addresses; read out the status of said solo keys, accompaniment keys, and pedals to said solo tone generator, accompaniment tone generator, and pedal tone generator, respectively; and read out note-representative signals from said phantom storage addresses to said orchestral tone generator.

61. The musical instrument as defined by claim 60 wherein said note status information is derived from the key statuses stored at said keyboard storage addresses.

62. The musical instrument as defined by claim 60 further comprising auxiliary memory means for storing predetermined note patterns; and wherein said note status information is derived from said predetermined note patterns.

63. The musical instrument as defined by claim 60 further comprising auxiliary memory means for storing predetermined note patterns; and wherein said note status information is derived from the key statuses stored at said keyboard storage addresses and from said predetermined note patterns.

64. The musical instrument as defined by claim 62 wherein said auxiliary memory means comprise read-only memory means.

65. The musical instrument as defined by claim 63 wherein said auxiliary memory means comprise read-only memory means.

66. The musical instrument as defined by claim 60 further comprising: rhythm generation means which include a plurality of percussion noise generators; and read-only memory means for storing predetermined rhythm pattern sequences and associated rhythm accompaniment note pattern sequences; and wherein said digital processor is operative to:

transfer an operator-selected rhythm pattern sequence and associated rhythm accompaniment note pattern sequence from said read-only memory means to said random access memory means;

read out, at spaced time intervals, said rhythm pattern sequence to said rhythm generation means; and store, at spaced time intervals, in said phantom storage addresses, said rhythm accompaniment note pattern sequence at said phantom storage addresses.

67. The musical instrument as defined by claim 66 wherein each of said rhythm accompaniment note pattern sequences include both a pedal voice note pattern sequence and a keyboard voice note pattern sequence.

68. The musical instrument as defined by claim 67 wherein the operator-selected keyboard voice note pattern sequence is stored, at spaced time intervals, at said phantom storage addresses, and the operator-selected pedal voice note pattern sequence is stored, at spaced time intervals at said pedal storage addresses.

69. The musical instrument as defined by claim 60 further comprising: rhythm generation means which include a plurality of percussion noise generators; and read-only memory means for storing predetermined rhythm pattern sequences and associated rhythm accompaniment note pattern sequences; and wherein said digital processor is operative to:

transfer an operator-selected rhythm pattern sequence and associated rhythm accompaniment note pattern sequence from said read-only memory means to said random access memory means;

read out, at spaced time intervals, said rhythm pattern sequence to said rhythm generation means; and store, at spaced time intervals, said rhythm accompaniment note pattern sequence at said pedal storage addresses.

70. The musical instrument as defined by claim 66 wherein said processor is operative to:

store a pedal note status which represents the musical key in which a musical rhythm accompaniment is to be played;

detect, from the stored keyboard key statuses, the presence of predetermined musical intervals between the pedal note and the notes corresponding to keys being played on said keyboard; and modify the selected rhythm accompaniment note pattern to be compatible with the detected musical intervals.

71. The musical instrument as defined by claim 69 wherein said processor is operative to:

store a pedal note status which represents the musical key in which a musical rhythm accompaniment is to be played;

detect, from the stored keyboard key statuses, the presence of predetermined musical intervals between the pedal note and the notes corresponding to keys being played on said keyboard, and modify the selected rhythm accompaniment note pattern to be compatible with the detected musical intervals.

72. The musical instrument as defined by claim 66 wherein said rhythm accompaniment note pattern sequences comprise sequences of musical offsets with respect to a tonic.

73. The musical instrument as defined by claim 69 wherein said rhythm accompaniment note pattern sequences comprise sequences of musical offsets with respect to a tonic.

74. The musical instrument as defined by claim 70 wherein said rhythm accompaniment note pattern sequences comprise sequences of musical offsets with respect to a tonic.

75. The musical instrument as defined by claim 60 wherein said digital processor is operative to: sense when a key or note status to be entered in random access memory indicates an off-to-on condition; and temporarily modify the key or note status to an off condition so as to result in a restrike by the music generating means in the event that the note was already being sustained by the music generating means.

76. An electronic musical instrument, comprising:

a solo keyboard having a plurality of octaves of keys;

an accompaniment keyboard having a plurality of octaves of keys;

a plurality of foot pedals;

a plurality of stops/effects control switches;

a digital processor;

random access memory means coupled to said digital processor;

key/pedal sampling means, controlled by said digital processor, for sampling, during successive time intervals, the statuses of said keys and pedals;

stops/effects sampling means, controlled by said digital processor, for sampling, during successive time intervals, the statuses of said stops/effects control switches;

music generating means coupled to said digital processor, said music generating means including tone generating circuitry, voicing generation circuitry for receiving the output of said tone generating circuitry and producing audio signals; and output transducer means for producing output acoustical signals in response to the audio signals;

said digital processor being operative to: store the statuses of said keys and pedals in said random access memory means; store the statuses of said stops/effects in said random access memory means; read out the statuses of said keys and pedals to said tone generating circuitry; read out the statuses of said stops/effects to control said voicing generation circuitry; detect, during a continuous sequence of time intervals, a continuous sequence of "on" keys of said accompaniment keyboard; accumulate, during said continuous sequence, the key statuses at said accompaniment keyboaard addresses by ORing sampled accompaniment key statuses into said accompaniment keyboard addresses; and clear the key statuses from said accompaniment keyboard addresses upon sensing a condition of no accompaniment keys "on" followed by an "on" key.

* * * * *